US009132652B2

(12) United States Patent
Ishizawa et al.

(10) Patent No.: US 9,132,652 B2
(45) Date of Patent: Sep. 15, 2015

(54) LIQUID CONTAINER

(71) Applicant: SEIKO EPSON CORPORATION, Tokyo (JP)

(72) Inventors: Taku Ishizawa, Nagano (JP); Hiroyuki Kawate, Yamanashi (JP); Katsutomo Tsukahara, Nagano (JP); Yoshiyuki Tanaka, Nagano (JP); Tokujiro Okuno, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/278,346

(22) Filed: May 15, 2014

(65) Prior Publication Data

US 2014/0362148 A1 Dec. 11, 2014

(30) Foreign Application Priority Data

Jun. 6, 2013 (JP) ..... 2013-119571
Mar. 14, 2014 (JP) ..... 2014-051103

(51) Int. Cl.
*B41J 2/175* (2006.01)

(52) U.S. Cl.
CPC ..... *B41J 2/17523* (2013.01)

(58) Field of Classification Search
USPC ..... 347/86
See application file for complete search history.

(56) References Cited

U.S. PATENT DOCUMENTS

2005/0057625 A1 3/2005 Ishizawa et al.
2005/0243149 A1 11/2005 Matsumoto
2013/0215201 A1* 8/2013 Murata ..... 347/86

FOREIGN PATENT DOCUMENTS

JP 2005-254570 A 9/2005
JP 2006-069030 A 3/2006
JP 2007-090646 A 4/2007
JP 2008-024006 A 2/2008
JP 2009-172918 A 8/2009
JP 2009-202346 A 9/2009

* cited by examiner

*Primary Examiner* — Stephen Meier
*Assistant Examiner* — Alexander D Shenderov
(74) *Attorney, Agent, or Firm* — Global IP Counselors, LLP

(57) ABSTRACT

A liquid container includes a liquid storage part with which one end portion is constituted of a plurality of film members, and a liquid supply part for supplying a liquid stored in the liquid storage part to a liquid consumption apparatus. The liquid supply part has a bonded part that is bonded to the film member at the one end portion of the liquid storage part, and a liquid supply tube part at which is formed a liquid supply port oriented in a direction intersecting with a bonding surface of the bonded part. The liquid supply tube part is provided so that at least one part of the liquid supply port overlaps with the bonded part as viewed in an axial direction of the liquid supply tube part from a side of the liquid supply port.

7 Claims, 58 Drawing Sheets

CROSS-SECTIONAL VIEW OF
18a-18a PORTION

LIQUID CONTAINER

CROSS-REFERENCE TO RELATED APPLICATIONS

This application claims priority to Japanese Patent Application No. 2013-119571 filed on Jun. 6, 2013 and Japanese Patent Application No. 2014-051103 filed on Mar. 14, 2014. The entire disclosure of Japanese Patent Application Nos. 2013-119571 and 2014-051103 is hereby incorporated herein by reference.

BACKGROUND

1. Technical Field

The present invention relates to a liquid container.

2. Related Art

One known type of ink cartridge (liquid container) has a flexible bag in which ink is stored. This bag is formed by, for example, welding a plurality of films together at the ends. This type of ink cartridge is usually provided with a liquid lead-out part. The liquid lead-out part is a rigid tube, and penetrates through to the interior of the bag. A flow path to the printer from the ink cartridge is ensured by inserting the liquid lead-out part to a predetermined position. In one known arrangement of the liquid lead-out part, the liquid lead-out part is sandwiched between bonding surfaces at the end of the bag, and projects out at an orientation parallel to the bonding surfaces (for example, Japanese laid-open patent publication No. 2005-254570). In another known arrangement, the liquid lead-out part is provided to a middle part of a film surface, penetrates through one film, and projects out at an orientation orthogonal to the bonding surface (for example, Japanese laid-open patent publication No. 60-217159).

The problem to be solved by the present invention resides in that it is difficult for an ink cartridge to be both reduced in size and improved in ease of assembly. The case of Japanese laid-open patent publication No. 2005-254570 results in an increase in size in the direction in which the liquid lead-out part projects out. In the case of Japanese laid-open patent publication No. 60-217159, the ease of assembly is poor because the liquid lead-out part is provided so as to penetrate through the one film. Additional desires include reducing the size of the apparatus, lowering costs, conserving resources, increasing the ease of manufacture, and improving the ease of use.

SUMMARY

The present invention has been made in order to solve at least one of the problems described above, and can be implemented as the following modes.

According to one mode of the present invention, provided is a liquid container comprising: a liquid storage part of which one end portion is constituted of a plurality of film members; and a liquid supply part for supplying a liquid stored in the liquid storage part to a liquid consumption apparatus. In this liquid container, the liquid supply part has a bonded part that is bonded to the film member at the one end portion of the liquid storage part, and a liquid supply tube part at which is formed a liquid supply port oriented in a direction intersecting with a bonding surface of the bonded part, the liquid supply tube part being provided such that at least a part of the liquid supply port overlaps with the bonded part as viewed in an axial direction of the liquid supply tube part from a side of the liquid supply port. According to this mode, the liquid supply part enters into the face direction of the film member of the liquid storage part, and therefore any increase in size of the liquid container in that direction is curbed. Thus, the ratio of the liquid storage space relative to the size of the liquid container overall is increased. Additionally, the ease of assembly is favorable because the liquid supply part can be mounted onto the end part of the liquid storage part.

In the mode described above, a notch part is provided to one part of the film member constituting the one end portion of the liquid storage part, and at least one portion of the liquid supply tube part is arranged so as to enter into the notch part. According to this mode, because the liquid storage tube part enters into the notch part, the film member is easily positioned relative to the liquid supply part. Additionally, any increase in the size of the liquid container overall can be curbed as well.

As another mode, provided is a liquid container comprising: a liquid storage part of which one end portion is constituted of a plurality of film members; and a liquid supply part for supplying a liquid stored in the liquid storage part to a liquid consumption apparatus. In this liquid container, the liquid supply part has a bonded part that is bonded to the film member at the one end portion of the liquid storage part, and a liquid supply tube part at which is formed a liquid supply port oriented in a direction intersecting with a bonding surface of the bonded part, a notch part being provided to one part of the film member constituting the one end portion of the liquid storage part, and at least one portion of the liquid supply tube part being arranged so as to enter into the notch part. According to this mode, because the liquid storage tube part enters into the notch part, the film member is easily positioned relative to the liquid supply part. Additionally, any increase in the size of the liquid container overall can be curbed as well.

In the move described above, the liquid supply part has an overhanging part overhanging more to an interior side of the liquid storage part than a position of the liquid supply tube part, at least one portion of a surface of the overhanging part is the bonding surface, and the overhanging part has inside thereof a connection flow path that connects the liquid supply port and an inside of the liquid storage part. According to this mode, because the overhanging part has the surface of bonding with the film member, the surface area of the surface of bonding can be increased. Hence, the bonding strength is improved and the possibility of liquid leakage is reduced. Additionally, because the connection flow path is provided to the interior of the overhanging part, a plurality of functions can be imparted to the overhanging part. Consequently, it is possible to curb any increase in size of the liquid supply part.

In the mode described above, the overhanging part has inside thereof a bypass flow path that connects the connection flow path and the inside of the liquid storage part. According to this mode, because the connection flow path and the bypass flow path are provided to the interior of the overhanging part, space can be used efficiently and any increase in size can be curbed.

In the mode described above, the liquid supply part is supported so as to be located further upward in the direction of the force of gravity than the liquid storage part in a state of having been connected to the liquid consumption apparatus, and such that the liquid supply port is oriented in an intersecting direction, which is a direction that intersects with the direction of the force of gravity. According to this mode, because the orientation of the liquid supply part intersects with the direction of the force of gravity, the connection part is easily seen when connected to the liquid consumption apparatus, and the connection is facilitated.

In the mode described above, the liquid supply part moves in the intersecting direction and is connected to the liquid consumption apparatus. According to this mode, because the liquid storage part follows when a force is made to act on the liquid supply part, the connection is facilitated.

DETAILED DESCRIPTION OF EXEMPLARY EMBODIMENTS

Embodiment 1

Configuration of Liquid Jet System 1000

Figure 1:
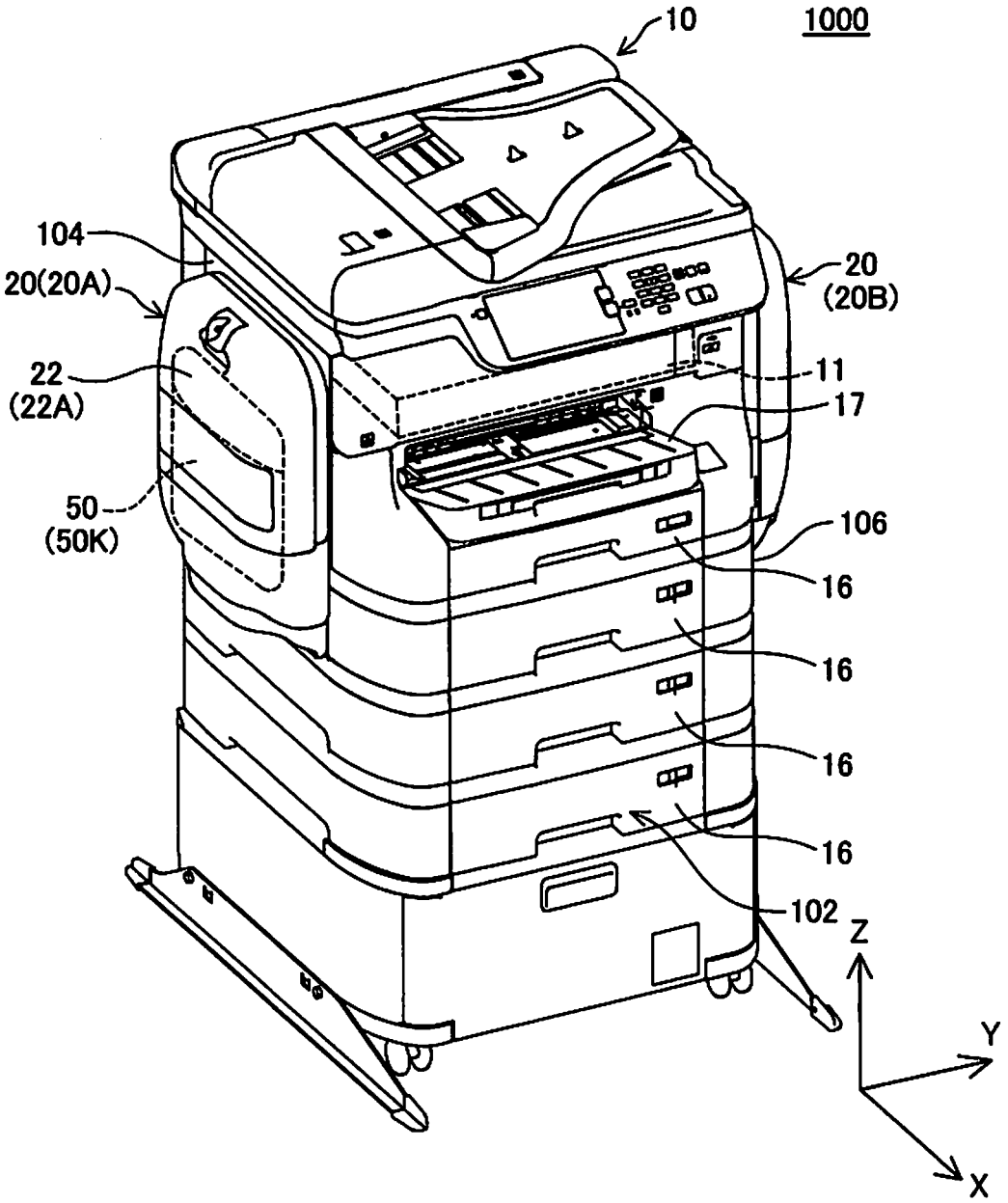
FIG. 1 is a perspective view illustrating the outer appearance of a liquid jet system.
Figure 2:
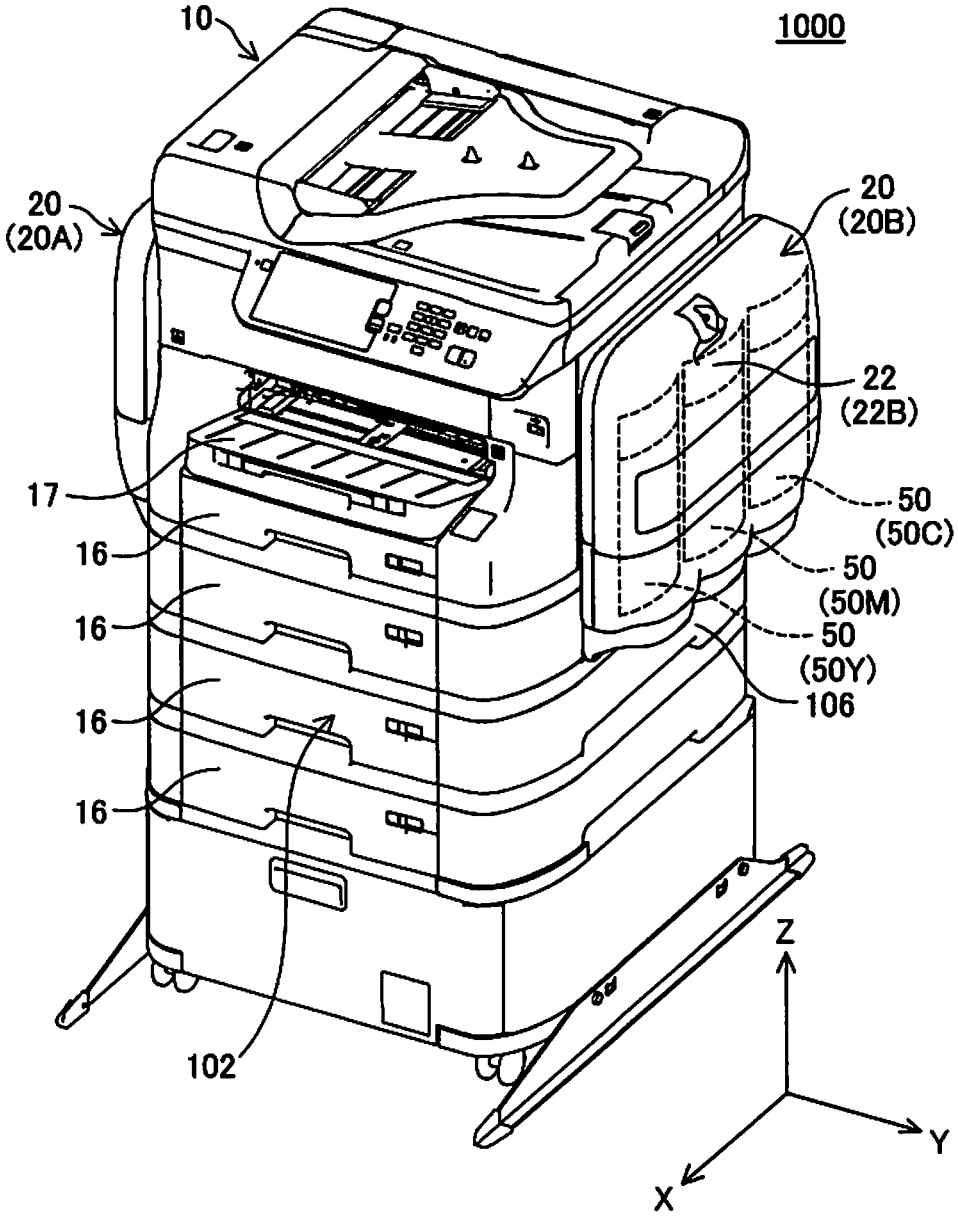
FIG. 2 is a perspective view illustrating the outer appearance of a liquid jet system.

FIGS. 1 and 2 are perspective views illustrating the outer appearance of a liquid jet system 1000. As illustrated in FIG. 1, the liquid jet system 1000 is provided with a printer 10 and two liquid supply apparatuses 20. The two liquid supply apparatuses 20 are each provided to two ends of the printer 10. In the state of use of the liquid jet system 1000, the printer 10 is installed on a horizontal surface. The XY plane is the horizontal plane, and the Z-axis direction is the direction of the force of gravity. The positive orientation of the Z-axis direction is the upward orientation in the direction of the force of gravity, and the negative orientation of the Z-axis direction is the downward orientation in the direction of the force of gravity. Below, the positive orientation of the Z-axis direction shall be denoted by the "+Z-axis direction" and the negative orientation of the Z-axis direction shall be denoted by the "−Z-axis direction". The other axes (the X-axis and Y-axis, as well as the K1-axis and K2-axis described below) shall also be similarly denoted.

The liquid supply apparatuses 20 supply ink to the printer 10. Liquid containers 50 (see FIG. 6, etc.) provided to the liquid supply apparatuses 20 can be detachably connected (mounted) to the printer 10.

The printer 10 is an inkjet printer. The printer 10 is provided with a recording mechanism 11, a plurality of paper feed trays 16, and a discharge tray 17. The plurality of paper feed trays 16 are provided to positions that are respectively different with respect to the Z-axis direction. The paper feed trays 16 are provided to an apparatus first surface 102 of the printer 10. The paper feed trays 16 store a recording medium (for example, paper) onto which an image such as text is printed (recorded) by the printer 10.

The recording mechanism 11 is provided with a recording head (not shown) for ejecting ink. The recording head has communication with the liquid supply apparatuses via a flow path line such as a tube. The recording head uses the ink supplied from the liquid supply apparatuses 20, and records (prints) by ejecting ink onto the recording medium. The recording medium that has been recorded on is discharged to the discharge tray 17.

The two liquid supply apparatuses 20 are provided to an apparatus second surface 104 and an apparatus third surface 106 intersecting with the apparatus first surface 102 of the printer 10. The apparatus first surface 102 to apparatus third surface 106 are each plans substantially perpendicular to a surface of installation in the state of use of the printer 10. The liquid supply apparatus 20 that is provided to the apparatus second surface 104 is also called a "first liquid supply apparatus 20A", and the liquid supply apparatus 20 that is provided to the apparatus third surface 106 is also called a "second liquid supply apparatus 20B". The first and second liquid supply apparatuses 20A, 20B are simply called "the liquid supply apparatuses 20" when being discussed without differentiation between the two.

Figure 3:
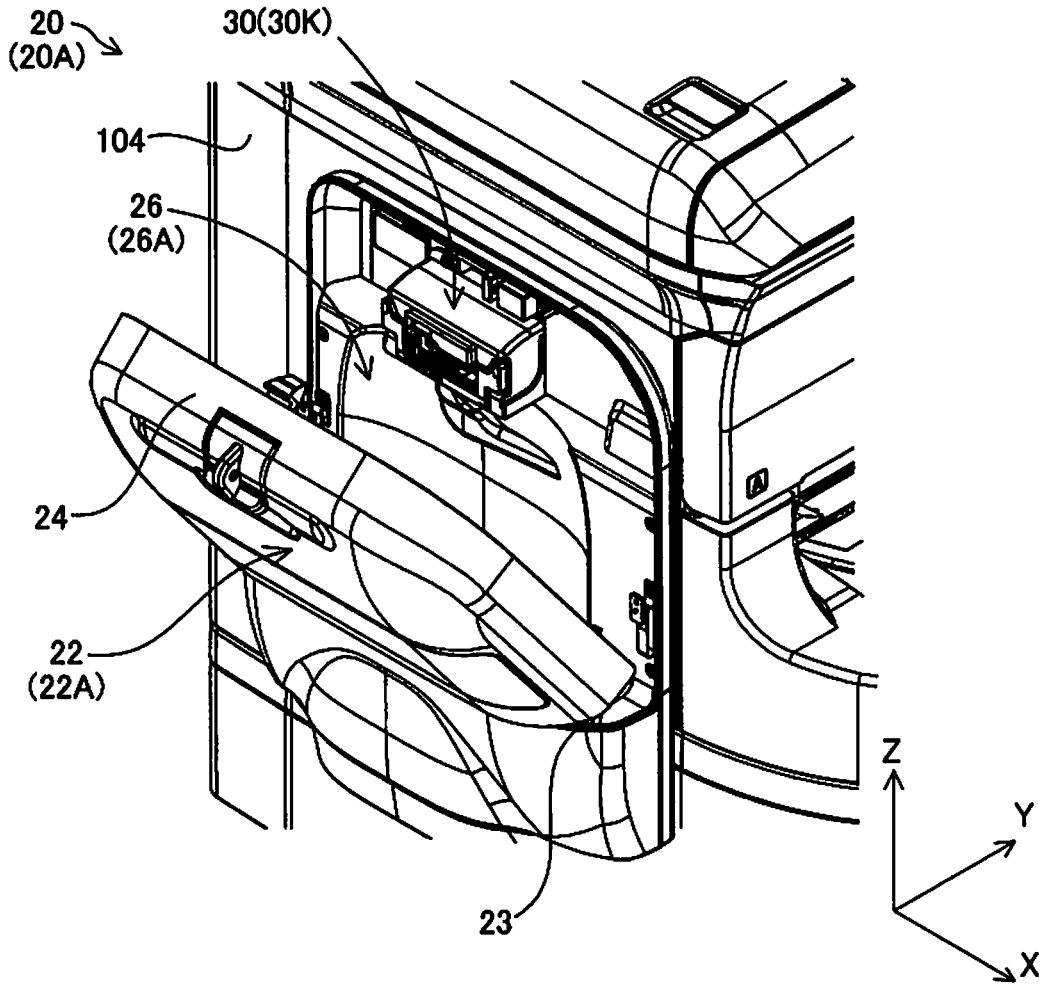
FIG. 3 is a drawing for describing storage with a liquid container.

As shown in FIG. 1, the first liquid supply apparatus 20A is provided with one cover member 22, one liquid container 50 (see FIGS. 6 and 7), and one detachable unit 30 (see FIG. 3). In FIG. 2, the liquid container 50 is covered by the cover member 22, and therefore is not depicted. As illustrated in FIG. 2, the second liquid supply apparatus 20B is provided with one cover member 22, three liquid containers 50, and three detachable units 30 corresponding respectively to the liquid containers 50 (see FIG. 4). Below, the reference numerals "22A" and "22B' shall be used when a distinction is being made between the two cover members 22. The reference numerals "50K", "50C", "50M", and "SOY" shall be used when a distinction is being made among the four liquid containers 50. The reference numerals "30K", "30C", "30M", and "30Y" shall be used when a distinction is being made among the four detachable units 30.

The four liquid containers 50 each store inks of respectively different colors. In the embodiment 1, a different liquid container 50 stores yellow (Y), magenta (M), cyan (C), and black (K) ink, respectively. The liquid container 50K stores black ink, the liquid container 50C stores cyan ink, the liquid container 50M stores magenta ink, and the liquid container 50Y stores yellow ink.

Figure 4:
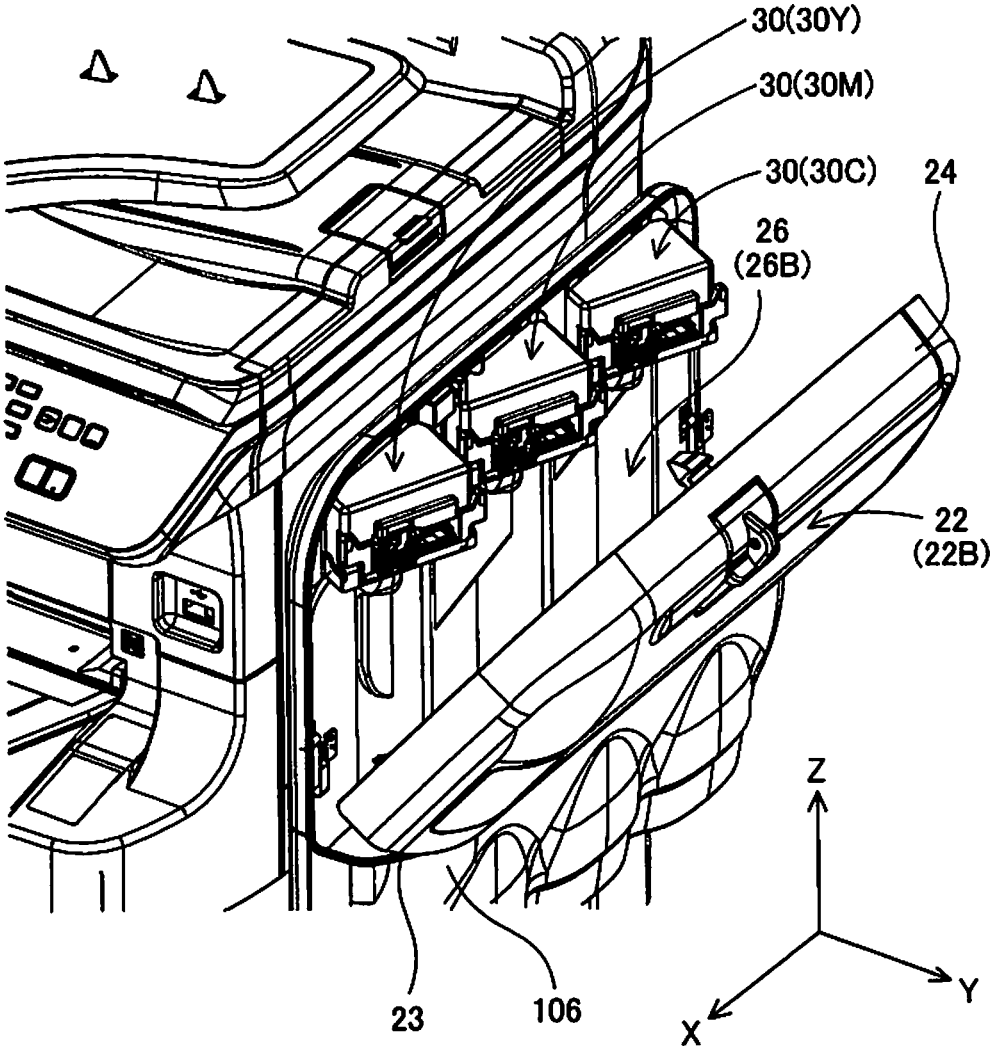
FIG. 4 is a drawing for describing storage with a liquid container.

FIGS. 3 and 4 are drawings for describing storage with the liquid containers 50. FIGS. 3 and 4 illustrate a state where the liquid containers 50 have been removed. As illustrated in FIGS. 3 and 4, the liquid containers 50 are stored in storage space parts 26 demarcated with the cover members 22. More specifically, the liquid container 50K is stored in the storage space part 26A (FIG. 3), and the liquid containers 50C, 50M, 50Y are stored in the storage space part 26B (FIG. 4). The detachable units 30 illustrated in FIGS. 3 and 4 are shown in a state where a movable member 40 (see FIGS. 37 to 42) has been pushed in. A case where a liquid container 50 is being mounted would be a state where the movable member 40 has been pulled out.

The liquid containers 50 are detachably mounted onto the detachable units 30 illustrated in FIGS. 3 and 4. The detachable unit 30K is arranged on the inside of the cover member 22A. The detachable units 30C, 30M, 30Y are arranged on the inside of the cover member 22B. As illustrated in FIG. 3, the detachable unit 30K is provided to the apparatus second surface 104 of the printer 10. As illustrated in FIG. 4, the detachable units 30C, 30M, 30Y are provided to the apparatus third surface 106 of the printer 10. In a case where the liquid containers 50 have been mounted onto the detachable units 30, then the inks that are stored in the liquid containers 50 are supplied to the recording head of the printer 10.

The cover members 22 are configured so as to be openable and closable. This opening and closing, as illustrated in FIGS. 3 and 4, is realized by when one end 23 of the −Z-axis direction side serves as a fulcrum about which another end 24 of the +Z-axis direction side is rotated. When the cover members 22 are opened, the upper part opens up and the liquid containers 50 can be taken up and out from the detachable units 30 or mounted from above. A liquid container 50 is replaced when only a little ink remains stored in the liquid container 50. A user is able to achieve this replacement by opening the cover member 22, detaching a new liquid container 50 onto the detachable unit 30, and closing the cover member 22.

Figure 5:
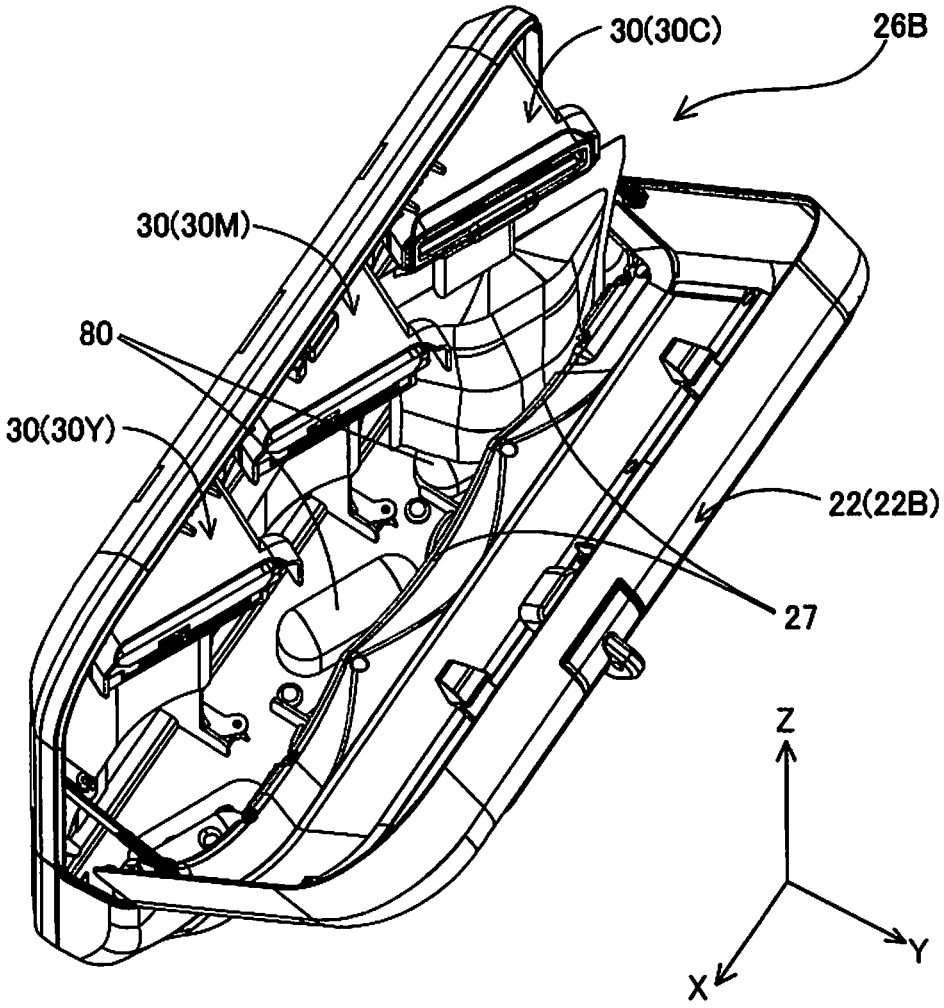
FIG. 5 is a perspective view illustrating a storage space part.

FIG. 5 is a perspective view illustrating the storage space part 26B (a storage part). FIG. 5 illustrates a state where the storage space part 26B stores the liquid container 50C. As illustrated in FIG. 5, the storage space part 26B is provided with a guide part 27 and an abutment part 80. The guide part 27 and the abutment part 80 are provided to every one of the three detachable units 30. The abutment part 80 is provided integrally with the storage space part 26B. The abutment part 80 abuts against the liquid container 50 in the state where the liquid container 50 has been mounted onto the detachable unit 30. The abutment part 80 has a curved convex shape (a convex curve) or projection as illustrated in FIG. 5, in order to prevent damage to the liquid container 50. The abutment part 80 shall be described below along with FIGS. 44 to 50.

When the user is inserting the liquid container 50 into the storage space part 26B from the exterior, this insertion is guided by the guide part 27. This guiding is executed such that a third film 523 (see FIG. 6), which is the bottom of the liquid container 50, abuts against the abutment part 80. The guide part 27 has a curved concave shape, as illustrated in FIG. 5, for the purpose of this guiding. The storage space part 26A, like the storage space part 28B, is also provided with the guide part 27 and the abutment part 80.

Configuration of Liquid Container 50

Figure 6:
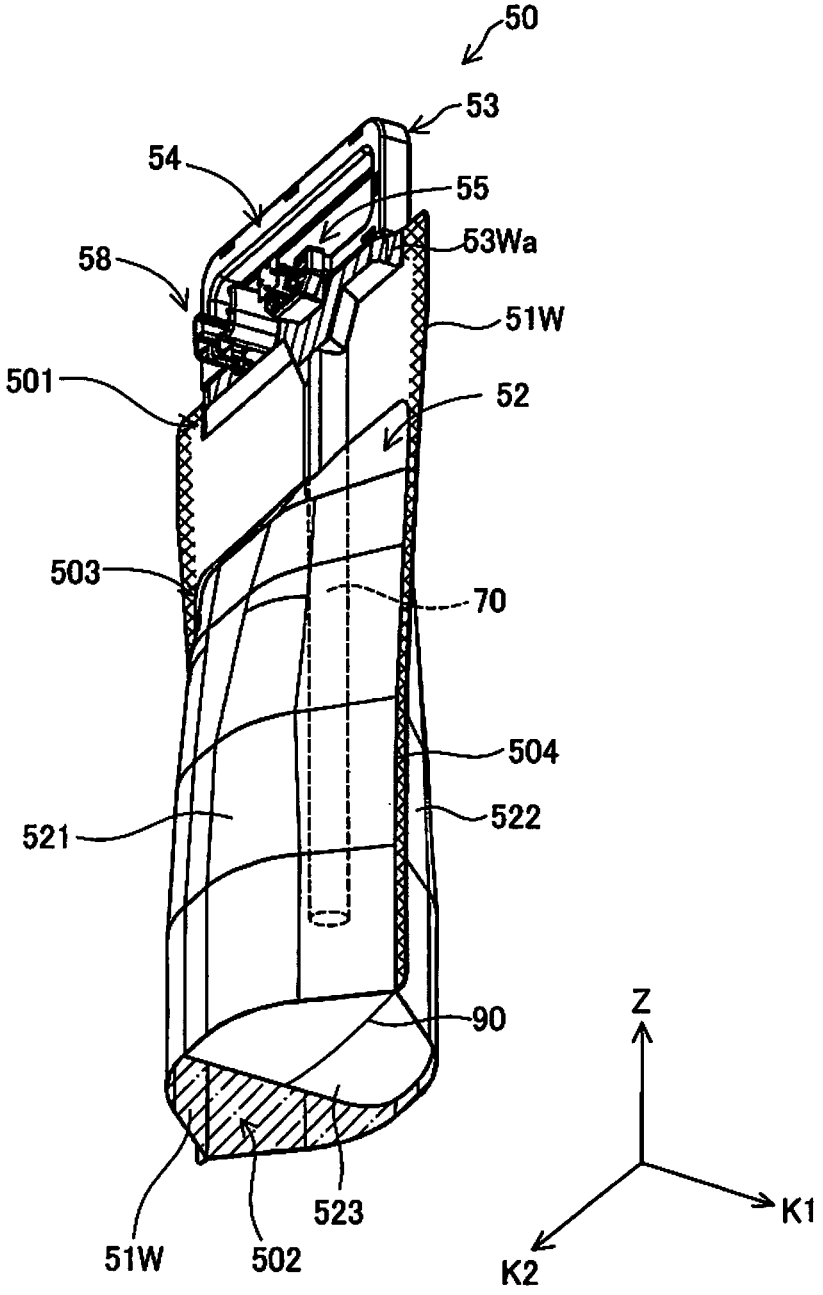
FIG. 6 is a perspective view illustrating the outer appearance of a liquid container.
Figure 7:
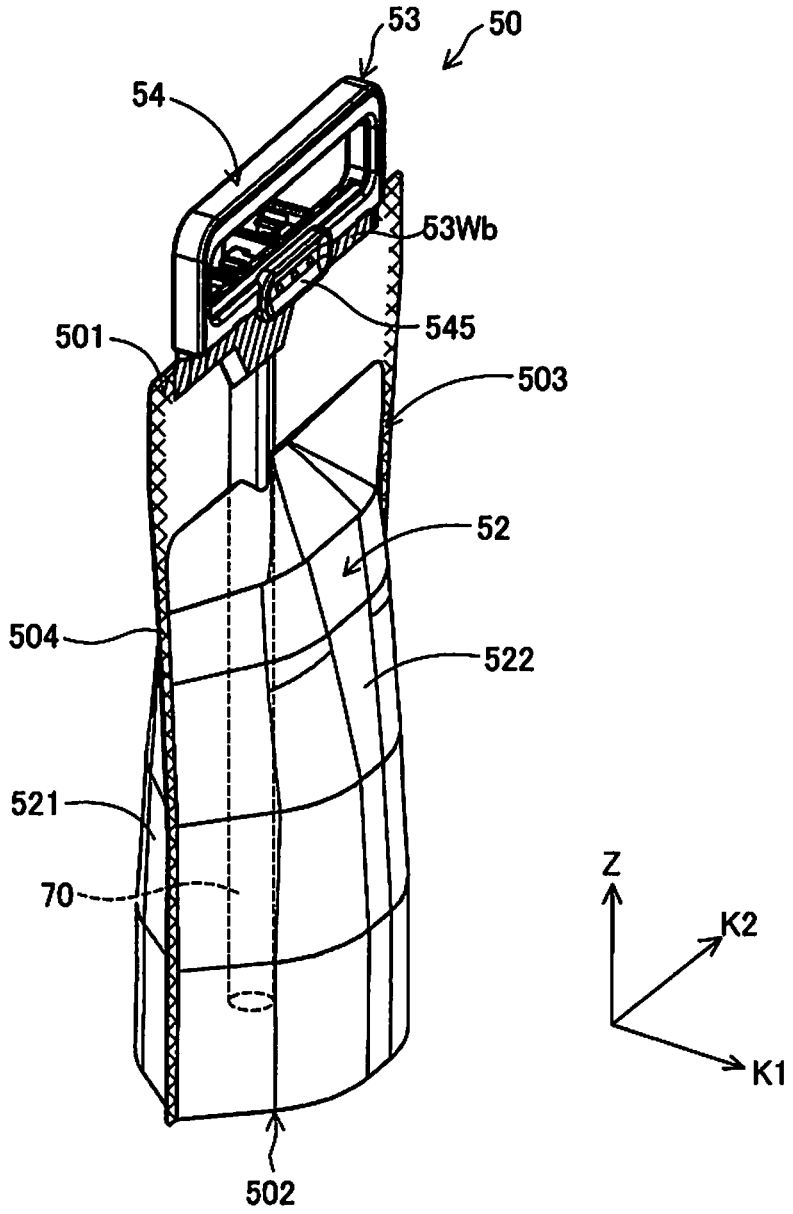
FIG. 7 is a perspective view illustrating the outer appearance of a liquid container.
Figure 8:
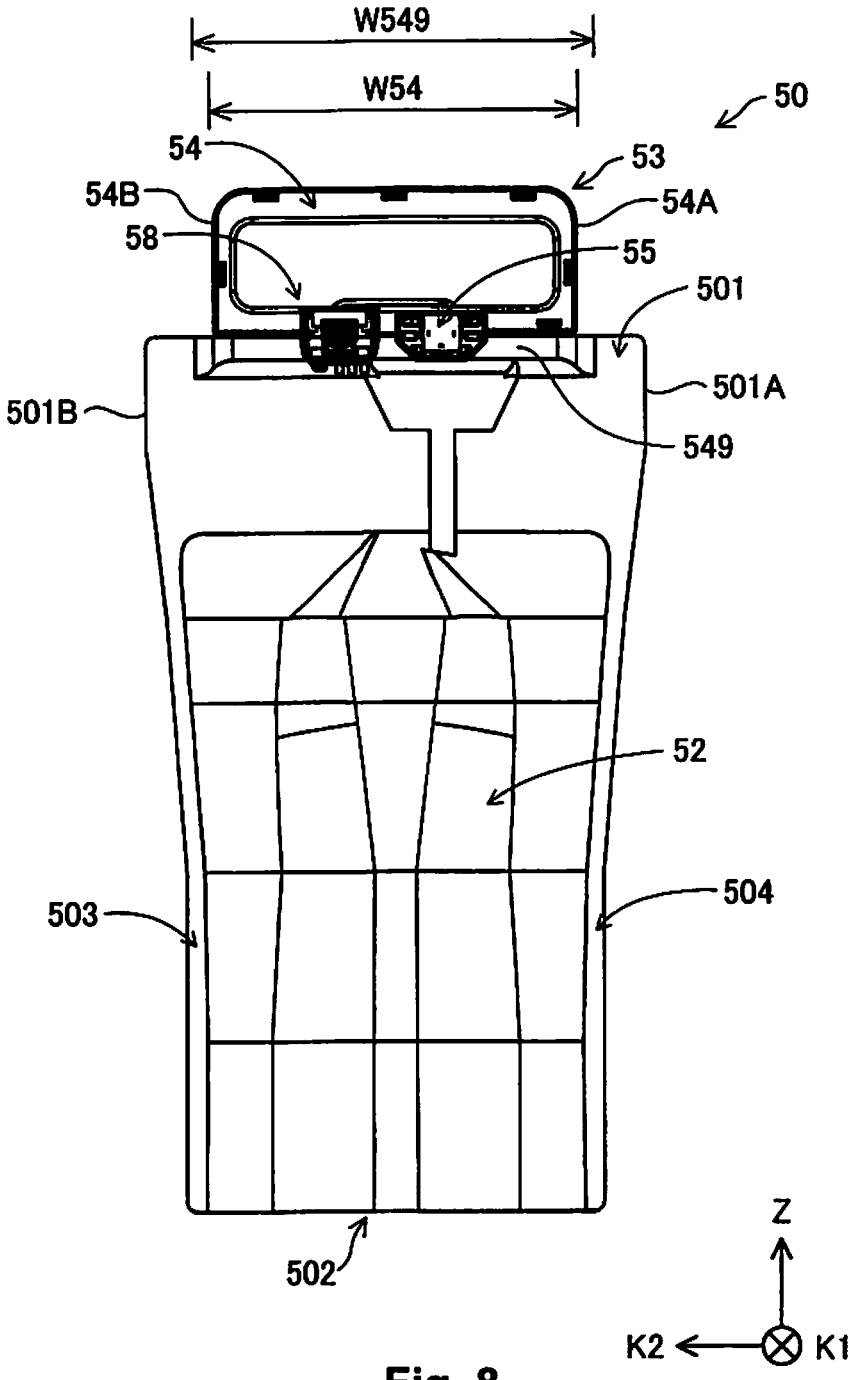
FIG. 8 is a front view illustrating the outer appearance of a liquid container.

FIGS. 6 and 7 are perspective views illustrating the outer appearance of the liquid container 50. FIG. 8 is a front view illustrating the outer appearance of the liquid container 50. FIGS. 6, 7, and 8 illustrate the Z-axis, the K1-axis, and the K2-axis in a state (mounted state) where the liquid container 50 has been mounted onto the detachable unit 30. The Z-axis is the same as the Z-axis that is illustrated in FIGS. 1 and 2.

FIGS. 6 and 7 illustrate a state prior to filling with ink and mounting onto the detachable unit 30. As illustrated in FIGS. 6 and 7, the liquid container 50 is provided with a liquid storage bag 52 and an operation member 53. The operation member 53 is provided with a grip part 54, a liquid supply unit 55, a substrate unit 58, and a pressing part 545. The grip part 54 is a portion for the user to be able to grasp the liquid container 50.

The liquid storage bag 52 is able to store the ink. The liquid storage bag 52 is attached to the operation member 53 in a state where a bag surface is exposed. That is to say, the liquid storage bag 52 is not stored in a case or the like, but rather is configured so as to allow viewing from the exterior.

A side of the liquid storage bag 52 to which the operation member 53 is attached is defined as one end 501 side, and the opposite side to the one end 501 is defined as another end 502 side. The end of the liquid storage bag 52 on the +K2-axis direction side is defined as a first side end 503 side, and the end on the −K2-axis direction side is defined as a second side end 504 side.

As illustrated in FIG. 8, the liquid supply unit 55 and the substrate unit 58 are positioned at the one end 502 side of the liquid storage bag 52. As illustrated in FIG. 8, when the liquid container 50 is viewed along the K1-axis direction, then the liquid supply unit 55 and the substrate unit 58 are positioned so as to overlap at least partially with the one end 501. In other words, respective lower ends of the liquid supply unit 55 and the substrate unit 58 are positioned more to the −Z-axis direction side than an upper end of the one end 501.

The liquid storage bag 52 has a first film 521, a second film 522 (FIG. 6), and a third film 523. The first through third films 521 to 523 demarcate a space for storing ink on the inside. As illustrated in FIGS. 6 and 7, the first film 521 and the second film 522 constitute a side surface of the liquid storage bag 52. As illustrated in FIG. 6, the third film 523 constitute a bottom surface of the liquid storage bag 52. The first film 521 and the second film 522 are arranged face to face. The first film 521 and the second film 522 have a margin region 51W parts of which are welded to one another. More specifically, a one end 501-side portion, first side end 503-side portion, and second side end 504-side portion of the margin regions 51W are welded together. The crosshatching added to FIGS. 6 and 7 illustrates the portion where the first and second films 521, 522 are compress-bonded.

The one end 501 of the liquid storage bag 52 (more specifically, one end of the first and second films 521, 522) is welded to a bonded part 549 (see FIGS. 15 and 16) of the operation member 53. More specifically, a liquid supply part 53B of the operation member 53 is sandwiched between the first film 521 and second film 522 constituting the one end part 501 of the liquid storage bag 52, a bonded part 549*a* of the liquid supply part 53B is bonded to an inside surface of the first film 521, and a bonded part 549*b* is bonded to an inside surface of the second film 522. In this manner, the operation member 53 is a member that can be attached to the one end 501 of the liquid storage bag 52. The single hatching with a solid line added to FIGS. 6 and 7 illustrates a peripheral region 53W, which is a portion of welding between the operation member 53 and the first and second films 521, 522.

As for the third film 523, a margin region 51W of the third film 523 and the margin region 51W of the first film 521 and the second film 522 are partially welded together. The single hatching with the single-dot dashed line added to FIG. 6 illustrates a portion where the third film 523 is welded to the first and second films 521, 522. The third film 523 functions as a gusset part.

Each of the first through third films 521 to 523 is flexible. Examples of materials used for the first through third films 521 to 523 include polyethylene terephthalate (PET), nylon, or polyethylene. This flexibility of the liquid storage bag 52 causes a reduction in the amount of ink stored to be accompanied by a reduction in the volume of the interior.

The liquid container 50 has a flow path member 70 for causing the ink stored in the liquid storage bag 52 to flow into the liquid supply unit 55 (the liquid supply part 53B, to be described in greater detail below). The flow path member 70 is arranged on the inside of the liquid storage bag 52.

The relationships among each of the parts of the liquid container 50 shall now be described with reference to FIG. 8. The width of the grip part 54 running along the K2-axis direction of the one end 501 of the liquid storage bag 52 is understood to be a width W54. The width of the bonded part 549 running along the K2-axis direction of the bonded part 549 is understood to be a width W549. The width W54 is the distance between one end part 54A and another end part 54B of the grip part 54 in the K2-axis direction. In this case, the width W54 is smaller than the width W549. Regarding the K2-axis direction, the liquid supply unit 55 and the substrate unit 58 are positioned between the two end parts 54A, 54B of the grip part 54.

Figure 9:
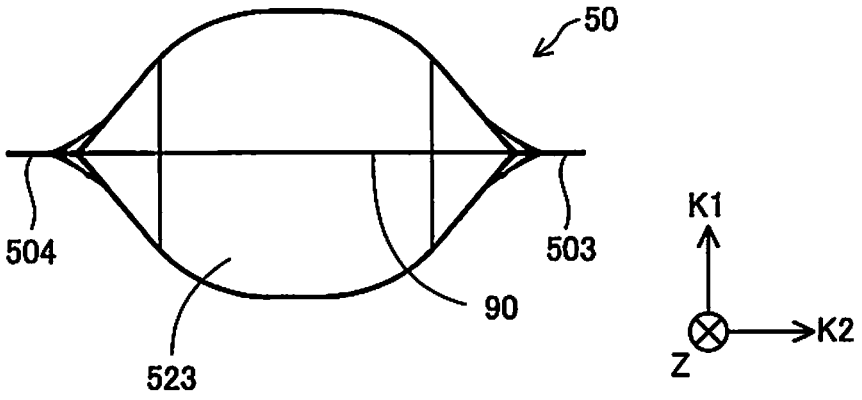
FIG. 9 is a bottom view illustrating the outer appearance of a liquid container.

FIG. 9 is a bottom view illustrating the outer appearance of the liquid container 50. As is illustrated in FIG. 9, a crease 90 is added to the third film 523. The crease 90, as is illustrated in FIG. 9, is provided so as to connect the first side end 503 and the second side end 504. When the volume of the interior of the liquid storage bag 52 is reduced, then the third film 523 is folded along the crease 90. This manner of folding of the third film 523 causes the reduction in the volume of the interior of the liquid storage bag 52 to proceed smoothly. As a result, the amount of residual ink is reduced. "Residual ink" refers to ink that remains in a liquid storage bag 52 being pulled out (taken out) during replacement of the liquid containers 50.

Figure 10:
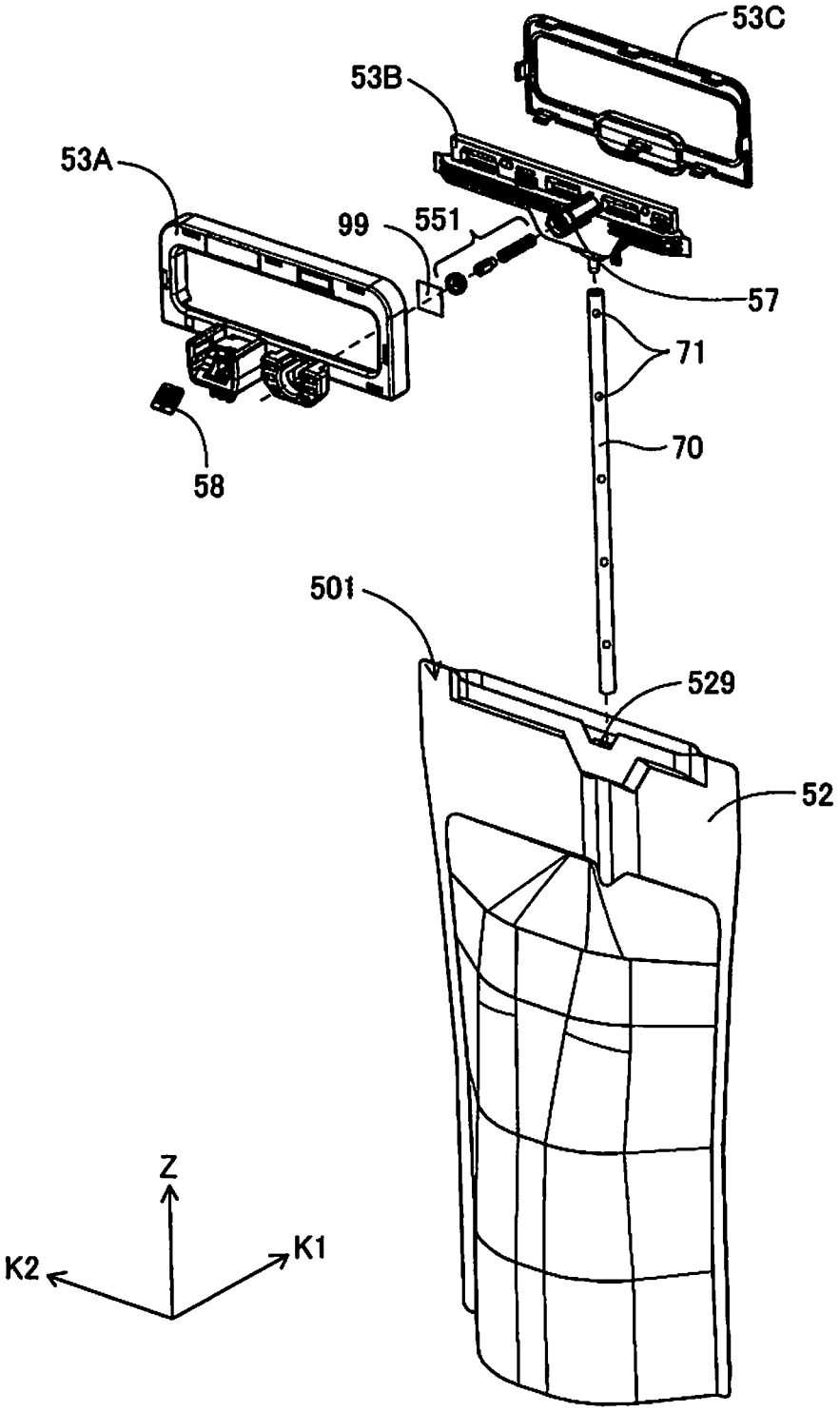
FIG. 10 is a perspective view illustrating an exploded view of a liquid container.

FIG. 10 is a perspective view illustrating an exploded view of the liquid container 50. The liquid container 50 is provided with the liquid storage bag 52, a joining member 53A, the liquid supply part 53B, a pressing member 53C, the substrate unit 58, the flow path member 70, a sealing film 99, and a valve mechanism 551.

The liquid storage bag 52 is provided with a notch part 529. The notch part 529 is a notch provided to the one end 501. The notch part 529 is provided in order to avoid interference between a liquid supply tube part 57 and the one end 501 when the liquid supply part 53B and the liquid storage bag 52 are being welded together.

The flow path member 70 is a tubular member through the interior of which the ink flows. The flow path member 70 is provided with a plurality of holes 71. The holes 71 are holes that penetrate through an outer wall and inner wall of the flow path member 70. The provision of the holes 71 makes it possible for the ink to flow in and flow out not only from an opening end of the flow path member 70 but also from the holes 71.

Figure 11:
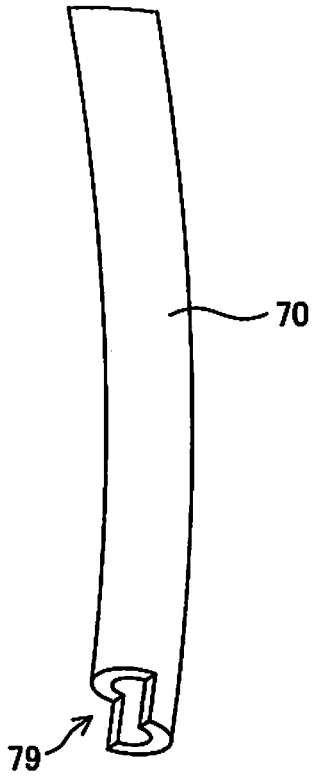
FIG. 11 is a perspective view illustrating near an opening end of a flow path member.

FIG. 11 illustrates near the opening end of the flow path member 70. The flow path member 70 is provided with a cut part 79 at a lower end. The cut part 79 is a surface formed when a part of the walls of the flow path member is cut near the opening end. The provision of the cut part 79 allows the ink near the bottom inside the liquid storage bag 52 to more readily flow into the opening end of the flow path member 70 especially in a case where little of the ink still remains.

Figure 12:
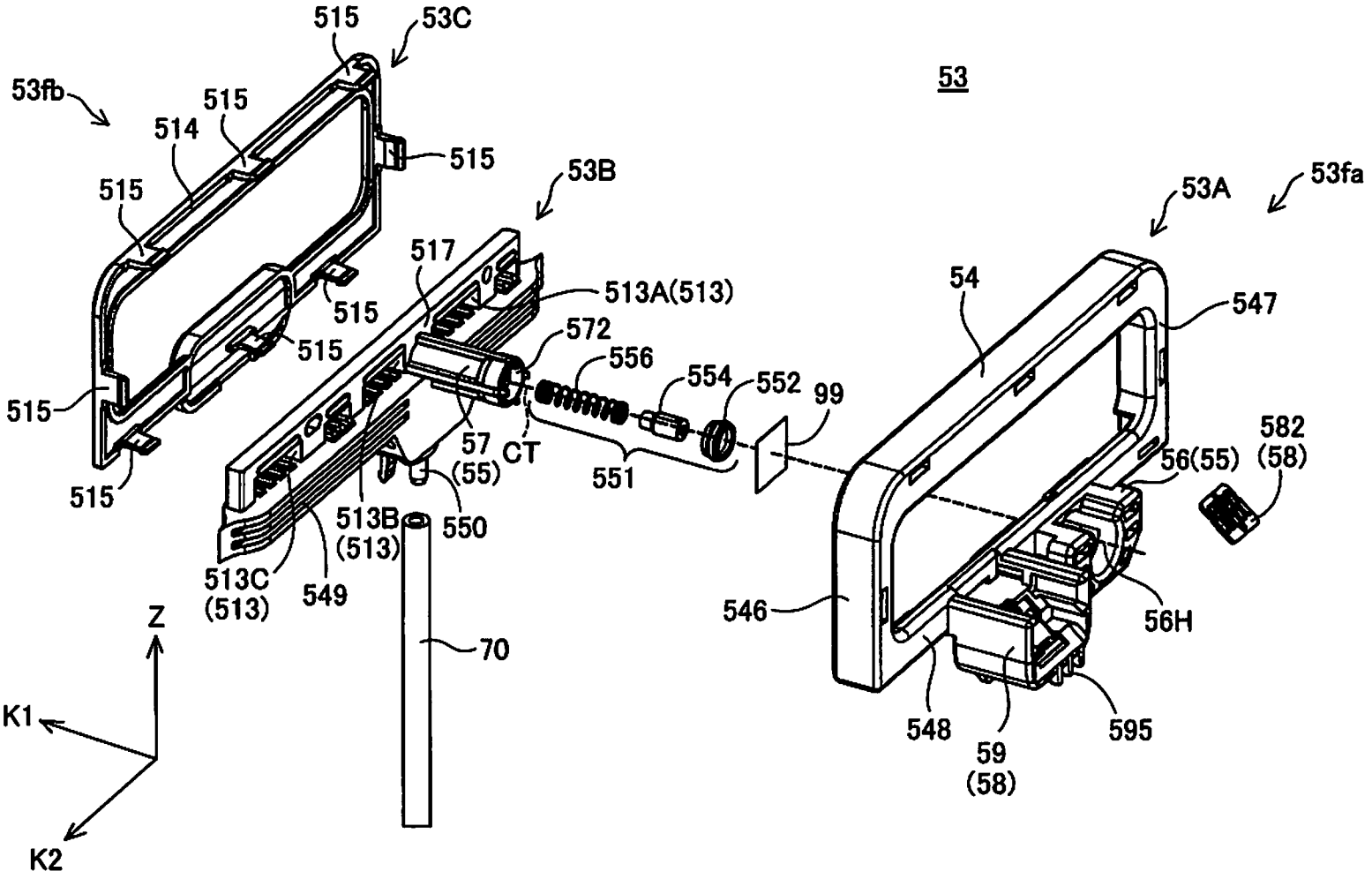
FIG. 12 is a perspective view illustrating an exploded view of an operation member.
Figure 13:
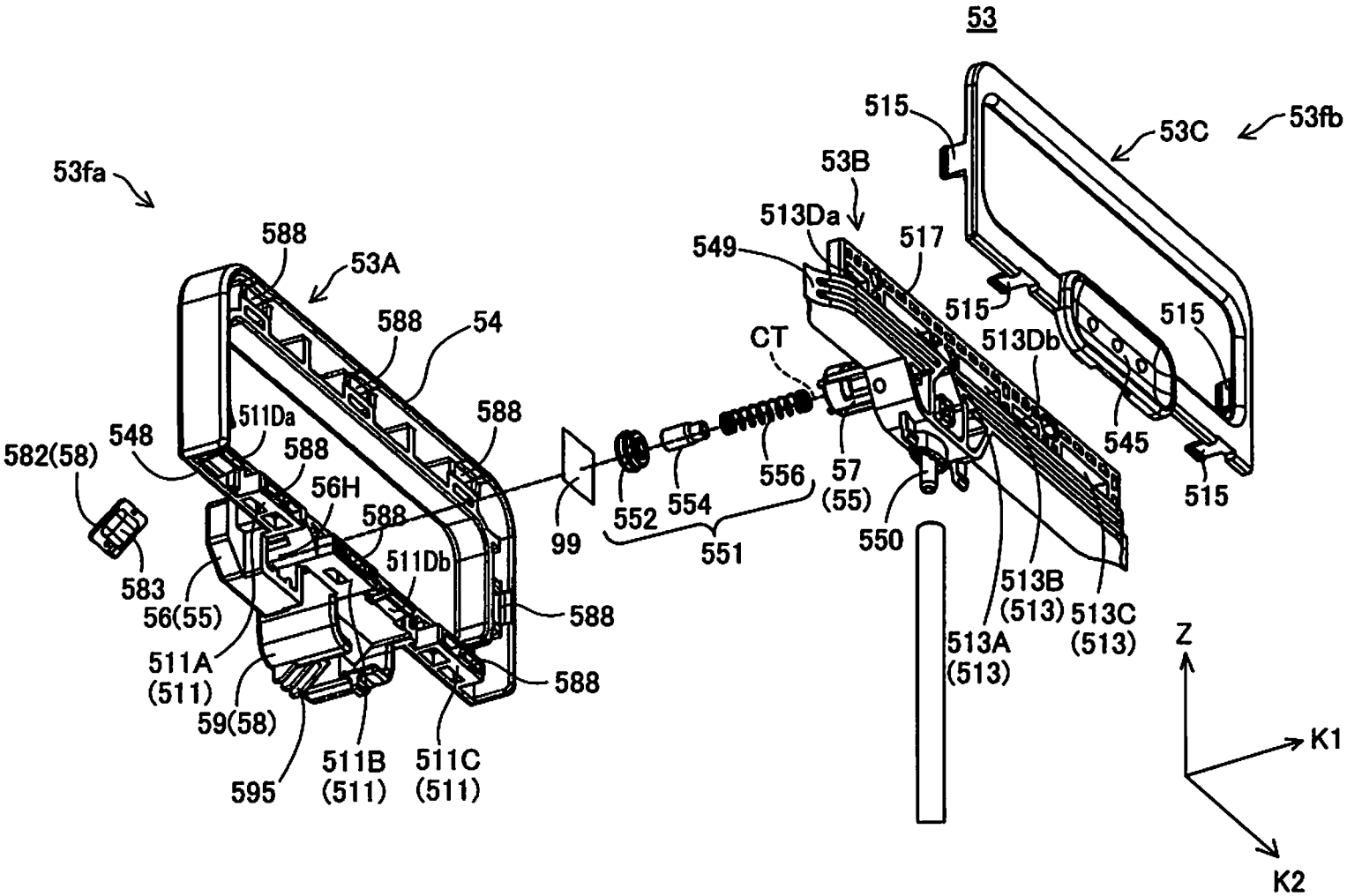
FIG. 13 is a perspective view illustrating an exploded view of an operation member.

FIGS. 12 and 13 are perspective views illustrating an exploded view of the operation member 53. As illustrated in FIGS. 12 and 13, the operation member 53 is provided with the joining member 53A, the liquid supply part 53B, and the pressing member 53C. The joining member 53A and the pressing member 53C are combined so as to sandwich the liquid supply part 53B. The joining member 53A through the pressing member 53C are manufactured by resin molding. In the embodiment 1, respectively different materials are used for the resin molding of the joining member 53A through the pressing member 53C. The material used for the joining member 53A has a higher mechanical rigidity than that of the liquid supply part 53B.

As illustrated in FIGS. 12 and 13, the −K1-axis direction side is defined as a first side 53*fa* of the operation member 53, and the +K1-axis direction side is defined as a second side 53*fb*.

The joining member 53A comprises the grip part 54. The shape of the grip part 54 is that of a rod. The joining member 53A is a plate-shaped member that runs along the plane perpendicular to the K1-axis direction (a center axis CT direction of the liquid supply tube part 57). A positioning part 56 and a circuit board retention part 59 are connected by integral molding to a base part 548 (more specifically a first side 53*fa* portion of the base part 548) of the joining member 53A.

As illustrated in FIG. 13, the joining member 53A has three engagement parts 511A, 511B, 551C at the second side 53*fb*. The engagement parts 511A, 511B, 511C are members for linking (connecting) the km and the liquid supply part 53B by engaging with the liquid supply part 53B. The engagement parts 511 are convexities that project out to the liquid supply part 53B side (the +K1-axis direction) from the base part 548. The three engagement parts 511A, 511B, 511C are arranged side by side along the K2-axis direction (the direction in which the positioning part 56 and the circuit board retention part 59 are arranged side by side). The reference numeral "511" shall be used when no distinction is being made among the three engagement parts 511A, 511B, 511C.

The engagement parts 511 are provided to the second side 53*fb* side of the base part 548. The shape of the engagement parts 511 is substantially a rectangular parallelepiped. That is to say, the outline of the engagement parts 511 is substantially rectangular and is a shape that surrounds an imaginary straight line running along the K1-axis direction.

As illustrated in FIG. 13, the joining member 53A is provided with eight (only seven are depicted) member engagement parts 588 at the second side 53*fb*. The member engagement parts have a concave shape and are for linking the joining member 53A and the pressing member 53C together by engaging with the pressing member 53C.

As illustrated in FIGS. 12 and 13, the liquid supply part 53B is provided with the liquid supply tube part 57 and the bonded part 549. The liquid supply tube part 57 and the bonded part 549 are formed integrally as a part of the liquid supply part 53B.

The liquid supply part 53B has three engagement parts 513A, 513B, 513C. The engagement parts 513A, 513B, 513C are for attaching the joining member 53A to the liquid supply part 53B by engaging with the engagement parts 511. The reference numeral "513" shall be used for when a distinction is not being made among the three engagement parts 513A, 513B, 513C.

The three engagement parts 513A, 513B, 513C are provided so as to correspond to the three engagement parts 511A, 511B, 511C of the joining member 53A. The engagement parts 513 are holes penetrating through in the K1-axis direction. The external shape of the engagement parts 513 is such that the engagement parts 511 can be fitted therewith. That is to say, the outer shape of the engagement parts 513 is substantially rectangular and is a shape that surrounds a direction (the K1-axis direction) that runs along the K1-axis direction (the center axis CT direction of the liquid supply tube part 57).

Sealing Ink in Liquid Container 50

Figure 14:
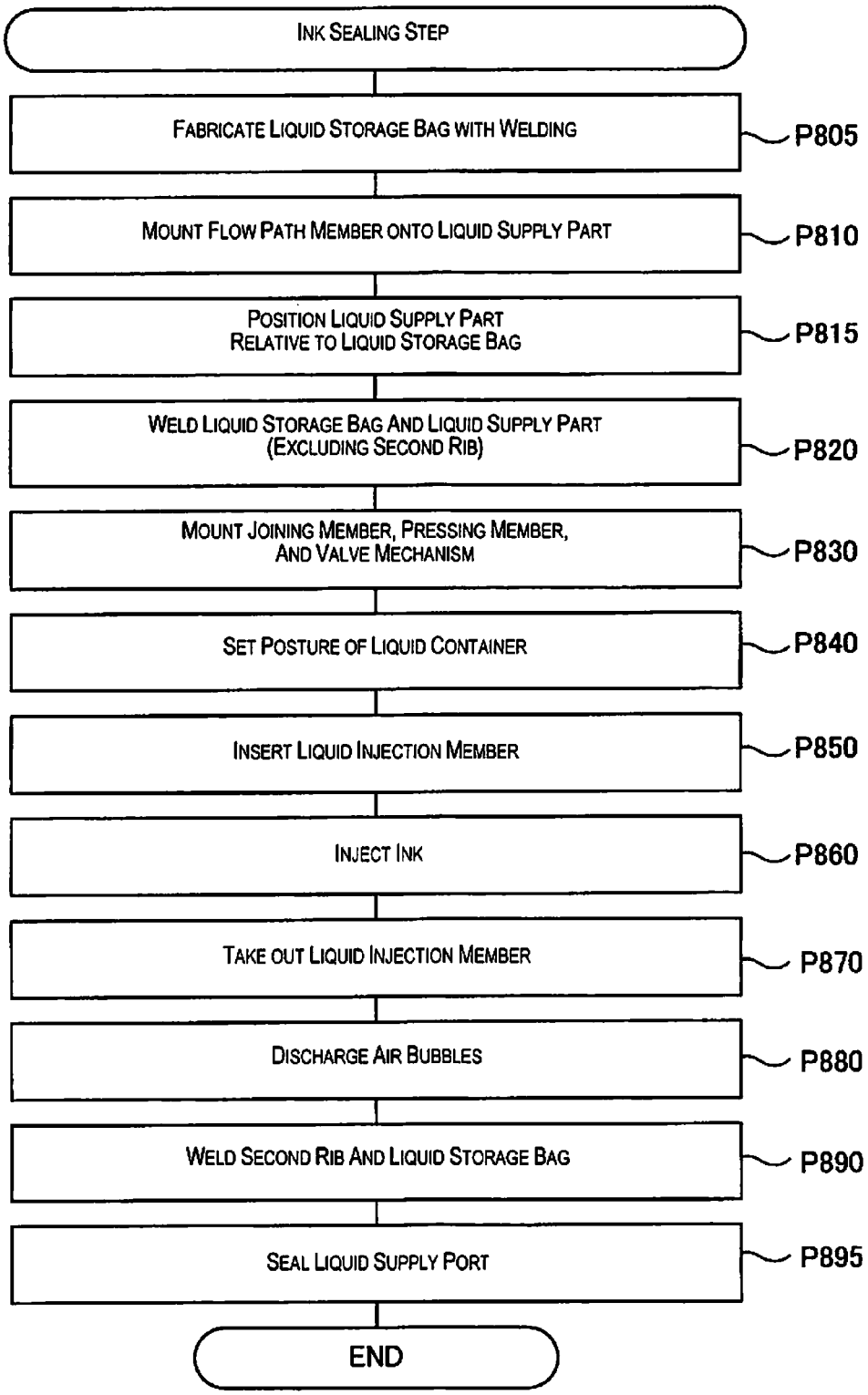
FIG. 14 is an operation flow chart illustrating an ink sealing step.

FIG. 14 is an operation flow chart illustrating an ink sealing step. The ink sealing step is a step for completing a liquid container 50 that stores ink, from a disassembled state such as is shown in FIG. 10.

First, the liquid storage bag 52 is fabricated by welding (step P805). More specifically, the liquid storage bag 52 is fabricated by welding the margin region 51W of the first through third films 521 to 523. Next, the flow path member 70 is welded to the liquid supply part 53B (step P810). More specifically, a lead-out part 550 is inserted into the flow path member 70 interior (see FIGS. 12 and 13).

Then, the liquid supply part 53B is positioned relative to the liquid storage bag 52 (step P815). More specifically, the mounted flow path member 70 is inserted into the liquid storage bag 52 interior, and the bonded part 549 of the liquid supply part 53B is positioned relative to first and second sheet members 521, 522. This positioning is executed by when the liquid supply tube part 57 contacts the notch part 529. This positioning is implemented for the purpose of the subsequent welding.

Next, the liquid storage bag 52 and the liquid supply part 53B are welded together (step P820). However, in the step P820, welding at a second rib 660 (see FIG. 15) is not implemented.

Figure 15:
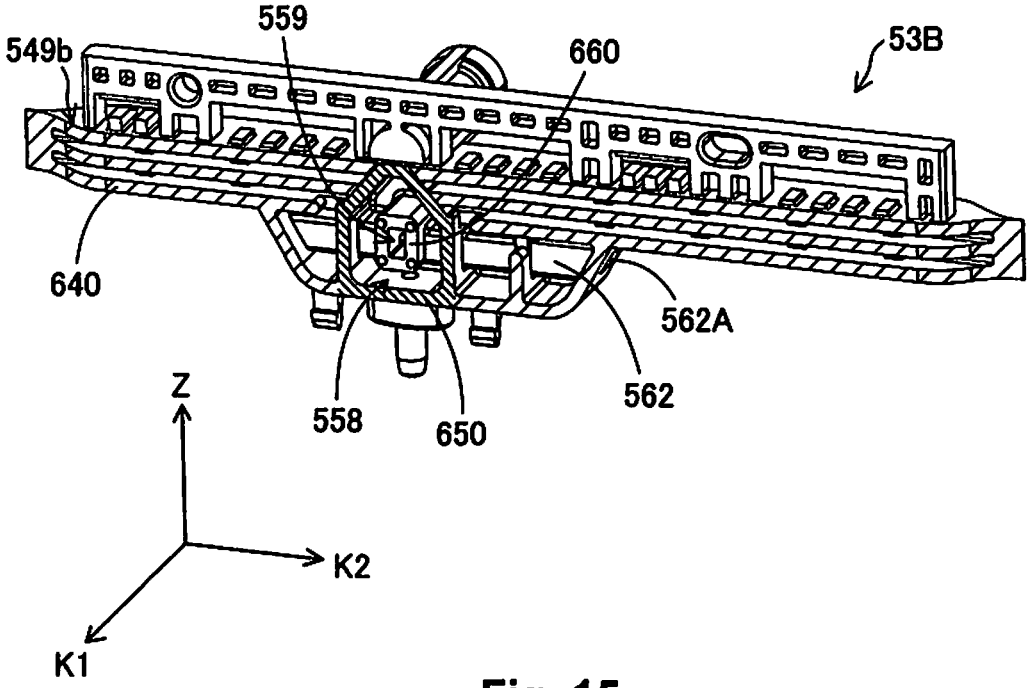
FIG. 15 is a perspective view of a liquid supply part.
Figure 16:
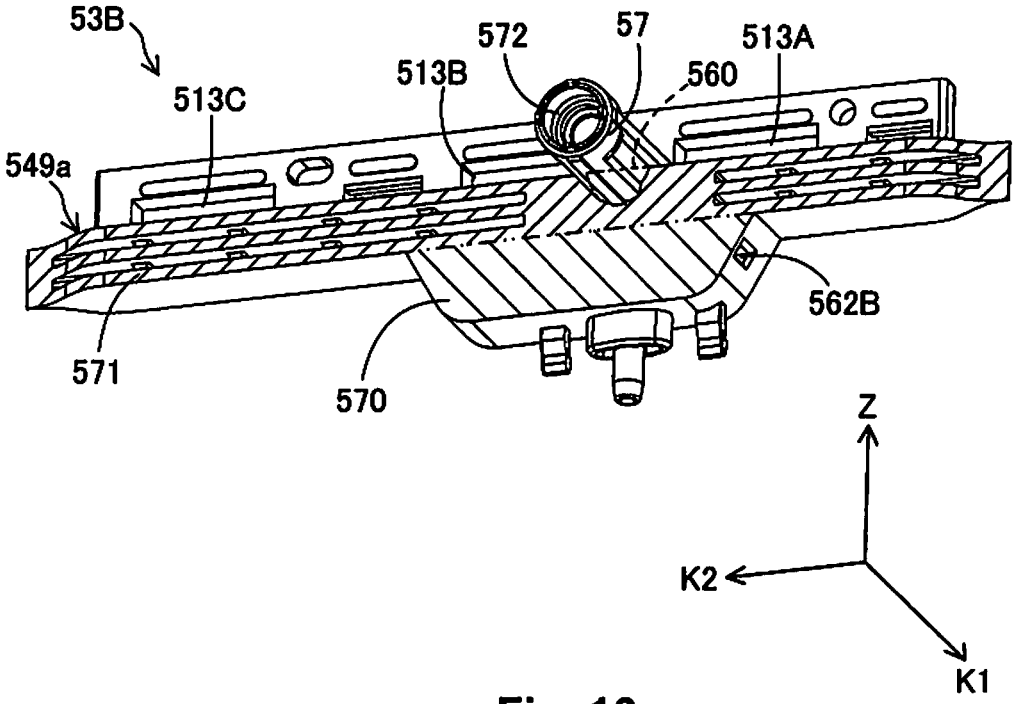
FIG. 16 is a perspective view of a liquid supply part.

FIGS. 15 and 16 are perspective views of the liquid supply part 53B. The bonded parts 549*a*, 549*b* are portions bonded to the liquid storage bag 52 in the liquid supply part 53B. The liquid supply part 53B has a substantially boat-shaped form as seen in the −Z-axis direction. A "boat-shaped form" refers to a shape that becomes gradually thinner at both ends in the longitudinal direction. The liquid supply part 53B has two surfaces opposing in the direction orthogonal to the Z-axis, or, more specifically, in the K1-axis direction. One of these two surfaces has the bonded part 549*a*, and the other has the bonded part 549*b*.

The bonded part 549*b* (FIG. 15) comprises an upper end bonded part 640, a first rib 650, and a second rib 660. What is welded in the step P820 is the upper end bonded part 640 and the first rib 650. The upper end bonded part 640 is illustrated by the hatching by lines going from the upper right to lower left in FIG. 15. The first rib 650 is illustrated by the hatching by lines going from the upper left to lower right in FIG. 15, and forms a substantially pentagonal shape. The one end 501 in the liquid storage bag 52 is sealed when the first and second films 521, 522 are welded together at the bonded part 549*a* and at the bonded part 549*b* less the second rib 660.

As illustrated in FIG. 15, the first rib 650 demarcates a first chamber 558. The second rib 660 demarcates the first chamber 558 and a second chamber 559. A bypass 562 illustrated in FIG. 15 is a flow path that connects the second chamber 559 and inside the liquid storage bag 52. The second chamber 559 has communication with the first chamber when the second rib 660 has not been welded. The bypass 562 accordingly communicates with the first chamber 558 when the second rib 660 has not been welded. The bypass 562 shall be described in greater detail below, with reference to FIGS. 25 to 27.

As illustrated in FIG. 16, the bonded part 549*a* is a portion where the surfaces illustrated by two different types of hatching are joined together. As illustrated in FIG. 16, a scooped-out part 560 is provided to the bonded part 549*a*. The scooped-out part 560 is a portion where the bonded part 549*a* is scooped out in the face direction. The liquid supply tube part 57 is arranged so as to contact the scooped-out part 560. In other words, the lower end (end in the −Z-axis direction) of the liquid supply tube part 57 is positioned lower (more in the −Z-axis direction) than the upper end (end in the +Z-axis direction) of the bonded part 549*a*.

As illustrated in FIG. 16, the bonded part 549*a* comprises an overhanging part 570 and a main bonding surface 571. The main bonding surface 571 is a principal bonding surface at the bonded part 549*a*. The overhanging part 570 is a portion that overhands out in the −Z-axis direction from the main bonding surface 571, and is illustrated by hatching by lines going from the upper left to the lower right. The first chamber 558, the second chamber 559, the bypass 562, and the like are provided, as illustrated in FIG. 15, to the reverse side (the −K1-axis direction) of the welded surface at the overhanging part 570.

Figure 17:
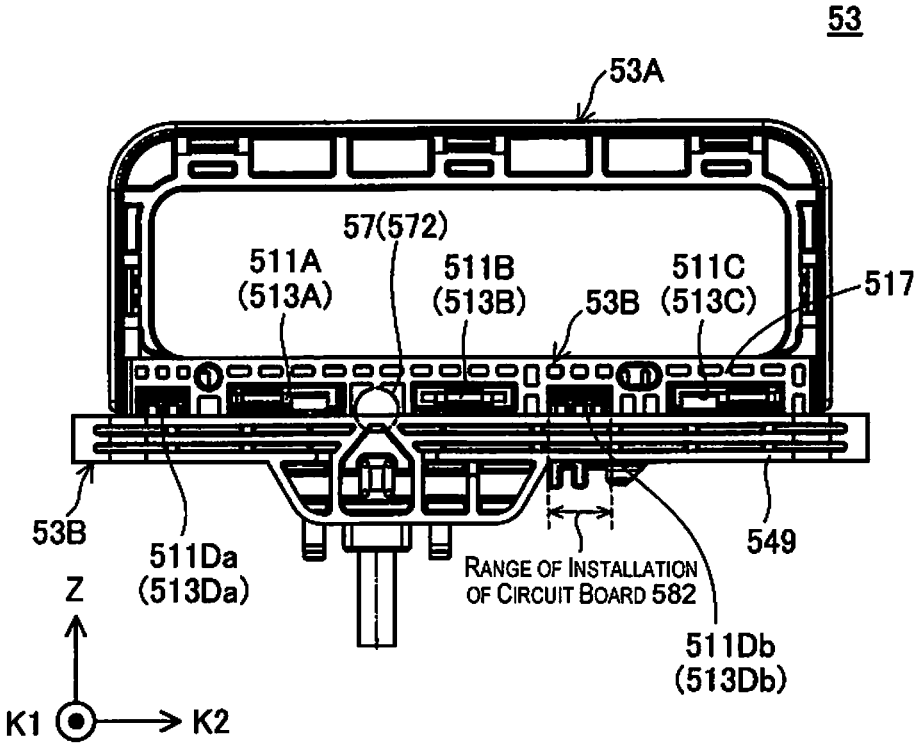
FIG. 17 is a rear view illustrating a state where a joining member and a liquid supply part have been assembled together.

The above-described welding is followed by assembly of the joining member 53A, the pressing member 53C, the valve mechanism 551, and a substrate 582, which comprises a storage apparatus 583 (step P830). This assembling shall be described in greater detail below. FIG. 17 is a rear view illustrating a state where the joining member 53A and the liquid supply part 53B have been assembled together. In other words, FIG. 17 illustrates a state where the pressing member 53C has not been assembled. FIG. 17 omits any depiction of the liquid storage bag 52.

As illustrated in FIG. 17, the liquid supply part 53B is attached to the joining member 53A by when the engagement parts 511A, 511B, 511C are fitted into the engagement parts 513A, 513B, 513C, which are the corresponding through holes. A protruding part 517 to which the engagement parts 513 are provided is exposed to the exterior of the liquid storage bag 52 in a state where the bonded part 549 has been welded to the liquid storage bag 52.

The three engagement parts 511A, 511B, 511C of the joining member 53A support the load from the liquid storage bag 52 by engaging with the liquid supply part 53B to which the liquid storage bag 52 is attached.

As illustrated in FIG. 17, movement of the liquid supply part 53B in the K2-axis direction and the Z-axis direction is limited relative to the joining member 53A by when the engagement part 511B and the engagement part 513B engage with one another. Movement of the liquid supply part 53B in the Z-axis direction relative to the joining member 53A is limited by when the engagement part 511A and the engagement part 513A engage with one another and the engagement part 511C and the engagement part 513C engage with one another. That is to say, by having an outer shape that surrounds the direction (K1-axis direction) that runs along the center axis CT direction (K1-axis direction) for one another, the engagement parts 511 and the engagement parts 513 make it possible to curb any positional deviation between the joining member 53A and the liquid supply part 53B in the face direction (the face direction defined by the Z-axis direction and the K2-axis direction) orthogonal to the center axis CT direction.

As illustrated in FIG. 17, the liquid supply tube part 57 is provided so that at least a part overlaps with the bonded part 549*b* when viewed along the K1-axis direction from the bonded part 549*b* side. In other words, a liquid supply port 572 is provided so that at least a part overlaps with the bonded part 549*b* when viewed along the K1-axis direction from the bonded part 549*b* side.

As illustrated in FIG. 13, the joining member 53A further has convex-shaped locking claws 511Da, 511Db. The locking claws 511Da, 511Db are provided to the second side 53*fb* of the base part 548 out of the joining member 53A. The liquid supply part 53B has through holes 513Da, 513Db at positions corresponding to the convex-shaped locking claws 511Da, 511Db.

Figure 18:
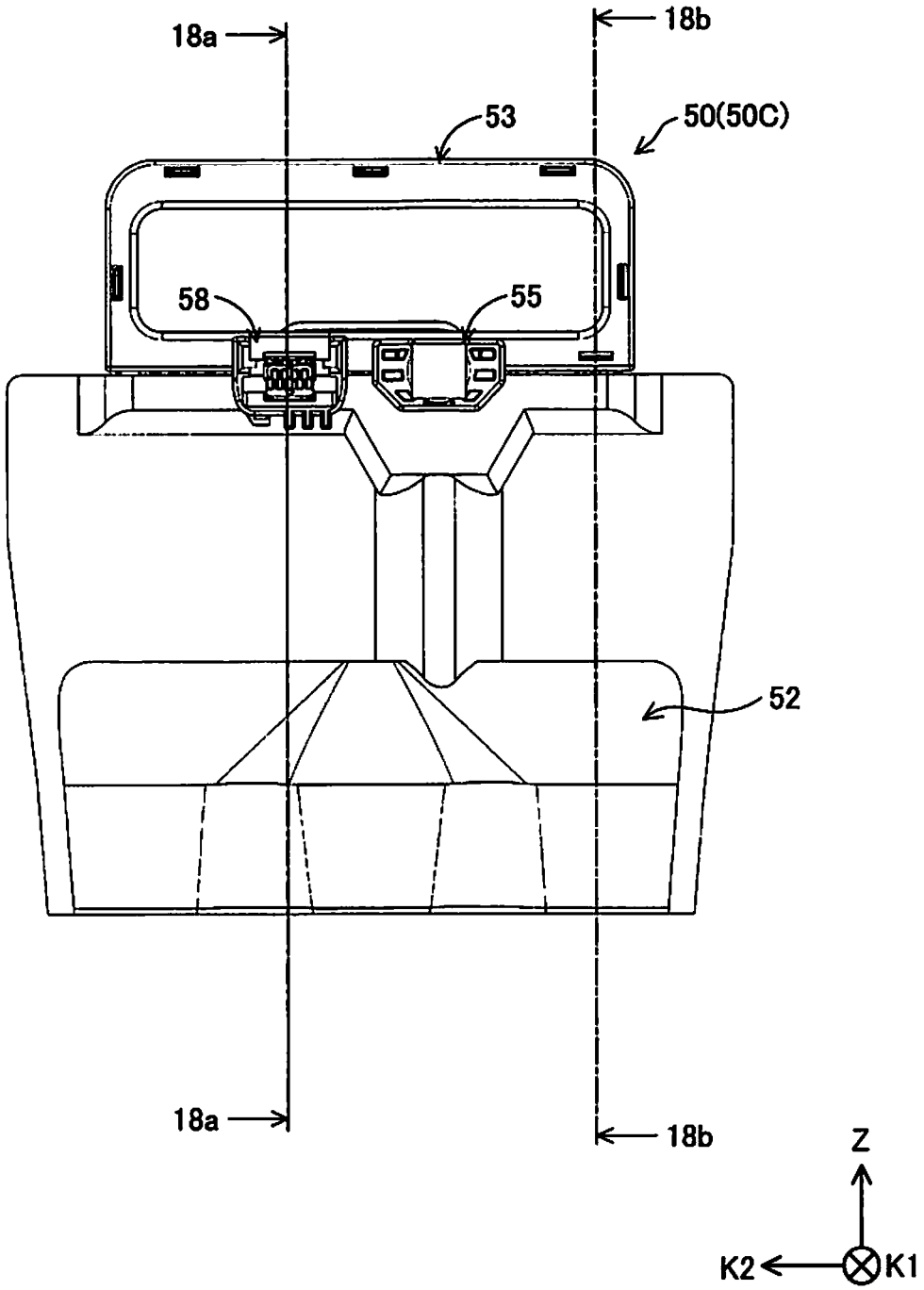
FIG. 18 is a front view illustrating a liquid container.
Figure 19:
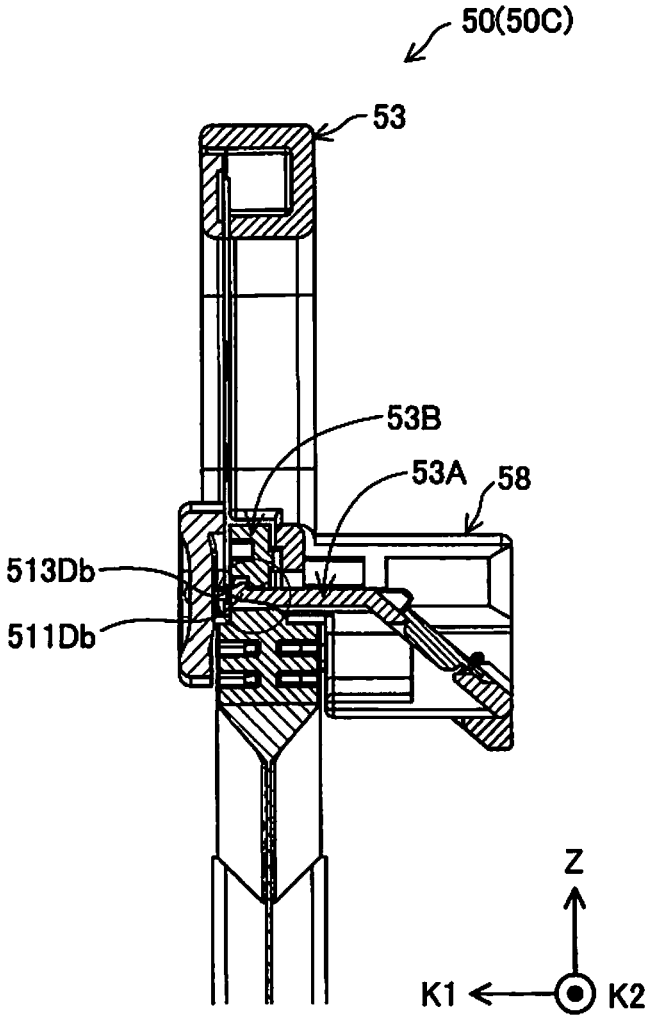
FIG. 19 is a partial cross-sectional view of FIG. 18.
Figure 20:
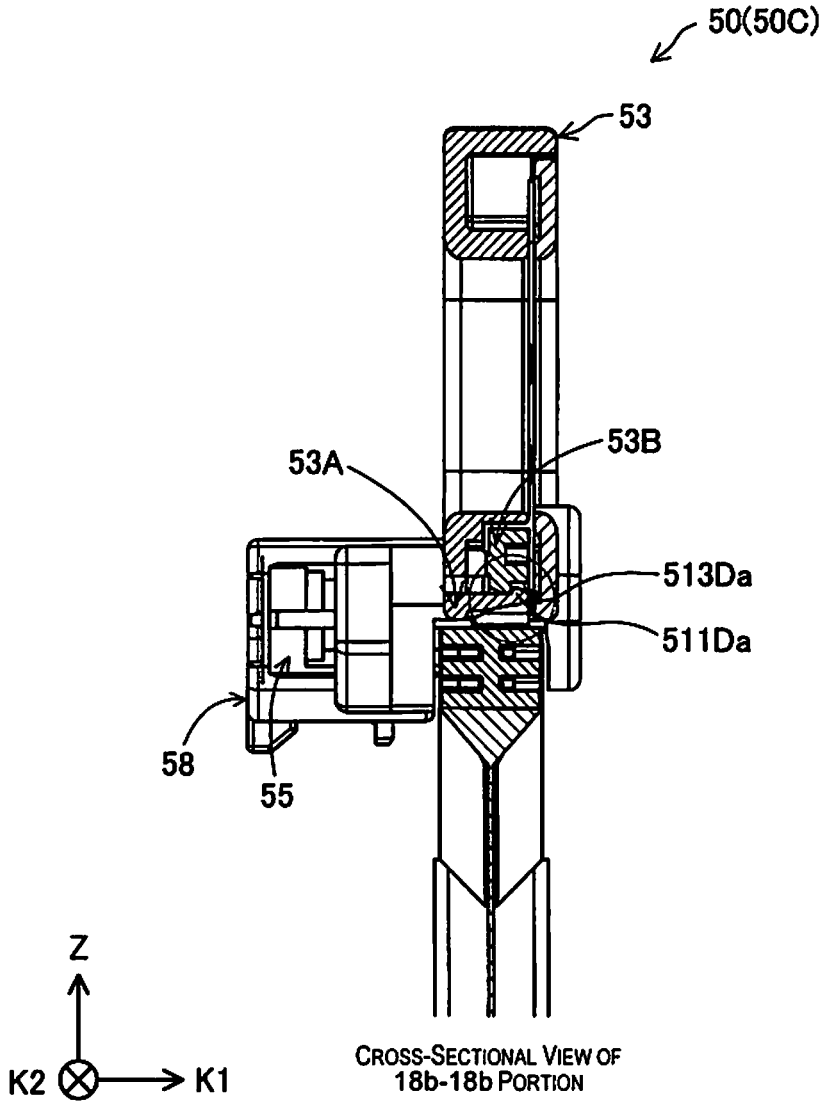
FIG. 20 is a partial cross-sectional view of FIG. 18.

FIG. 18 is a front view illustrating the liquid container 50. FIG. 18 illustrates a state of assembly that also comprises the pressing member 53C. FIG. 19 is a partial cross-sectional view along the 18*a*-18*a* line in FIG. 18. FIG. 20 is a partial cross-sectional view along the 18*b*-18*b* line in FIG. 18.

As illustrated in FIGS. 19 and 20, movement of the liquid supply part 53B in the +K1-axis direction relative to the joining member 53A is limited by when the locking claws 511Da, 511Db are locked by the member where the through holes 513Da, 513Db are formed. Movement of the liquid supply part 53B in the −K1-axis direction relative to the joining member 53A is limited by when a part of the liquid supply part 53B abuts against a part of the joining member 53A.

As described above, positioning between the two members 53A, 53B is performed by when the engagement parts 511 of the joining member 53A engage with the engagement parts 513 of the liquid supply part 53B. The circuit board retention part 59 is bonded to the joining member 53A, and the liquid supply tube part 57, which is connected to the printer 10, is bonded to the liquid supply part 53B. Accordingly, the position between the liquid supply tube part 57 and the circuit board retention part 59 is determined by the engagement between the engagement parts 511 of the joining member 53A and the engagement parts 513 of the second member.

As illustrated in FIG. 17, in the K2-axis direction of the bonded part 549, the engagement part 511A and the engagement part 511B at positions by which the liquid supply tube part 57 is sandwiched. In the K2-axis direction, the engagement part 511A and the engagement part 511C are arranged at positions by which the liquid supply tube part 57 is sandwiched. In the K2-axis direction, the engagement part 511B and the engagement part 511C are arranged at positions by which a circuit board 582 is sandwiched. In the K2-axis direction, the engagement part 511A and the engagement part 511C are arranged at positions by which the circuit board 582 is sandwiched.

As illustrated in FIG. 13, the pressing member 53C comprises the pressing part 545. The pressing member 53C forms a frame that corresponds with the shape of the joining member 53A. The pressing member 53C is a planar member that runs along a plane perpendicular to the K1-axis direction (the center axis CT direction). Of the pressing member 53C, the first side 53*fa* portion is provided with eight engagement parts 515. The joining member 53A and the pressing member 53C are joined by when the engagement parts 515 engage with the member engagement parts 588 illustrated in FIG. 13.

The pressing member 53C is colored with the color of the ink that is stored in the liquid storage bag 52. For example, in the case of the liquid container 50Y, which contains yellow ink, the pressing member 53C is colored yellow.

After the joining member 53A and the pressing member 53C have been mounted, the posture of the liquid container 50 is set (step P840). Next, a liquid injection member 13 is inserted into the liquid supply tube part 57 (step P850). The steps P840 and P850 are implemented for the purpose of injecting the ink in (step P850).

Figure 21:
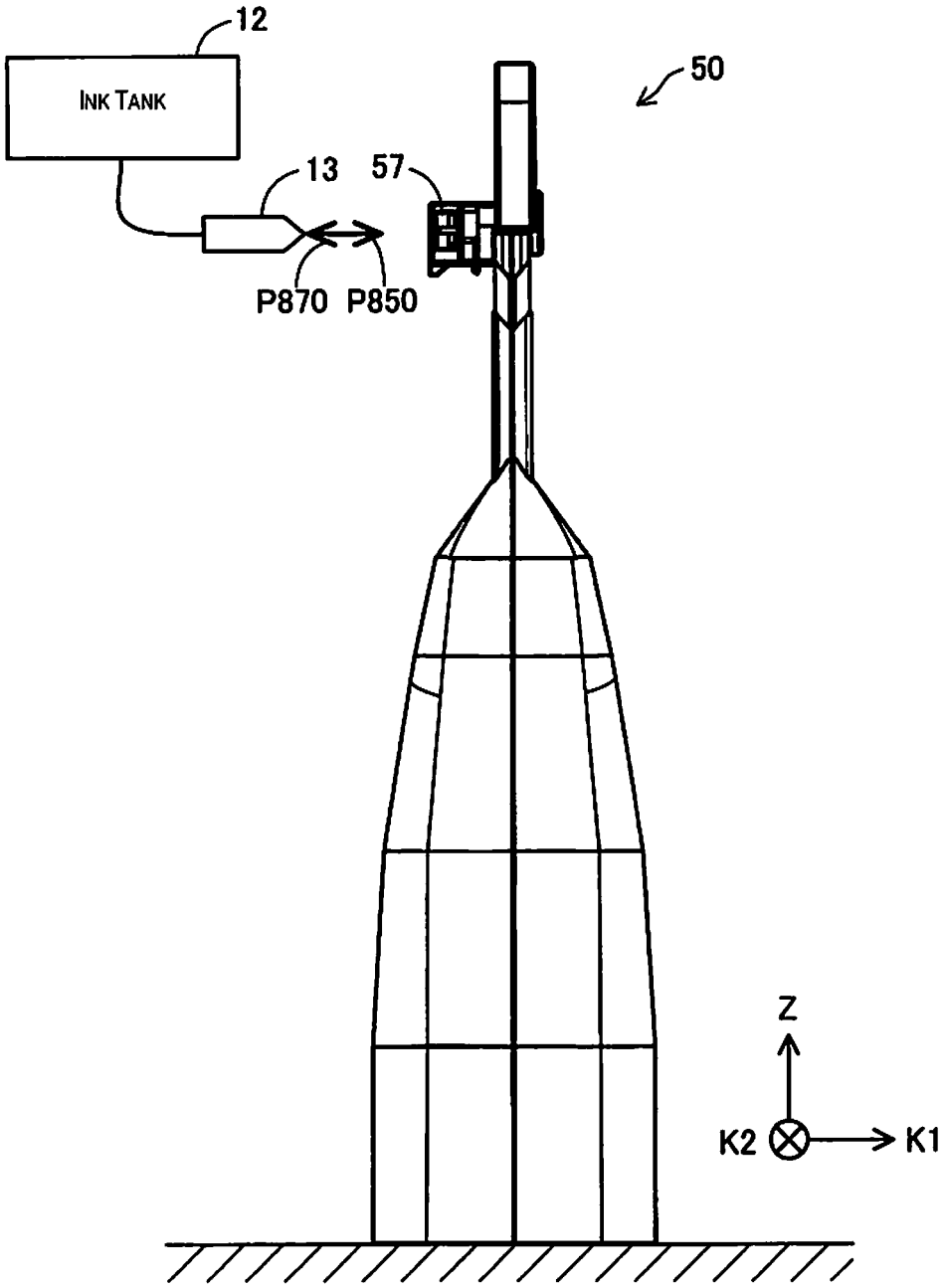
FIG. 21 is a side view illustrating a liquid container, with the posture thereof having been set.

FIG. 21 is a side view illustrating the liquid container 50, with the posture thereof having been set. In the embodiment 1, the posture for when ink is injected is set to the same posture as the state of attachment to the detachable unit 30. In other words, [the liquid container 50] is set to a posture at which the liquid storage bag 52 is positioned more to the −Z-axis direction side than the operation member 53, and the liquid supply tube part 57 faces an orientation intersecting with the Z-axis direction—more specifically, faces the horizontal direction.

The liquid container 50 has a gusset part, as described earlier, and can therefore be set to this posture merely by being placed on a horizontal surface, as illustrated in FIG. 21, provided that a certain amount of ink is stored therein. At the time of the step P840, no ink is stored, and therefore the step P840 is implemented by using a jig 14 (see FIG. 22) to fix the position of the operation member 53.

Then, the ink is injected into to the liquid container 50 (step P860). The ink being injected in is held in an ink tank 12. This injection is executed via the inserted liquid injection member 13.

Figure 22:
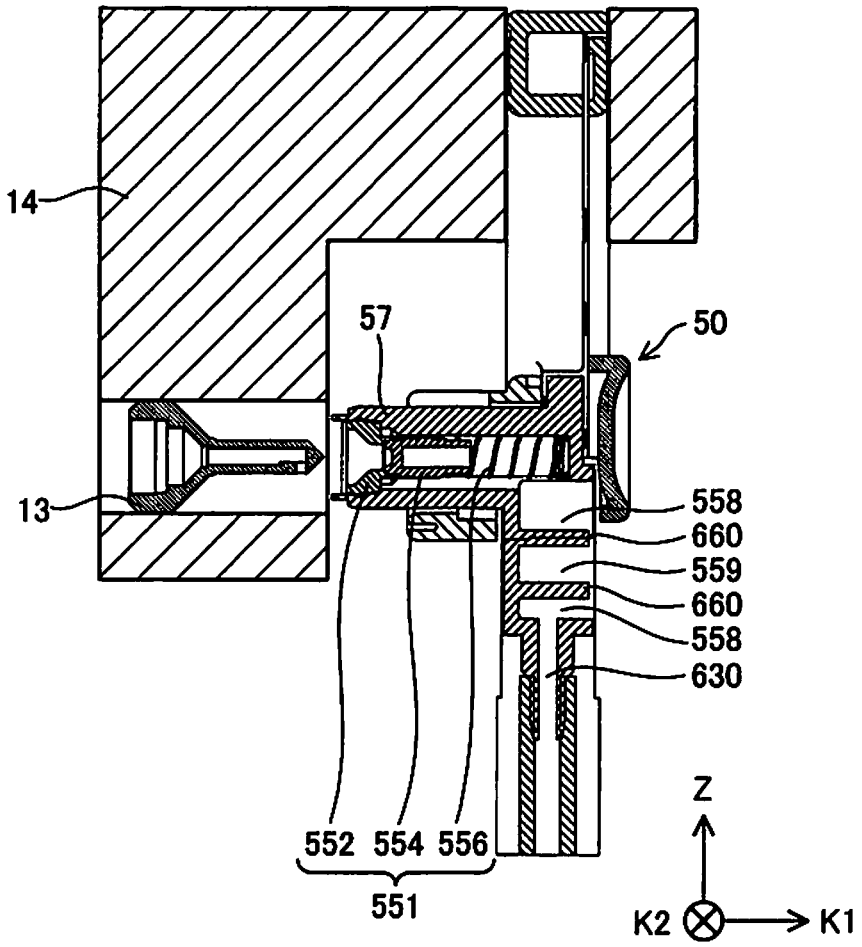
FIG. 22 is a cross-sectional view (before insertion) of a flow path during injection.

FIG. 22 is a cross-sectional view of the liquid injection member 13, the jig 14, and the liquid container 50. The cross-section in FIG. 22 is a plane (the 47-47 cross-section in FIG. 47) that comprises the center axis line of the liquid supply tube part 57 and also is orthogonal to the horizontal plane.

FIG. 22 is a cross-sectional view illustrating the state prior to when the liquid injection member 13 is inserted into the liquid supply tube part 57. The jig 14 positions the liquid supply tube part 57 by sandwiching the joining member 53A and the pressing member 53C. The jig 14 positions the liquid injection member 13 with respect to the K2-Z plane, by a through hole provided to the interior.

As illustrated in FIG. 22, the valve mechanism 551 is arranged in the interior of the liquid supply tube part 57. The valve mechanism 551 is for opening and closing the flow path formed in the liquid supply tube part 57 interior. The valve mechanism 551 is provided with a valve seat 552, a valve body 554, and a spring 556.

The valve seat 552 is a substantially annular member. The valve seat 552 is constituted of, for example, an elastic body of rubber, elastomer, or the like. The valve seat 552 is pressed-fitted into the interior of the liquid supply tube part 57. The valve body 554 is a substantially cylindrical member. The valve body 554 blocks off a hole (valve hole) formed in the valve seat 552 in a state (the state illustrated in FIG. 22) prior to when the liquid container 50 is mounted onto the detachable unit 30. The spring 556 is a compression coil spring. The spring 556 applies a force onto the valve body 554 with an orientation going toward the valve seat 552.

Figure 23:
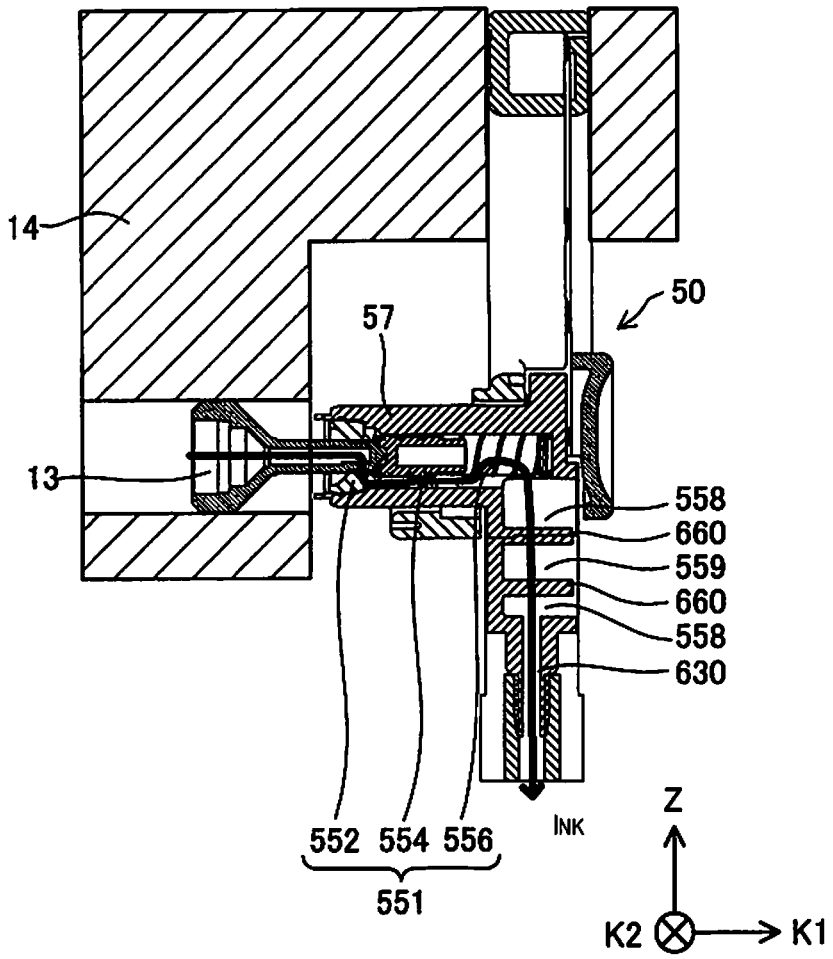
FIG. 23 is a cross-sectional view (after insertion) of a flow path during injection.

FIG. 23 is a cross-sectional view illustrating the state where the liquid injection member 13 has been inserted into the liquid supply tube part 57. In this state, the tip of the liquid injection member 13 causes the valve body 554 to move in the +K1 direction, thereby releasing the seal between the valve seat 552 and the valve body 554 and through an opening part of the liquid injection member 13 tip and the liquid supply tube part 57. When the flow path is created in this manner, the ink can be injected into the liquid storage bag 52.

In addition to the flow path connected in FIG. 23, the injection of the ink is implemented via the bypass 562. Because the injection of the ink is thus implemented via a plurality of flow paths, the flow path resistance is reduced and unencumbered injection is realized.

In the step P860, as well, the posture that was set in the step P840 is being maintained, and therefore the liquid supply tube part 57 is located farther upward in the direction of the force of gravity than the liquid storage bag 52. Ink accordingly flows unencumbered into the liquid storage bag 52.

Figure 24:
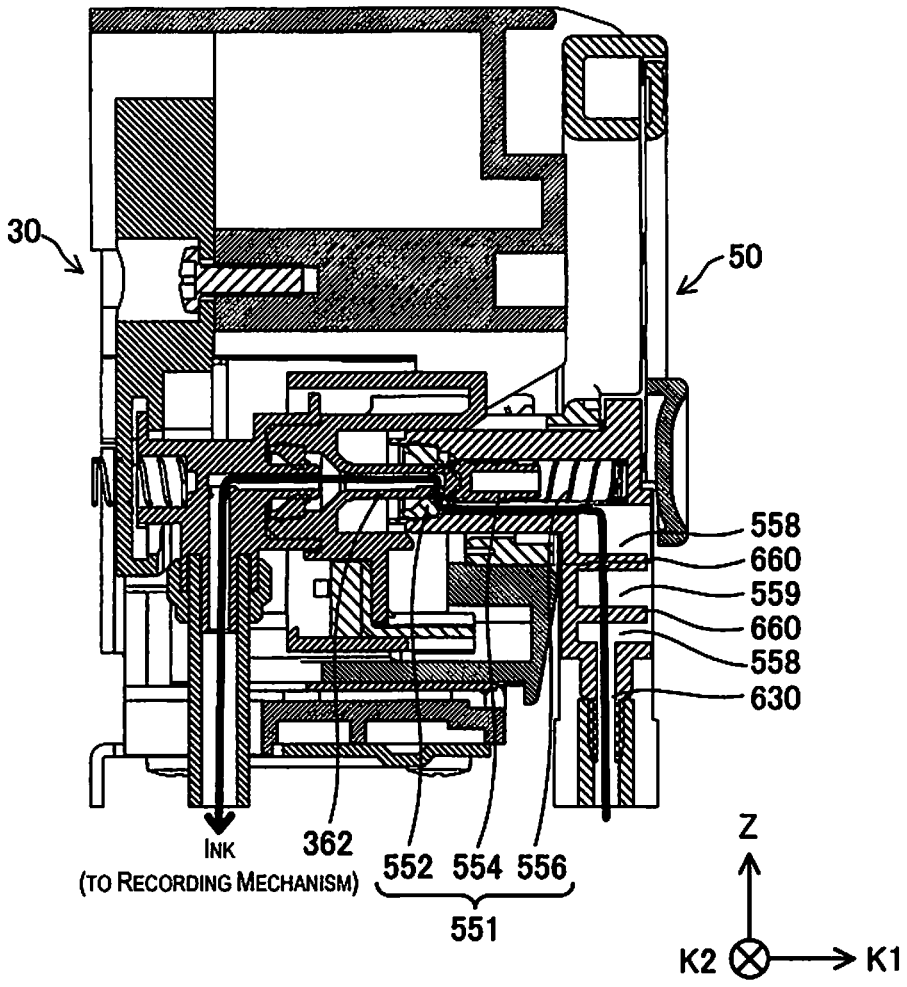
FIG. 24 is a cross-sectional view of a detachable unit and a liquid container.

FIG. 24 is a cross-sectional view illustrating the state where the liquid container 50 has been mounted onto the detachable unit 30. The mounting shall be described in greater detail below, but ensuring the flow path is a point of commonality with when the ink is being injected and therefore a brief description shall be provided here. When the liquid container 50 is mounted onto the detachable unit 30, it becomes possible for the ink to be supplied to the printer 10. The flow path is ensured by when a liquid introduction part 362 is inserted into the liquid supply tube part 57. The liquid introduction part 362 has a similar shape to that of the liquid injection member 13, and the internal flow path passes through the recording mechanism 11.

After the injection of the ink, the liquid injection member 13 is pulled out from the liquid supply tube part 57 (step P870). The step P870 is implemented with no change to the posture that was set in the step P840. In other words, in the step P870, the liquid supply tube part 57 projects out in the horizontal direction and the liquid injection member 13 is pulled out in the horizontal direction. Accordingly, though ink may drip out from the liquid injection member 13 when the liquid injection member 13 is taken out from the liquid supply tube part 57, there is little possibility that this ink could stick to the liquid container 50.

After the liquid injection member has been taken out, air bubbles are discharged from inside the liquid storage bag 52 (step P880). This discharging is realized by discharging from the liquid supply tube part 57 a predetermined amount of ink that is stored in the liquid storage bag 52, while also maintaining the posture that was set in the step P840. A syringe (not shown) is used for this discharging. The syringe has a similar shape to that of the liquid injection member 13, and performs suction in a state of having been inserted into the liquid supply tube part 57. The air bubbles are discharged via the second chamber 559 and the bypass 562. The bypass 562 shall be described next.

Figure 25:
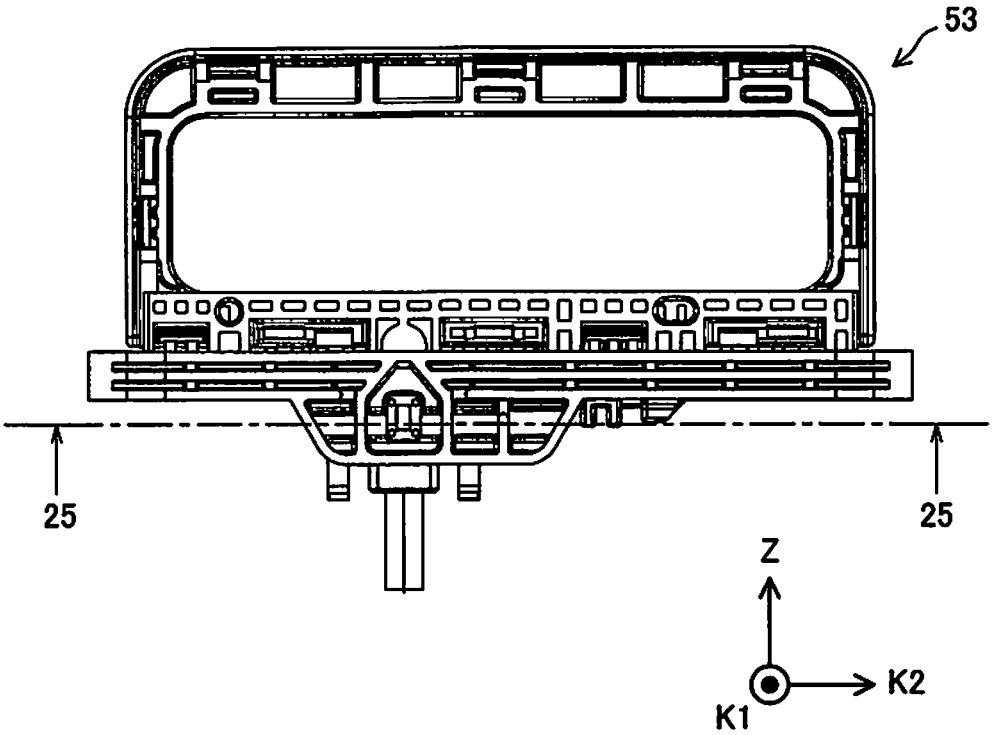
FIG. 25 is a rear view illustrating a state where a joining member and a liquid supply part have been assembled.
Figure 26:
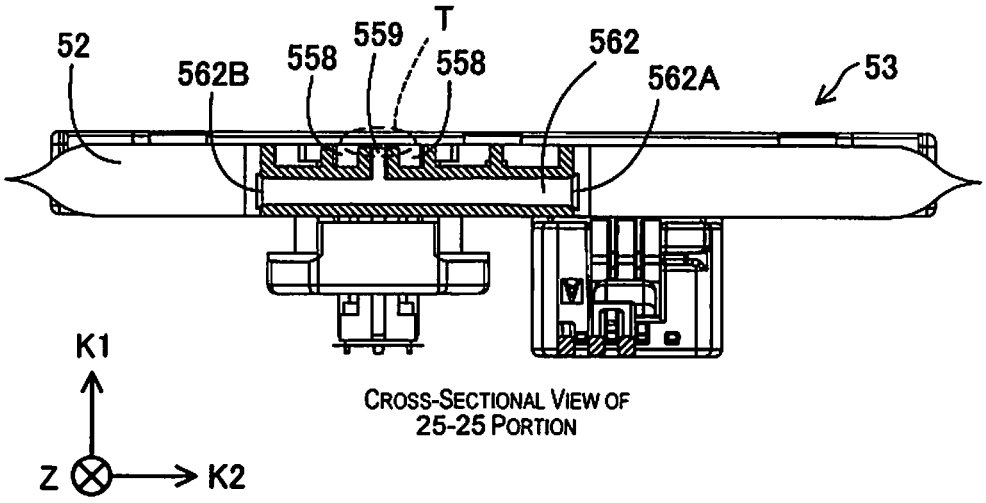
FIG. 26 is a cross-sectional view in FIG. 25.
Figure 27:
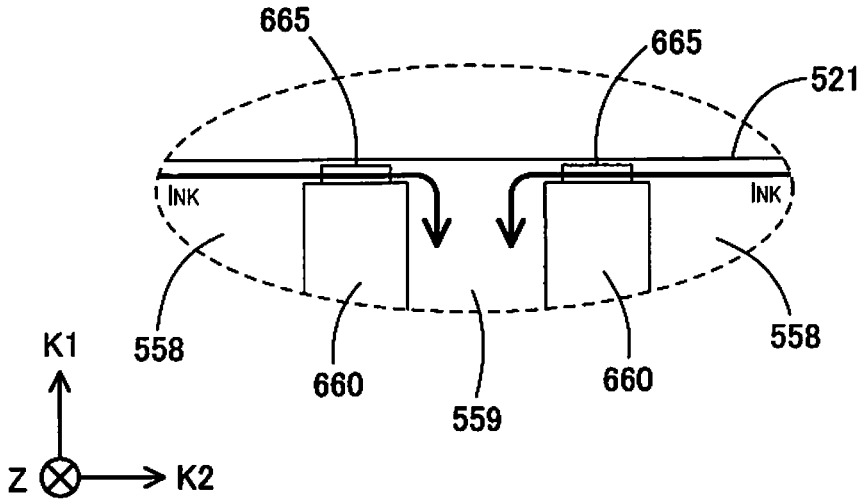
FIG. 27 is an enlarged view of FIG. 26.

FIG. 25 is a rear view illustrating the state where the joining member 53A and the liquid supply part 53B have been assembled. FIG. 26 is a cross-sectional view taken along the 25-25 line in FIG. 25. FIG. 27 is an enlarged view of the "T" section in FIG. 26. The depiction of the liquid storage bag 52 illustrated in FIG. 26 is omitted in FIG. 25. FIG. 25 omits the pressing member 53C.

As illustrated in FIG. 26, the bypass 562 has opening parts 562A, 562B. The opening parts 562A, 562B open at near the one end 501 in the liquid storage bag 52. In other words, the opening parts 562A, 562 is located near the upper end inside the liquid storage bag 52.

As illustrated in FIG. 26, the bypass 562 has communication with the second chamber 559. As illustrated in FIG. 27, the ink is able to flow between the first film 521 and the second rib 660 in a state where the first film 521 and the second rib 660 have not been welded together. In other words, the bypass 562 communicates with the first chamber 558 via the second chamber 559 at the time of the step P880.

As illustrated in FIG. 27, projections 665 are provided to the end surface of the second rib 660. The projections 665 are for ensuring the flow path surface area between the first film 521 and the second rib 660.

The bypass 562 is utilized for the discharging of gas in the step P880. In other words, the air bubbles that accumulate near the upper end in the liquid storage bag 52 flow into the opening parts 562A, 562 and then are discharged, passing through the bypass 562, the second chamber 559, the first chamber 558, and the liquid supply tube part 57 in the stated order.

The discharging of the air bubbles is followed by welding the end surface of the second rib 660 and the liquid storage bag 52 (step P890). When the second rib is welded, the projections 665 melt and disappear.

Figure 28:
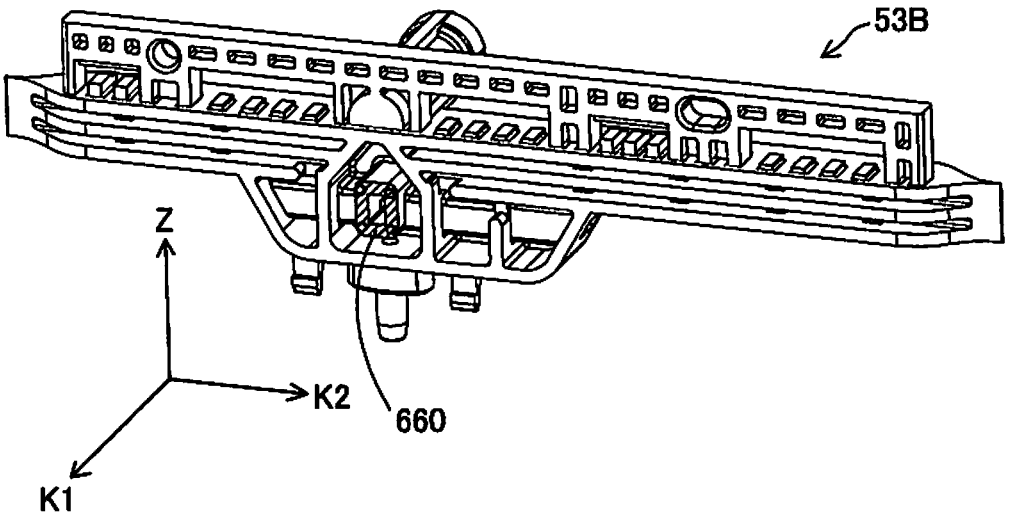
FIG. 28 is a perspective view illustrating a liquid supply part.

FIG. 28 is a perspective view illustrating the liquid supply part 53B. The hatching illustrated in FIG. 28 illustrates a cross-section of the second rib 660. When the end surface of the second rib 660 and the liquid storage bag 52 are welded together, the ink is no longer able to flow from the second chamber 559 to the first chamber 558. As a result, the supplying of ink from the liquid storage bag 52 to the liquid supply tube part 57 is implemented by the flow path member 70.

Finally, the liquid supply port 572 is sealed off by the sealing film 99 (see FIG. 12) (step P895). The sealing film 99 prevents the ink from leaking out to the exterior from the liquid supply port 572 prior to when the liquid container 50 is mounted onto the detachable unit 30. In addition, the sealing film 99 prevents the urging force of the spring 556 from causing the valve seat 552 and the valve body 554 to move in the −K1-axis direction and consequently be taken out from the liquid supply tube part 57. The sealing film 99 is broken by the liquid introduction part 362 when the liquid container 50 is being mounted onto the detachable unit 30.

Configuration of Operation Member 53

Figure 31:
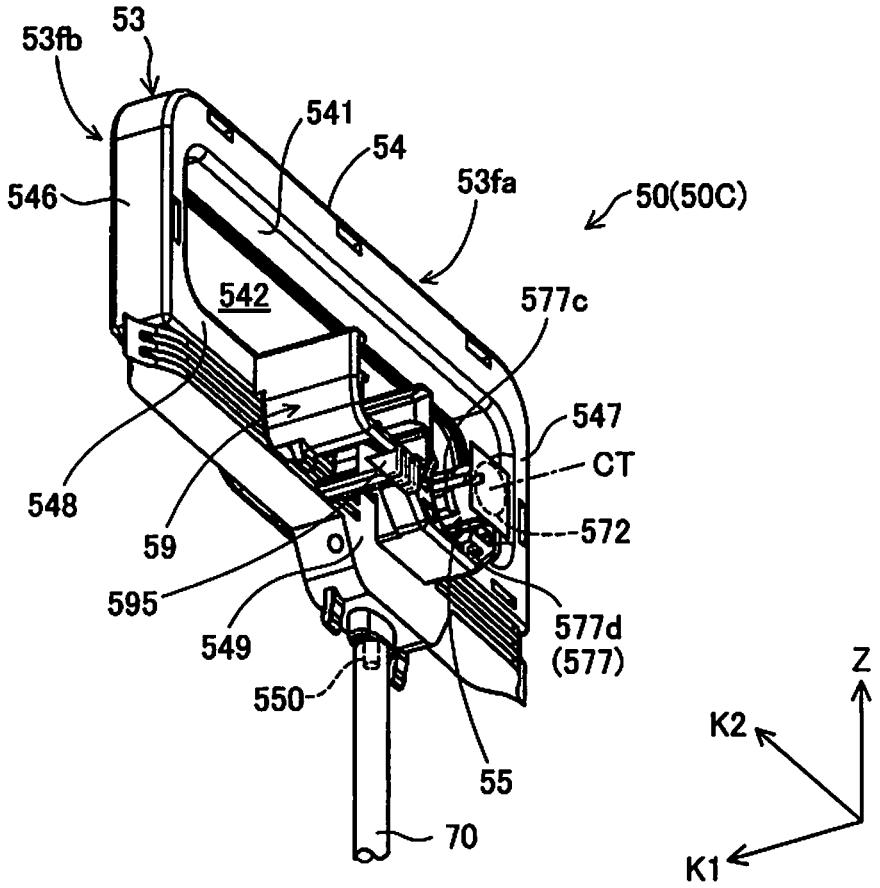
FIG. 31 is a perspective view illustrating one portion of a liquid container.
Figure 32:
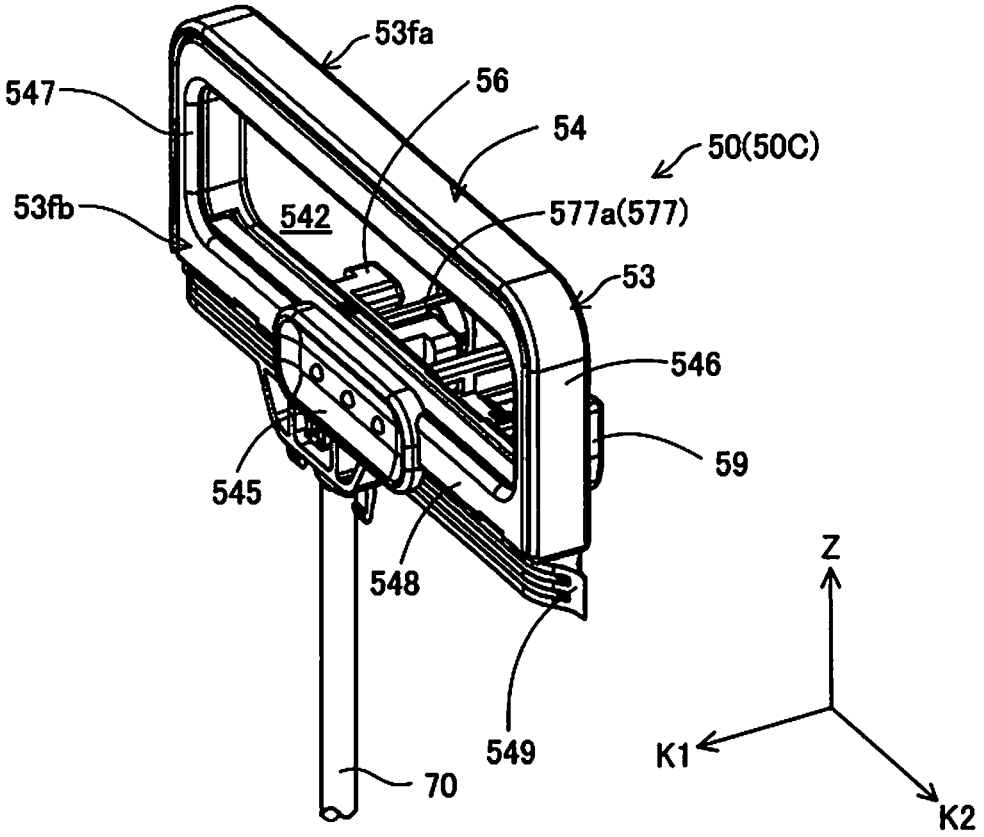
FIG. 32 is a perspective view illustrating one portion of a liquid container.
Figure 33:
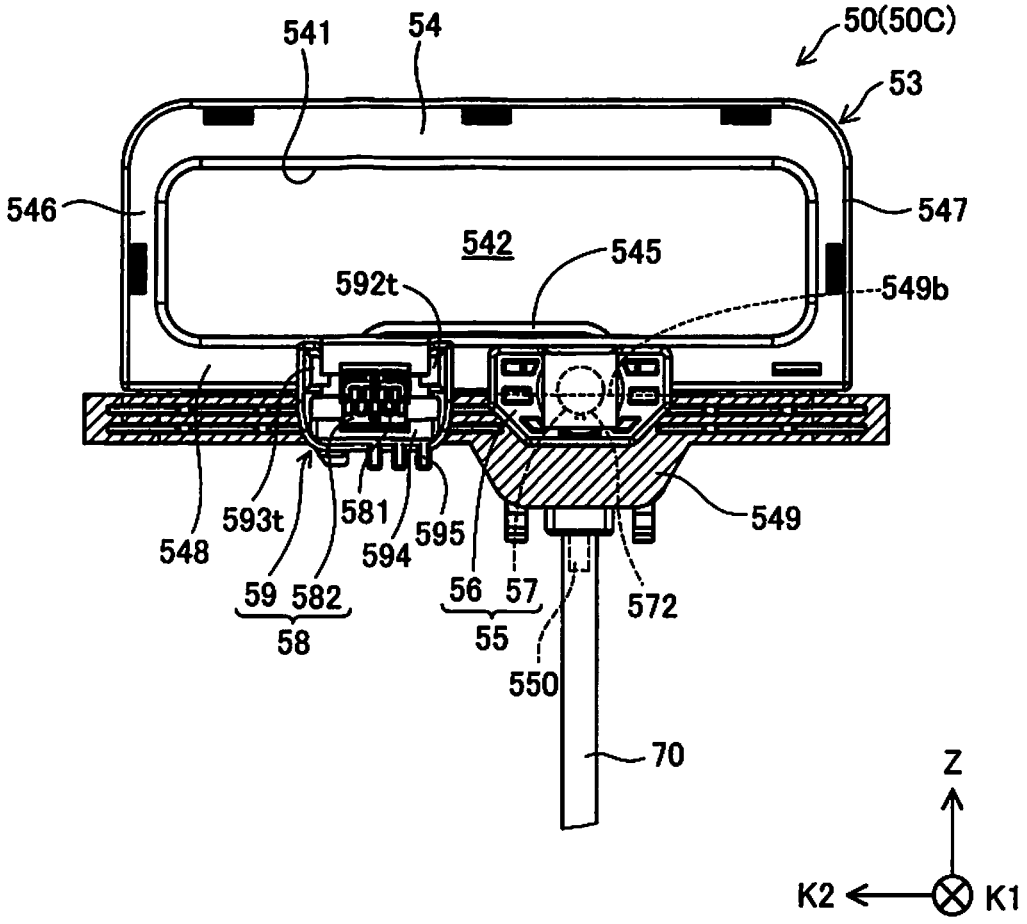
FIG. 33 is a front view of one portion of a liquid container.
Figure 34:
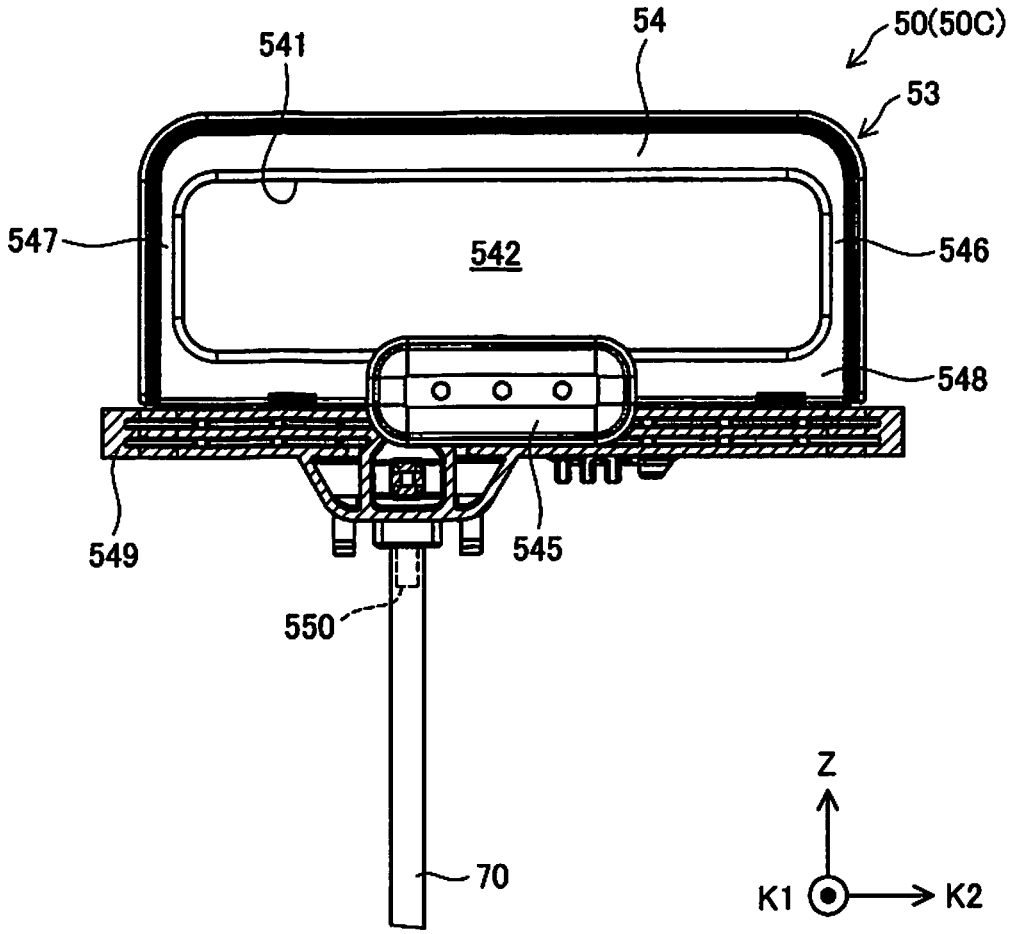
FIG. 34 is a rear view of one portion of a liquid container.
Figure 35:
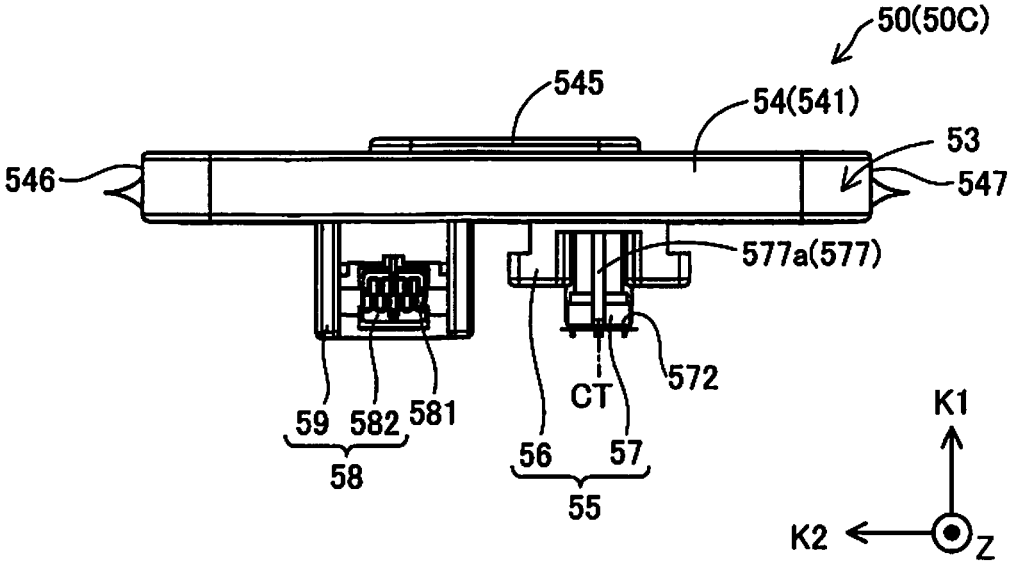
FIG. 35 is a top view of one portion of a liquid container.
Figure 36:
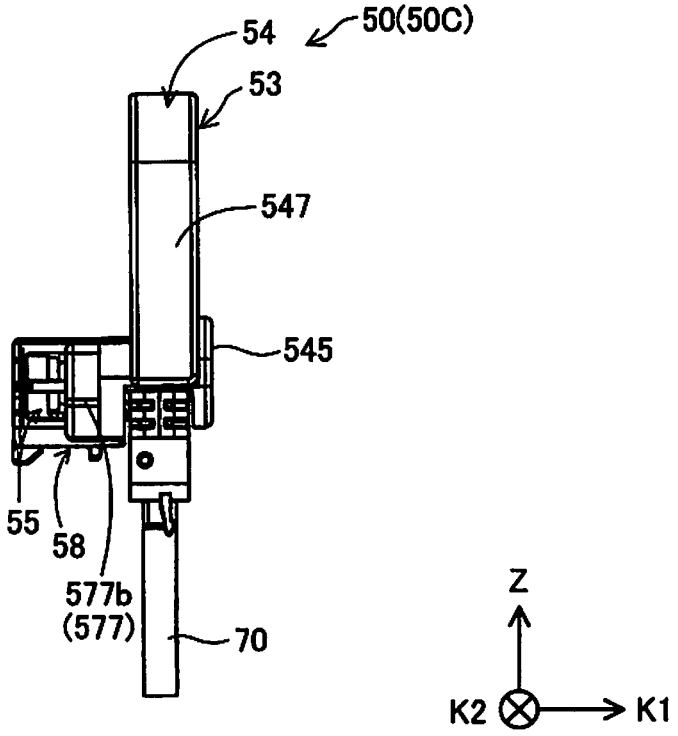
FIG. 36 is a right side view of one portion of a liquid container.

FIGS. 29, 30, 31, and 32 are perspective views illustrating one portion of the liquid container 50. This one portion refers to a portion that excludes the liquid storage bag 52 and a part of the flow path member 70. FIG. 33 is a front view of the one portion of the liquid container 50. FIG. 34 is a rear view of the one portion of the liquid container 50. FIG. 35 is a top view of the one portion of the liquid container 50. FIG. 36 is a right-side view of the one portion of the liquid container 50.

Figure 29:
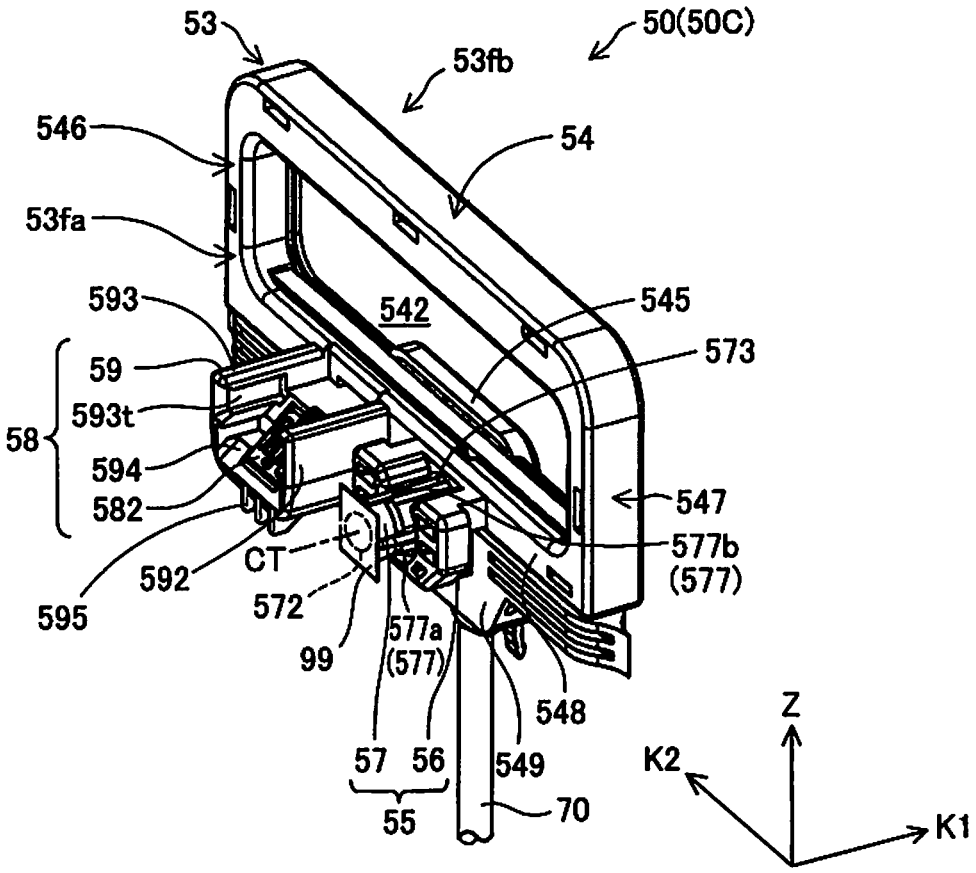
FIG. 29 is a perspective view illustrating one portion of a liquid container.
Figure 30:
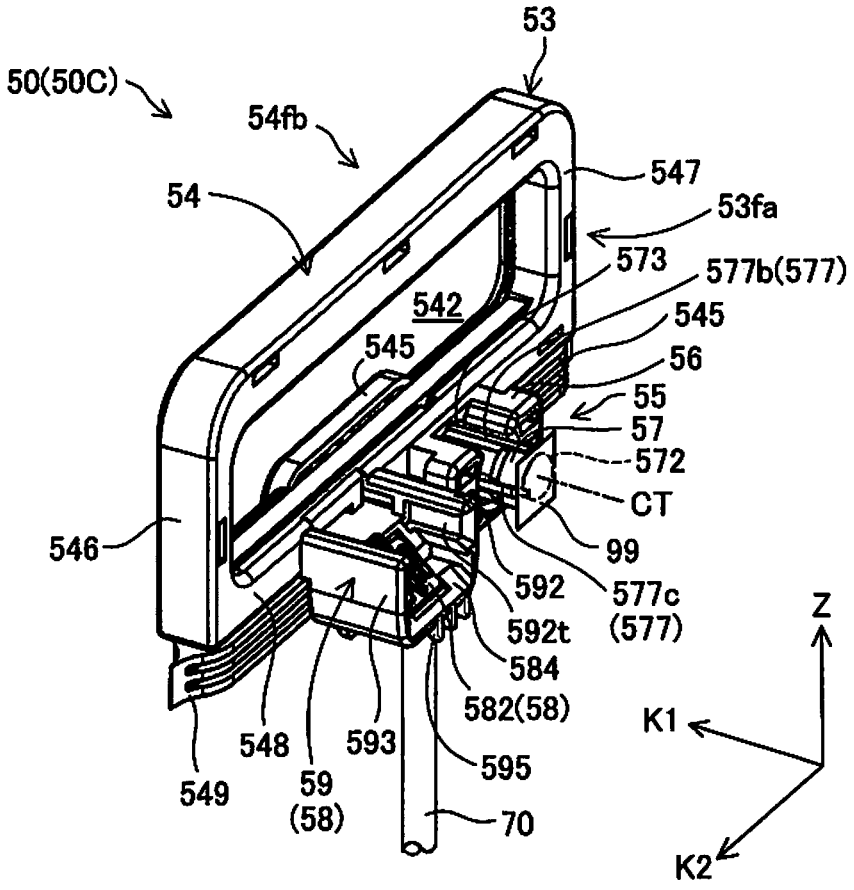
FIG. 30 is a perspective view illustrating one portion of a liquid container.

As illustrated in FIGS. 29 and 30, the operation member 53 is provided with the grip part 54, a first connection part 546, a second connection part 547, the base part 548, and the bonded part 549.

A frame is formed by the grip part 54, the first connection part 546, the second connection part 547, and the base part 548. This frame forms a receiving space part 542. The receiving space part 542 is a space into which the hand of the user is inserted.

The grip part 54 is a portion that is gripped by the user. The grip part 54 extends along the K2-axis direction. As illustrated in FIG. 31, the grip part 54 has a grip surface 541 that contacts the receiving space part 542. The grip surface 541 is a portion that is held by the user. The grip surface 541 is substantially horizontal in the mounted state.

As illustrated in FIG. 29, the first connection part 546 is a member that extends to the base part 548 side (the −Z-axis direction; the liquid storage bag 52 side) from the one end part of the grip part 54 in the K2-axis direction. The second connection part 547 is a member that extends to the base part 548 side (the −Z-axis direction; the liquid storage bag 52 side) from the other end part of the grip part 54 in the K2-axis direction.

The base part 548 is a portion that faces the grip part 54 with the receiving space part 542 interposed therebetween. The base part 548 extends along the K2-axis direction. Attached to the base part 548 are the positioning part 56, the circuit board retention part 59, and the pressing part 545 (FIG. 32). That is to say, the liquid supply unit 55 and the circuit board retention part 59 are joined to one another via the base part 548. This joining signifies that the joined members are connected to one another so as to move in a mutually interlocked fashion. This makes it possible to move the operation member 53 and hence the liquid container 50 in an integral fashion.

The bonded part 549 is located on the opposite side to the side where the grip part 54 is located, with the base part 548 sandwiched therebetween. The bonded part 549 is adjacent to the base part 548. The bonded part 549 extends along the K2-axis direction. The bonded part 549 is a portion where the one end 501 of the liquid storage bag 52 (FIG. 7) is bonded by welding or the like, as stated previously. The single hatching added to FIGS. 33 and 34 illustrates the surface of bonding with the liquid storage bag 52.

As illustrated in FIGS. 29 and 30, the liquid supply unit 55 has the liquid supply tube part 57 and the positioning part 56. The liquid supply unit 55 is provided so as to protrude outwardly (in the −K1-axis direction) from the operation member 53.

As illustrated in FIG. 33, the grip surface 541 is arranged more to the +Z-axis direction side than the liquid supply tube part 57. As illustrated in FIG. 35, the liquid supply port 572 is provided so as to be offset in the −K1-axis direction relative to the grip part 54. In other words, the liquid supply port 572 does not overlap with the grip surface 541 in a case where the liquid container 50 is viewed in the direction orthogonal to the grip surface 541 and at an orientation (the −Z-axis direction) going toward the liquid supply tube part 57 from the grip surface 541. That is to say, the grip surface 541 and the liquid supply port 572 do not overlap with one another in a case where the liquid container 50 is projected onto a plane perpendicular to the grip surface 541. As illustrated in FIG. 33, the liquid supply tube part 57 is provided so as to partially overlap with the bonded part 549*b* when viewed along the K1-axis direction from the liquid supply port 572 side. In other words, the liquid supply port 572 is provided so that at least a part overlaps with the bonded part 549*b* when viewed along the K1-axis direction from the liquid supply port 572 side.

The positioning part 56 positions the liquid container 50, including the liquid supply port 572, by a certain extent relative to the printer 10 when the liquid container 50 is being connected to the printer 10. The positioning part 56 is provided integrally to the joining member 53A. In the embodiment 1, the positioning part 56 is provided integrally with the joining member 53A by being formed by integral molding with the joining member 53A.

As illustrated in FIGS. 29 and 30, the positioning part 56 is arranged around the liquid supply tube part 57, centered on the center axis CT. The center axis CT is an imaginary central axis line of the liquid supply tube part 57. The central axis CT is parallel to the K1-axis direction. The positioning part 56 is not, however, arranged at the grip part 54 side of the periphery of the liquid supply tube part 57. The positioning part 56 is arranged on the inside of a supply part supporting part 42 (see FIGS. 37 to 43) provided to the detachable unit 30 when the liquid container 50 is connected to the detachable unit 30.

As illustrated in FIGS. 29 and 30, the substrate unit 58 is provided with the circuit board 582 and the circuit board retention part 59. The substrate unit 58 is provided so as to protrude outwardly (in the −K1-axis direction) from the operation member 53. The direction of protrusion of the substrate unit 58 is the same as the direction of protrusion of the liquid supply tube part 57 (the −K1-axis direction). The direction of protrusion of the substrate unit 58 and the direction of protrusion of the liquid supply tube part 57 need not be the same, and need only be substantially parallel. The substrate unit 58 and the liquid supply tube part 57 protrude out from the operation member 53 at the same orientation (the −K1-axis direction) relative to the operation member 53.

As illustrated in FIG. 35, the substrate unit 58 is provided alongside the liquid supply unit 55 in a direction parallel to the grip surface 541. More specifically, the substrate unit 58 and the liquid supply unit 55 are provided arranged side by side in a direction parallel to the grip surface 541 and a direction (the K2-axis direction) orthogonal to the central axis CT.

As illustrated in FIG. 29, the circuit board retention part 59 positions the circuit board 582 relative to the detachable unit 30 when the liquid container 50 is connected to the detachable unit 30. The circuit board retention part 59 is provided integrally to the operation member 53. In the embodiment 1, the circuit board retention part 59 is provided integrally with the joining member 53A by being formed by integral molding as a part of the joining member 53A.

The circuit board retention part 59 has a concave shape. This concave shape signifies that, as illustrated in FIG. 29, substantially the outline thereof appears like the character 凹 (indented cuboid) in front view. A bottom part 594 corresponding to the recess in the character 凹 (indented cuboid) is inclined with respect to the grip surface 541. The circuit board 582 is retained at an incline to the circuit board retention part 59 by when the circuit board 582 is attached to the bottom part 594.

The circuit board retention part 59 has a first side wall part 592 and a second side wall part 593 which each extend to the +Z-axis direction side from the two sides in the K2-axis direction of the bottom part 594. As illustrated in FIG. 30, the first side wall part 592 has a groove part 592*t*. As illustrated in FIG. 29, the second side wall part 593 has a groove part 593*t*. The groove parts 592*t*, 593*t* are utilized to position the circuit board retention part 59.

As illustrated in FIG. 33, the circuit board 582 has a plurality of terminals 581 at the surface. In the embodiment 1, there are nine of the terminals 581 arranged so as to correspond to a number (nine) of apparatus-side terminals 381. In the embodiment 1, the outer shape of the terminals 581 is substantially rectangular. The storage apparatus 583 (FIG. 13) is also arranged on the reverse side of the circuit board 582. The storage apparatus 583 stores information relating to the liquid container 50 (for example, ink color and date/month/year of manufacture). The storage apparatus 583 and the plurality of terminals 581 are electrically connected together. In the mounted state, the plurality of terminals 581 are each respectively connected to the apparatus-side terminals (see FIGS. 37 to 42), which are provided to the printer 10.

As illustrated in FIG. 35, the grip surface 541 is arranged to the side of the direction (+Z-axis direction) perpendicular to the central axis CT direction of the liquid supply tube part 57. The substrate unit 58 is provided so as to be offset in the central axis CT direction with respect to the operation member 53, which comprises the grip surface 541. In other words, the substrate unit 58 is arranged at a position not overlapping with the grip surface 541 (the operation member 53) when the liquid container 50 is viewed in the direction orthogonal to the grip surface 451 and at an orientation (the −Z-axis direction) going from the grip surface 541 toward the liquid supply tube part 57. That is to say, when the liquid container 50 is provided onto a plane perpendicular to the grip surface 541, the positional relationship is one where the grip surface 541 and the substrate unit 58 do not overlap.

As illustrated in FIGS. 31 and 32, the circuit board retention part 59 and the positioning part 56 are provided to the first side 53*fa*, which is the same side.

As illustrated in FIG. 32, the positioning part 56 and the circuit board retention part 59 are provided to the surface of the first side 53*fa*, as illustrated in FIG. 31, whereas the pressing part 545 is provided to the surface of the second side 53*fb*, as illustrated in FIG. 32.

The pressing part 545 is a portion that is pressed on by the user when the liquid container 50 is connected to the printer 10. By pushing the pressing part 545 to the −K1-axis direction side, the user causes the movable member 40 (see FIGS. 37 to 42) on which the liquid container 50 is set up to move to the −K1-axis direction side.

The pressing part 545 is provided so as to protrude outwardly (the +K1-axis direction) from the operation member 53. This makes it easier to distinguish between the pressing part 545 and the other portions. As a result, the user can be prompted to an operation for pressing on the pressing part 545 when connecting the liquid container 50 to the printer 10.

As illustrated in FIG. 34, regarding the pressing part 545, a part of the outer shape of the pressing part 545 extends outside in the Z-axis direction beyond the base part 548 when the operation member 53 is viewed from the direction running along the K1-axis direction. In this manner, the pressing part 545 is easily pushed on, because the surface area is set so as to be large.

As illustrated in FIGS. 29 to 33, identifying ribs 595 are provided to a lower part of the circuit board retention part 59. The identifying ribs 595 are each shaped differently for every ink color to be stored. The detachable unit 30 is provided with an engaging groove 596 (FIG. 40) in order to accept only a liquid container 50 of the correct color of ink.

Configuration of Detachable Unit 30

Figure 37:
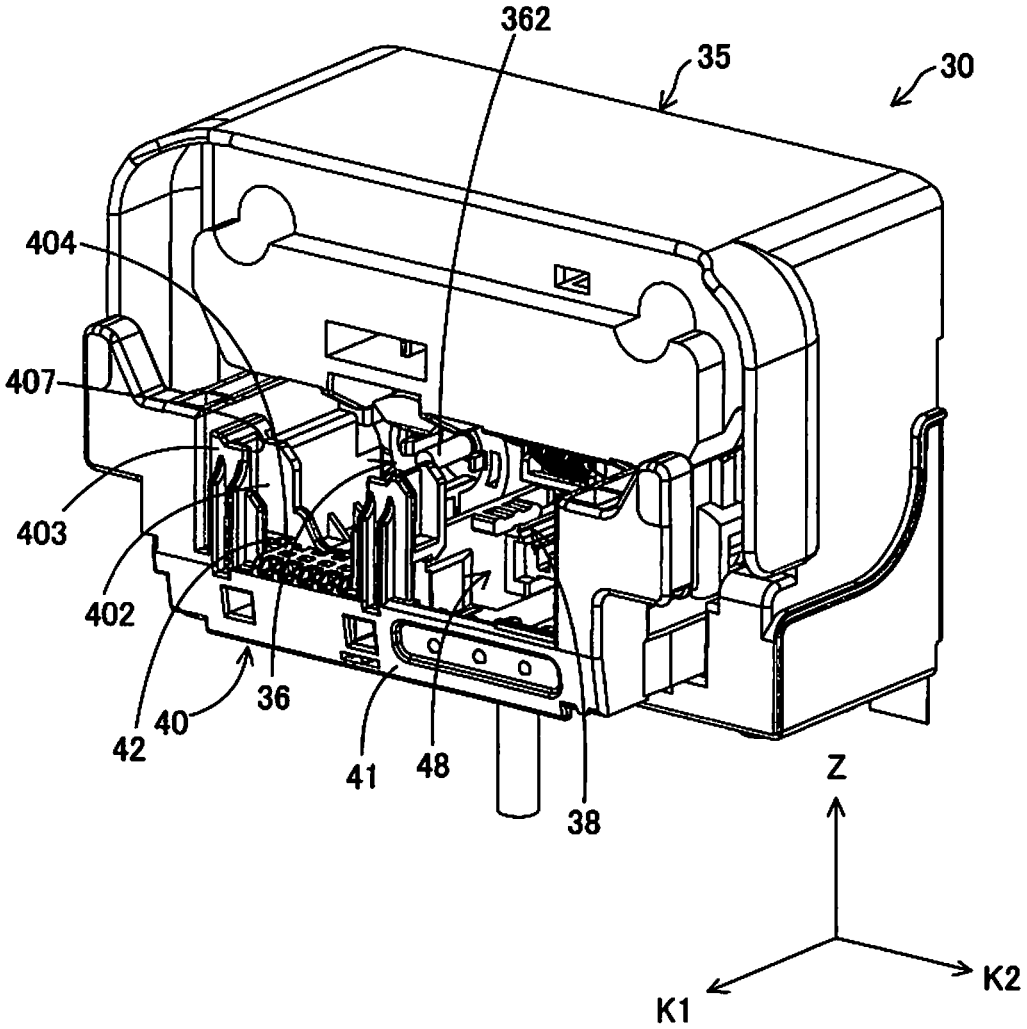
FIG. 37 is a perspective view for describing a detachable unit.
Figure 38:
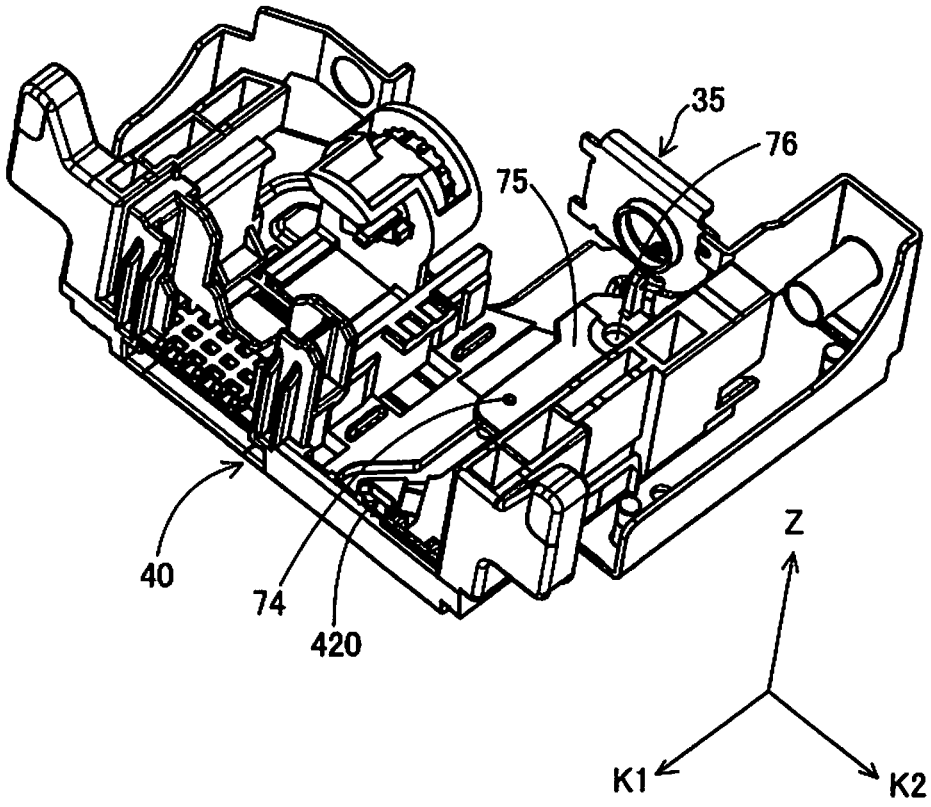
FIG. 38 is a perspective view for describing a detachable unit.
Figure 39:
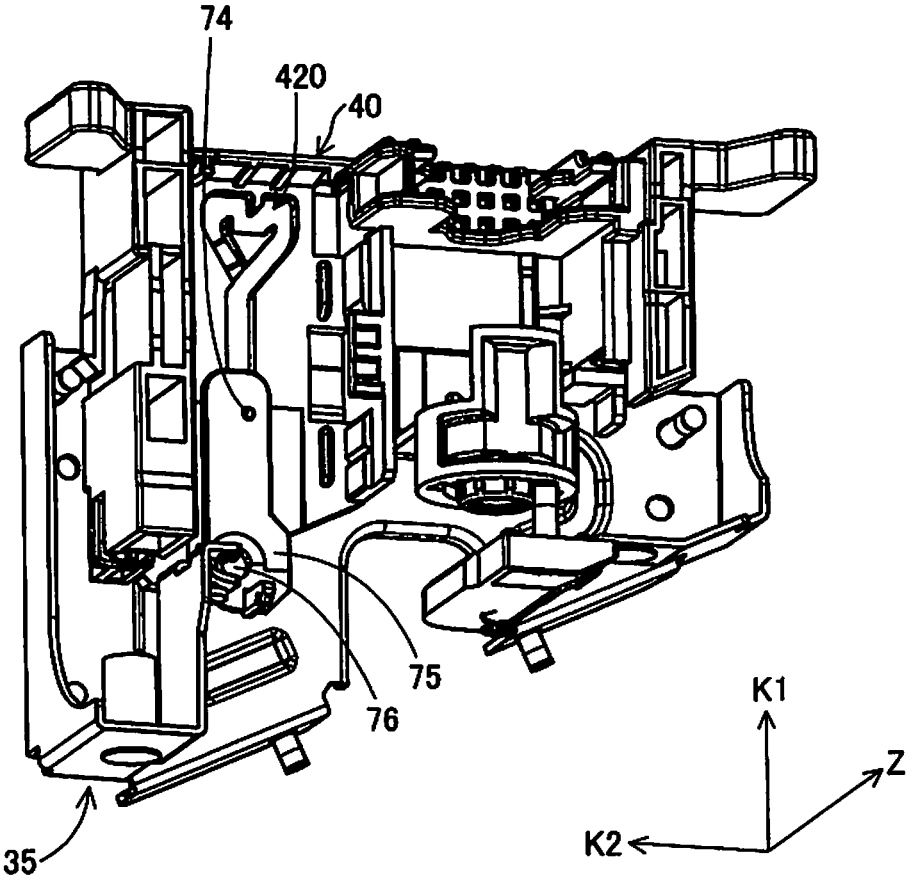
FIG. 39 is a perspective view for describing a detachable unit.
Figure 40:
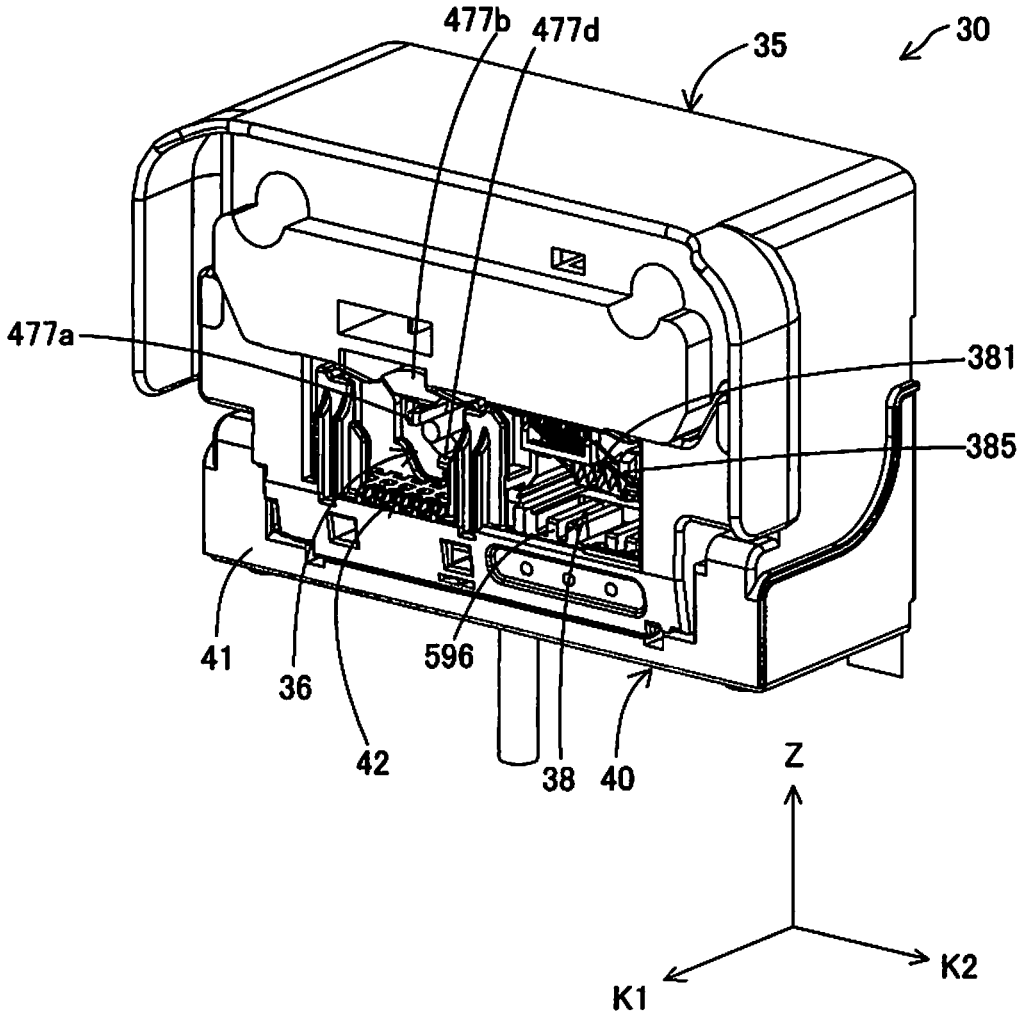
FIG. 40 is a perspective view for describing a detachable unit.

FIGS. 37 to 42 are perspective views for describing the detachable unit 30. FIGS. 38, 39, 41, and 42 omit depictions of a part of a fixed member 35. As illustrated in FIGS. 37 and 40, the detachable unit 30 is provided with the fixed member 35 and the movable member 40. FIGS. 37 to 39 are perspective views illustrating the detachable unit 30, and illustrate a state where the movable member 40 projects outwardly with respect to the fixed member 35. In this state, the state where the liquid container 50 has been set up on the movable member 40 is termed a "set state". This "set state" refers to a state where the positioning part 56 and the circuit board retention part 59 are engaged with the movable member 40.

Figure 41:
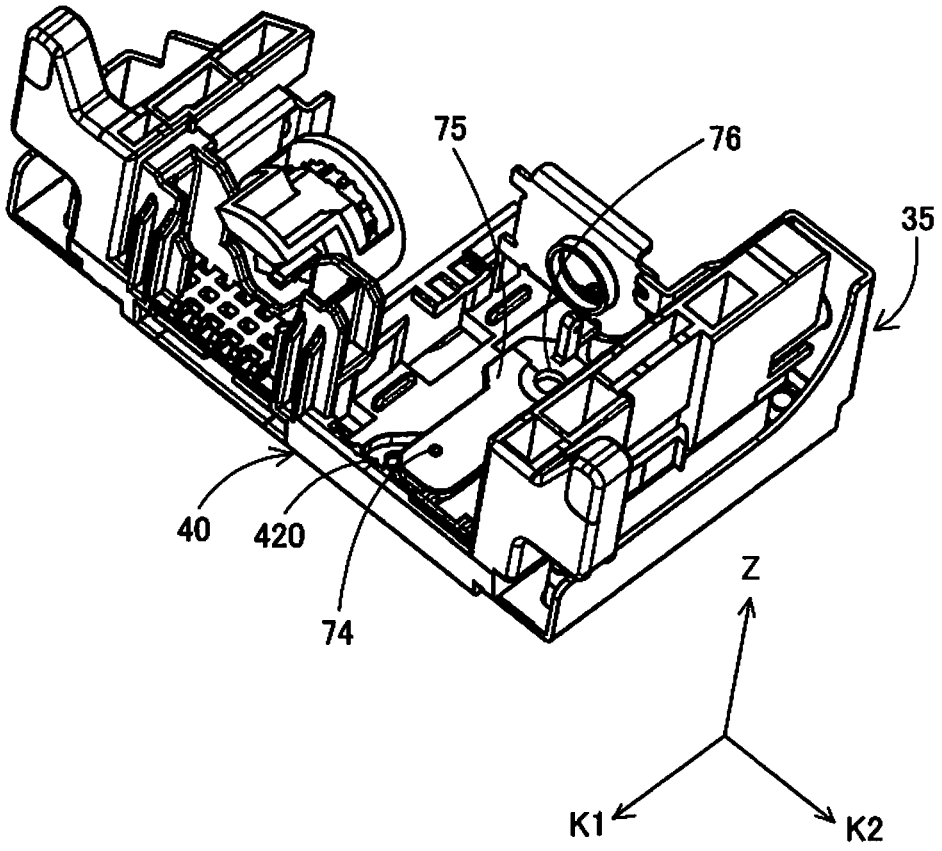
FIG. 41 is a perspective view for describing a detachable unit.
Figure 42:
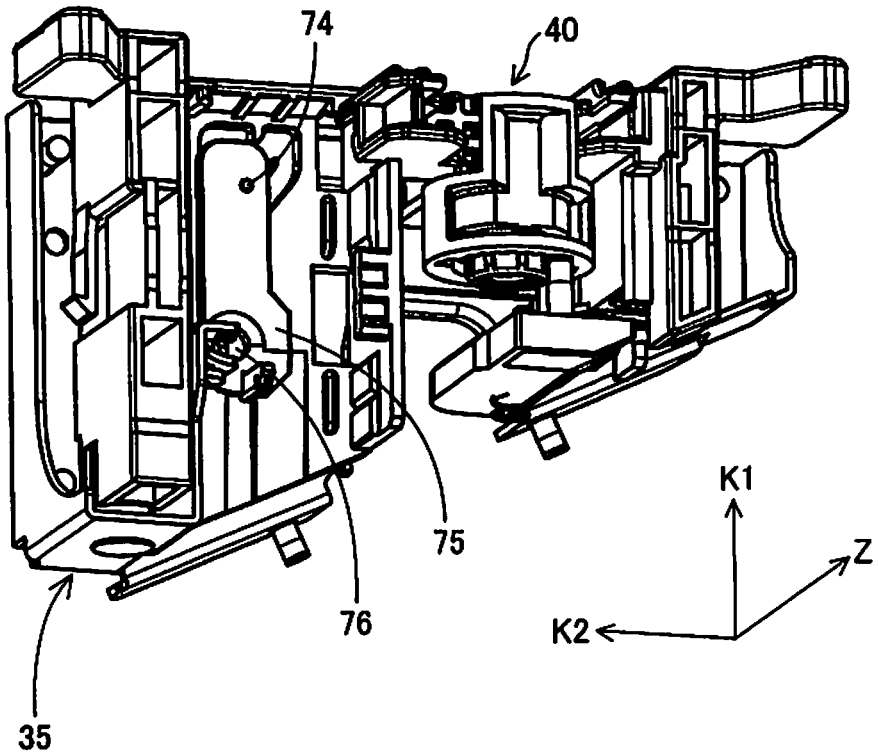
FIG. 42 is a perspective view for describing a detachable unit.

FIGS. 40 to 42 are perspective views illustrating the detachable unit 30, and illustrate a state where the movable member 40 is accommodated in the fixed member 35. The mounted state is reached upon the transition to this state from the set state.

The movable member 40 is colored in the corresponding color of ink. The "corresponding color of ink" refers to the color of the same system of color of the ink stored by the liquid container 50 that needs to be connected out of the liquid containers 50K, 50C, 50M, 50Y.

The fixed member 35 is provided with a liquid introduction mechanism 36 and a contact mechanism 38. The liquid introduction mechanism 36 and the contact mechanism are arranged side by side along the K2-axis direction. The liquid introduction mechanism 36 has a liquid introduction part 362.

The movable member 40 is configured so as to be able to move along the K1-axis direction relative to the fixed member 35. The movable member 40 is provided with a base part 41, the supply part supporting part 42, and a substrate supporting part 48. The supply part supporting part 42 and the substrate supporting part 48 are each connected to the base part 41. The supply part supporting part 42 and the substrate supporting part 48 are each members provided to the +Z-axis direction side relative to the base part 41.

As illustrated in FIG. 40, the contact mechanism 38 is provided with the plurality (nine in the embodiment 1) of apparatus-side terminals 381, and a plurality (two in the embodiment 1) of substrate positioning parts 385. In the mounted state of the liquid container 50, the apparatus-side terminals 381 are electrically connected to the circuit board 582 of the liquid container 50. This makes it possible for various kinds of information (for example, the color of ink and day, month, and year of manufacture of the liquid container 50) to be sent and received between the circuit board 582 and the printer 10. The apparatus-side terminals 381 are formed of leaf springs.

The substrate positioning parts 385 are arranged on both sides in the K2-axis direction (the direction in which the liquid introduction mechanism 36 and the contact mechanism 38 are arranged side by side) (FIG. 40 depicts only one side). The substrate positioning parts 385 perform final positioning of the circuit board of the liquid container 50 relative to the apparatus-side terminals 381 when the liquid container 50 is mounted onto the detachable unit 30. The substrate positioning parts 385 are members that extend along the K1-axis direction.

The supply part supporting part 42 is a member for determining the position, to a certain extent, of the liquid container 50 relative to the liquid introduction part 362. The supply part supporting part 42 is provided to a position that overlaps with the liquid introduction part 362 when the detachable unit 30 is viewed along the K1-axis direction.

The supply part supporting part 42 is provided so as to form a concave shape. This concave shape signifies that the outline is substantially the shape of the character 凹 (indented cuboid) when viewed from the front. The "front" mentioned here refers to a plane where the +Z-axis direction is upward and the −K1-axis direction is inward. A groove part 407 is formed at both sides in the K2-axis direction on the supply part supporting part 42. Movement of the liquid supply tube part 57 is limited by when the previously described positioning part 56 (FIGS. 29 to 31) comes in from above into the groove parts 407. That is to say, movement of the liquid supply tube part 57 is limited by a plurality of surface parts (for example, a first support surface part 402, a second support surface part 403, and a third support surface part 404) that demarcate and form the supply part supporting part 42. This results in the liquid container 50 being positioned to a certain extent relative to the detachable unit 30.

The positioning part 56 is arranged on the inside of the supply part supporting part 42 when the liquid container 50 is connected to the printer 10. This causes the positioning part and the plurality of surface parts (the first support surface part 402, the second support surface part 403, and the third support surface part 404 that are illustrated in FIG. 37) demarcating and forming the supply part supporting part 42 to abut against one another in the set state. As a result, the movement of the liquid supply tube part 57 is limited. Thus, the liquid container 50 is positioned to a certain extent with respect to the K2-Z plane. This abutting performs positioning with respect to parallel movement (translation) in the K2-Z plane, and need not perform positioning with respect to rotation in the K2-Z plane.

The substrate supporting part 48 is a member for determining the positioning of the circuit board 582 relative to the contact mechanism 38. The substrate supporting part 48 is provided to a position that overlaps with the contact mechanism 38 when the detachable unit 30 is viewed along the K1-axis direction. The substrate supporting part 48 is provided so as to form a concave shape similar to that of the supply part supporting part 42. Movement of the circuit board of the liquid container 50 is limited by a plurality of surface parts (for example, first substrate support surface parts 482) that demarcate and form the substrate supporting part 48.

Figure 46:
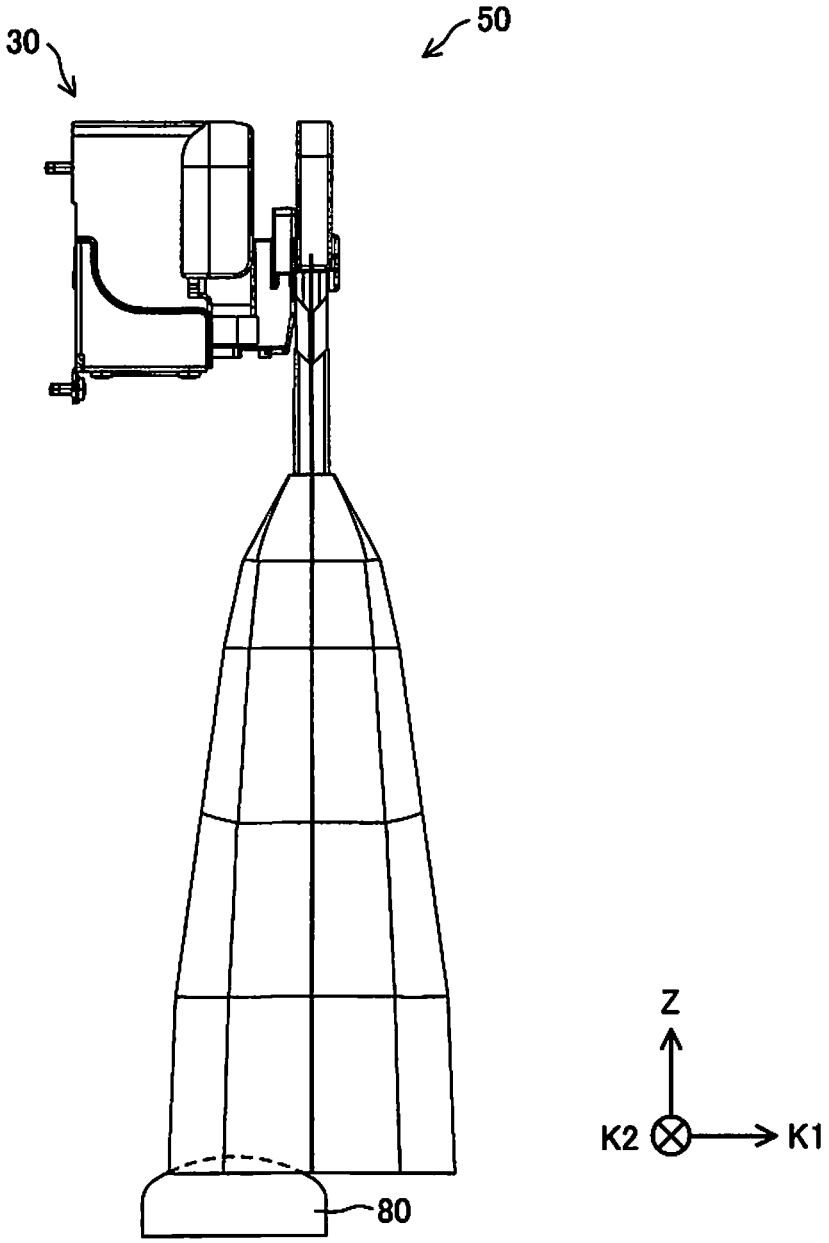
FIG. 46 is a side view (set state) illustrating a detachable unit, a liquid container, and an abutment part.

The circuit board retention part 59 is supported by the substrate supporting part 48 (FIG. 37) when the liquid container 50 is being newly mounted onto the detachable unit 30. This causes the circuit board retention part 59 and the circuit board 582 to be positioned to a certain extent with respect to the K2-Z plan relative to the apparatus-side terminals 381 (FIG. 46). Then, moving the movable member 40 in the −K1-axis direction causes a substrate positioning part 385 (FIG. 40) to enter into the groove part 593*t* (FIG. 29) of the circuit board retention part 59 and causes another substrate positioning part 385 (not shown) to enter into the groove part 592*t* (FIG. 30) of the circuit board retention part 59. The circuit board retention part 59 and the circuit board 582 are thereby positioned relative to the apparatus-side terminals 381.

At the transition to the mounted state, the liquid supply port 572 is connected to the liquid introduction part 362 in a state of having been positioned by projections 577 (577*a*, 577*b*, 577*c*, 577*d*; see FIGS. 29 to 31) provided to the liquid supply tube part 57 and positioning projections 477 (477*a*, 477*b*, 477*c*, 477*d*; see FIG. 40) provided to the fixed member 35. The liquid introduction part 362 is provided with a flow path at the interior, similarly with respect to the liquid injection member 13. The ink is supplied to the printer 10 by way of this flow path.

As illustrated in FIGS. 38, 39, 41, and 42, the movable member 40 is provided with a heart-shaped cam 420, and the detachable unit 30 is provided with a follower 75. The follower 75 is provided with an engagement projection 74. The engagement projection 74 is a member that projects out in the −Z-axis direction, but FIGS. 38, 39, 41, and 42 illustrate a portion of engagement with the follower 75 in the +Z-axis direction. The follower 75 is a member joined to the fixed member 35 via a connection part 76. The follower 75 engages with the movable member 40 by when the engagement projection 74 engages with the heart-shaped cam 420.

Figure 43:
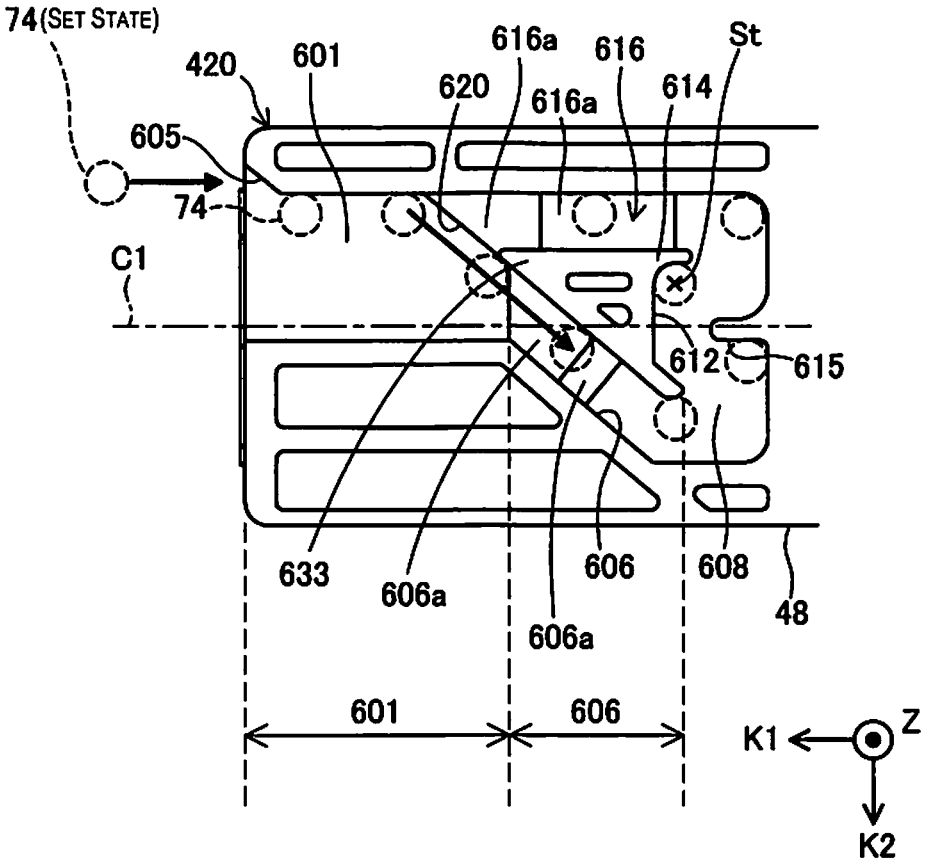
FIG. 43 is a drawing for describing retention and transition of respective states.

FIG. 43 is a drawing for describing the retention and transition of the variety of states. The states signify the previously described set state and mounted state. Below, a "mounting operation" refers to transitioning from the set state to the mounted state, and a "removal operation" refers to transitioning from the mounted state to the set state.

FIG. 43 schematically illustrates the heart-shaped cam 420. As illustrated in FIG. 43, the heart-shaped cam 420 is provided with a receiving part 601, a guiding part 606, a connection part 608, an engagement part 612, and an exit part 616.

During the mounting operation, the engagement projection 74 moves to the receiving part 601, the guiding part 606, the connection part 608, and the engagement part 612, in the stated order. In the mounted state, the engagement projection 74 engages with the engagement part 612 at a predetermined engagement position St of the engagement part 612. During the removal operation, the engagement projection 74 moves to the engagement part 612, the exit part 616, and the receiving part 601, in the stated order.

The receiving part 601 forms an opening 605 and receives the engagement projection 74 from the opening 605. The receiving part 601 is deeper than the other portions 606, 608, 612, 616 of the heart-shaped cam 420. This "deeper" signifies being positioned in the −Z-axis direction.

The guiding part 606 is a portion for guiding the engagement projection 74 to the engagement position St (a position where the engagement part 612 is formed). The guiding part 606 is connected to the receiving part 601. The guiding part 606 guides the engagement projection 74 at an incline with respect to the direction of movement of the movable member 40 (the −K1-axis direction). The guiding part 606 has an inclined part 606*a*. The inclined part 606*a* becomes increasingly shallower going away from the receiving part 601. There is no stepped difference at the boundary between the guiding part 606 and the receiving part 601.

The connection part 608 connects the guiding part 606 and the engagement part 612. The connection part 608 has a projection wall 615. The projection wall 615 projects out to the +K1-axis direction side from a wall that forms a dead end in the −K1-axis direction.

The engagement part 612 faces the projection wall 615. The engagement part 612 has an engagement wall 614. The engagement wall 614 is formed of a wall part 633. The wall part 633 is one of a plurality of wall parts that demarcate and form the groove of the heart-shaped cam 420. The exit part 616 connects the engagement part 612 and the receiving part 601. The exit part 616 has an inclined part 616*a*. At the inclined part 616, the groove becomes increasingly deeper approaching the receiving part 601. A stepped difference 620 is formed at the boundary between the exit part 616 and the receiving part 601.

The accompanying movement of the engagement projection 74 within the heart-shaped cam shall now be described with reference to FIG. 43. FIG. 43 illustrates the relative movement of the engagement projection 74 with respect to the movable member 40. In fact, the movable member 40 rotates in the K1-axis direction relative to the fixed member 35, and the engagement projection 74 rotates about the connection part 76.

The movable member 40 at all times receives a force toward the +K1-axis direction from the fixed member 35 due to the elastic force of an elastic body such as a spring (not shown). The connection part 76 exerts a torque on the follower 75 at all times while also rotatably connecting the follower 75. This rotational axis is the Z-axis, passing through the connection part 76. The orientation of torque generated by the connection part 76 is an orientation of rotation when a right-hand thread advances in the +Z-axis direction.

The engagement projection 74 moves to the guiding part 606 along the stepped difference 620 from the receiving part 601 during the mounting operation. Pressing the movable member 40 in the direction of mounting (the −K1-axis direction) against the previously described elastic force causes the engagement projection 74 to arrive at the connection part 608. The engagement projection 74, having arrived at the connection part 608, moves in a direction comprising a −K2-axis direction component due to the previously described torque. This causes the engagement projection 74 to collide with the projection wall 615 and stop. A clicking noise occurs at this time. The clicking noise lets the user know that there is no need to press any further.

When the user stops pressing in the direction of mounting, then the movable member 40 is pushed back in the direction of removal (the +K1-axis direction) by the previously described elastic force. This releases the engagement from the projection wall 615 and causes the engagement projection 74 to arrive at the engagement part 612. The previously described torque then causes the engagement projection 74 to collide with the engagement wall 614. This collision produces a clicking noise. This clicking noise lets the user know that the mounting operation is complete.

The removal operation is realized by the following procedure. The user pushes the movable member 40 in the direction of mounting. This separates the engagement projection 74 from the engagement wall 614. Then, the previously described torque causes the movable member 40 to move in the −K2-axis direction, thus releasing the engagement. In association therewith, the engagement projection 74 collides with the wall. This collision produces a clicking noise. This clicking noise lets the user know that there is no need to press any further.

In the state where the engagement has been released, when the user stops pressing in the direction of mounting, then the previously described elastic force causes the movable member 40 to move in the direction of removal, and causes the engagement projection 74 to arrive at the receiving part 601 by way of the exit part 616. As a result, the removal operation is completed.

Mounting of Liquid Container 50 onto Detachable Unit 30

Figure 44:
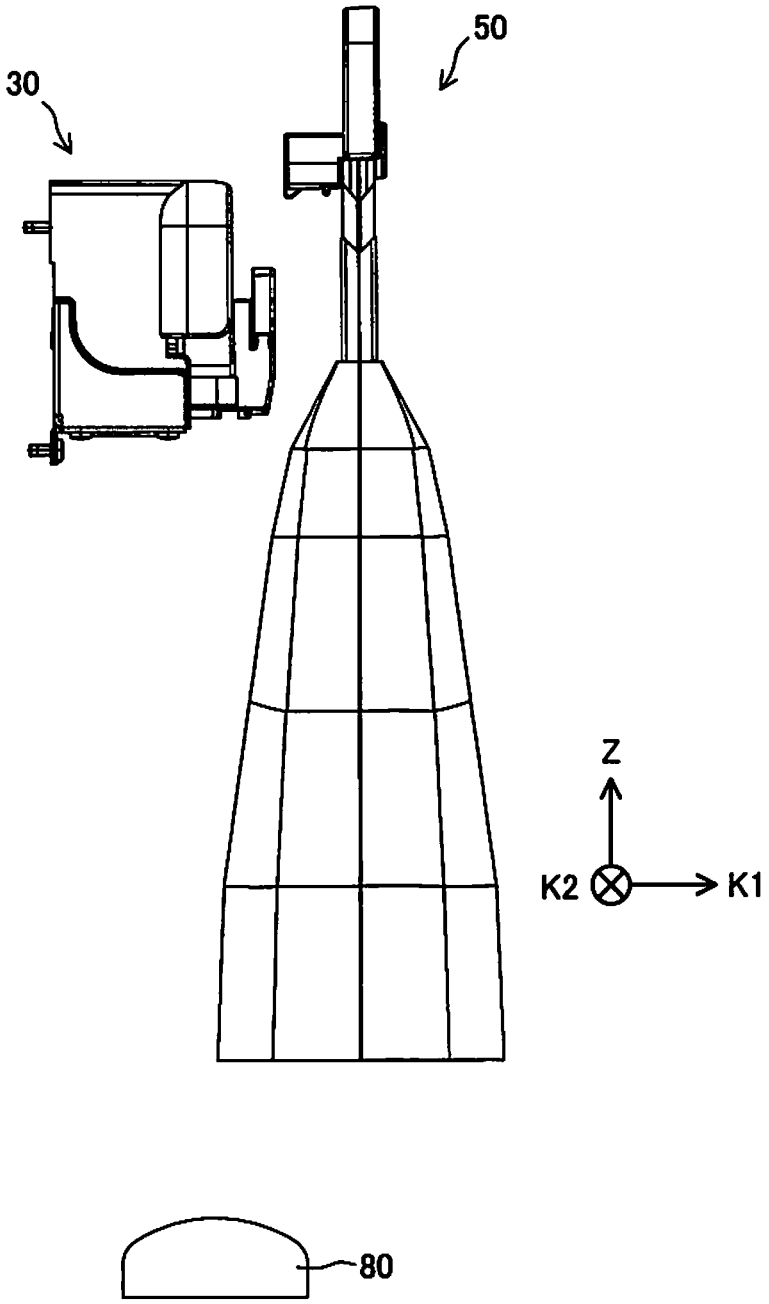
FIG. 44 is a side view (non-contacted state) illustrating a detachable unit, a liquid container, and an abutment part.
Figure 45:
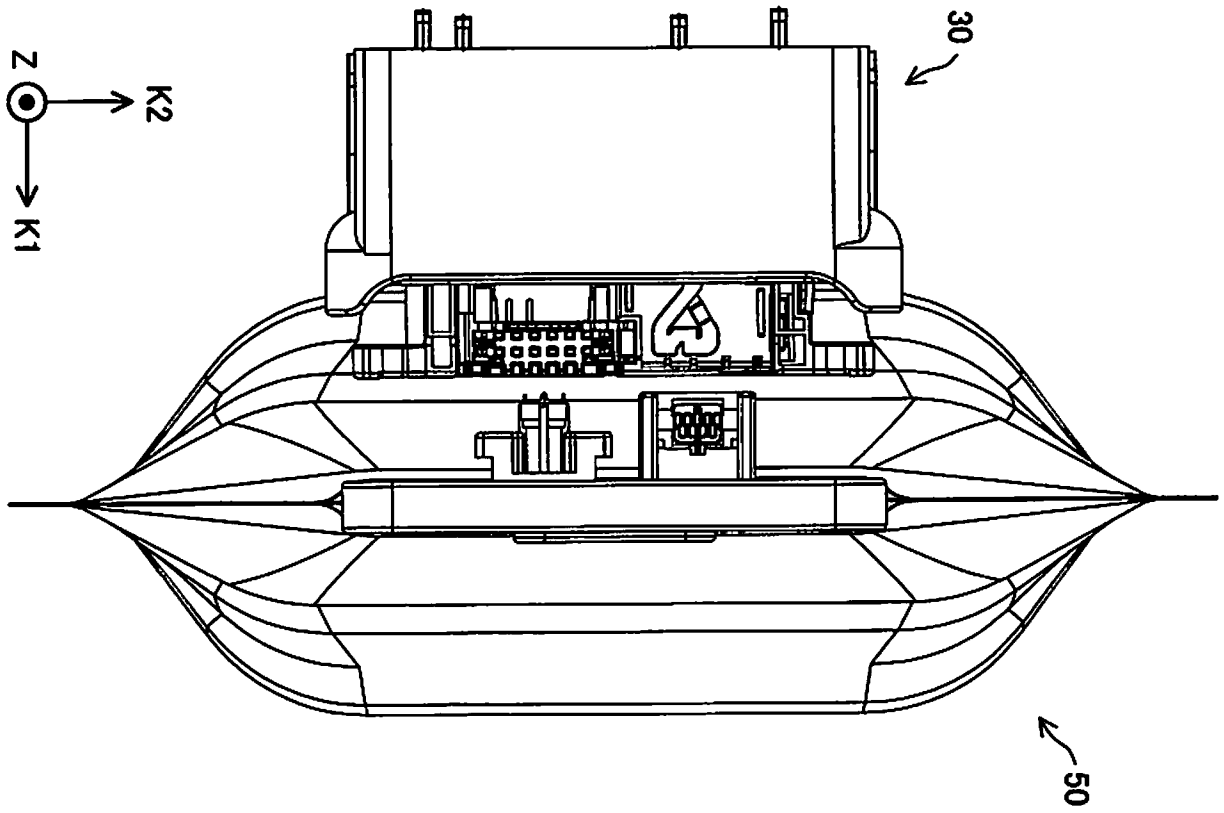
FIG. 45 is a top view (non-contacted state) illustrating a detachable unit and a liquid container.
Figure 47:
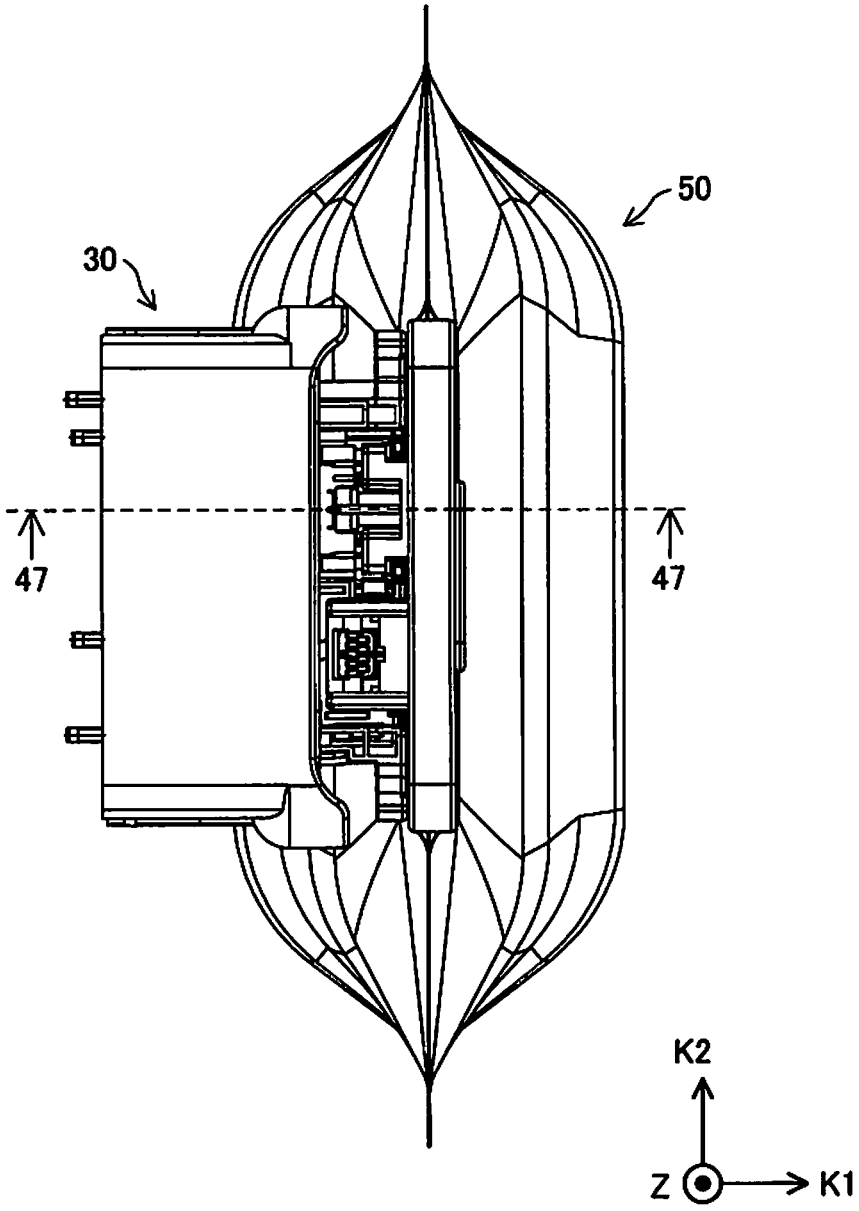
FIG. 47 is a top view (set state) illustrating a detachable unit and a liquid container.
Figure 48:
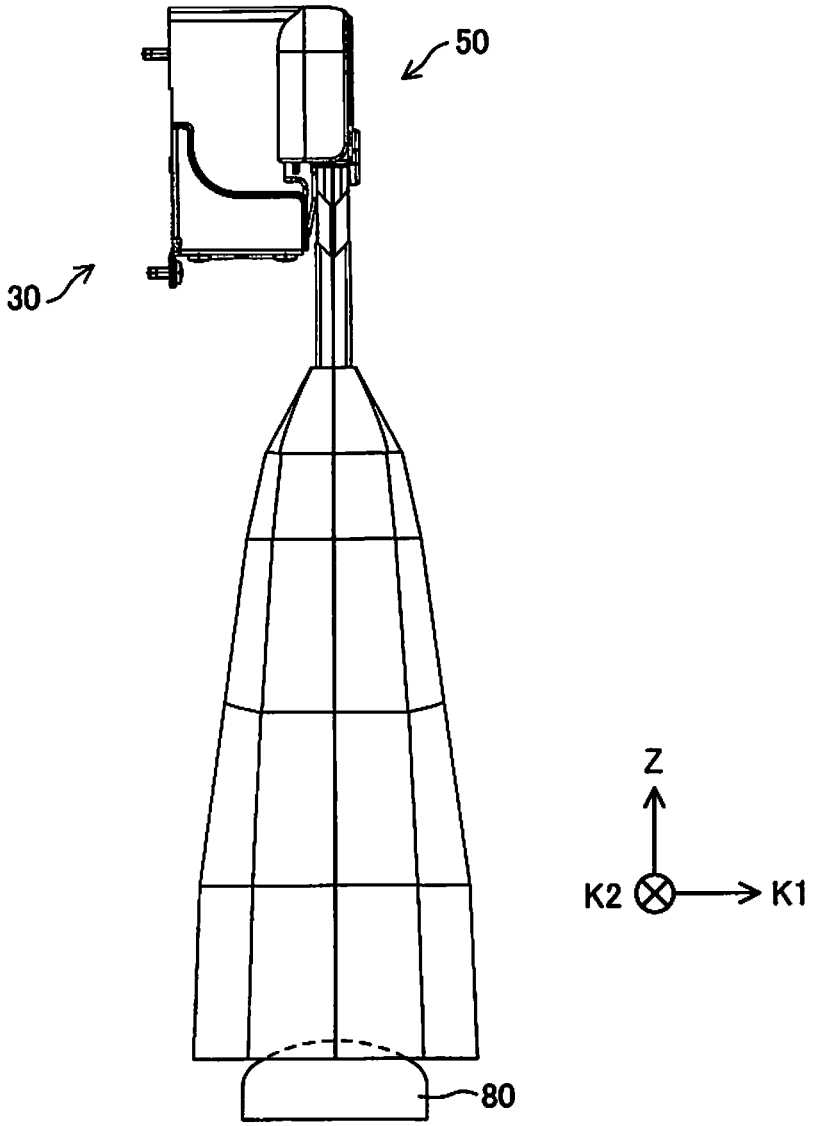
FIG. 48 is a side view (mounted state) illustrating a detachable unit, a liquid container, and an abutment part.
Figure 49:
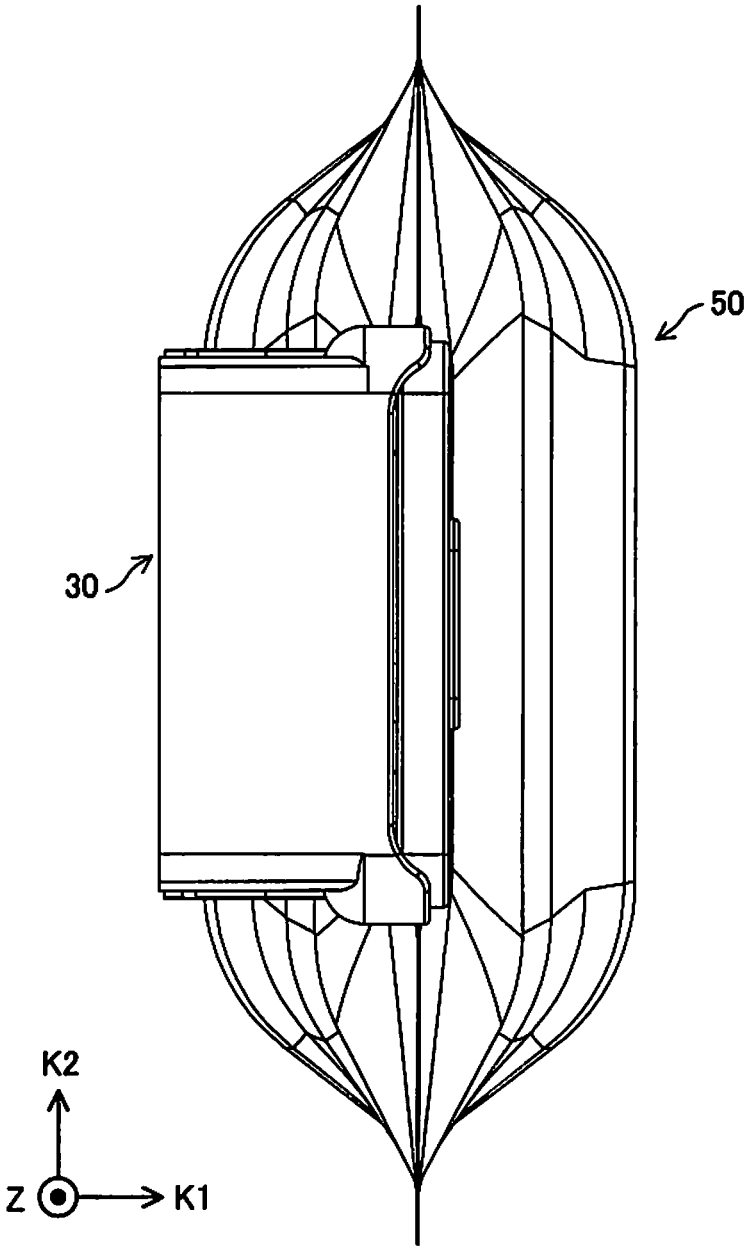
FIG. 49 is a top view (mounted state) illustrating a detachable unit and a liquid container.

The manner in which the liquid container 50 is mounted onto the detachable unit 30 shall now be described. FIGS. 44, 46, and 48 are side views illustrating the detachable unit 30, the liquid container 50, and the abutment part 80. FIGS. 45, 47, and 49 are top views illustrating the detachable unit 30 and the liquid container 50. FIGS. 44 and 45 illustrate a state (non-contact state) prior to when the detachable unit 30 and the liquid container 50 contact one another. FIGS. 46 and 47 illustrate the set state. FIGS. 48 and 49 illustrated the mounted state.

To transition from the non-contact state (FIGS. 44, 45) to the set state (FIGS. 46, 47), the user moves the liquid container 50 along the guide part 27 (not shown in FIGS. 44 to 49; see FIG. 5). At the transition to the set state, the positioning part 56 is supported by the movable member 40 such that the liquid supply part 53B is positioned further in the +Z-axis direction than the liquid storage bag 52. Saying here that "the liquid supply part 53B is positioned further in the +Z-axis direction than the liquid storage bag 52" comprises a case where the liquid supply part 53B enters into the liquid storage bag 52 with respect to the Z-axis direction, as in the present embodiment. In other words, this comprises a case where the lower end of the liquid supply part 53B is positioned further in the −Z-axis direction than the upper end of the liquid storage bag 52, as in the present embodiment. At the transition to the set state, the third film 523, which is the bottom part of the liquid container 50, abuts against the abutment part 80, as illustrated in FIG. 46.

The abutment part 80 is arranged so as not to hinder the transition from the non-contact state to the set state. Were the abutment part 80 to shift considerably in the +Z-axis direction beyond the position that is illustrated in FIG. 46, then the operation member 53 would consequently be hindered from moving to the position serving as the set state. The abutment part 80 is arranged with such circumstances having been taken into consideration. The abutment part 80, as a result, bears a part of the load of the liquid container 50 in the set state.

In the transition from the set state to the mounted state, as well, the abutment part 80 also bears a part of the load of the liquid container 50, and therefore the load applied to the movable member 40 is lightened during this transition. As a result, the movement of the movable member 40 becomes smoother and the durability of the movable member 40 is improved.

Figure 50:
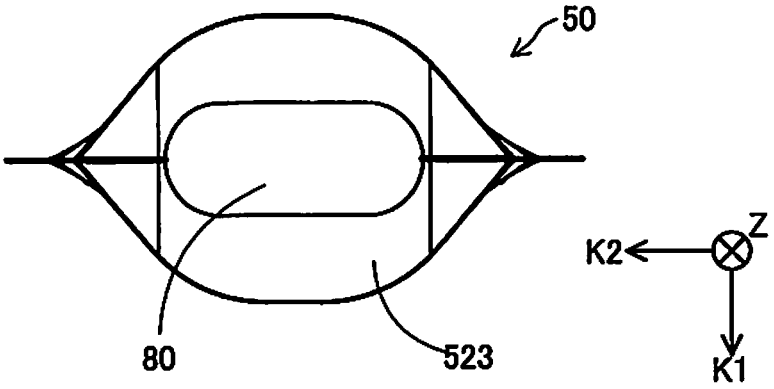
FIG. 50 is a bottom view (mounted state) illustrating a liquid container and an abutment part in a mounted state.

FIG. 50 is a bottom view illustrating the liquid container 50 and the abutment part 80 in the mounted state. The abutment part 80 is located near the middle of the third film 523 in the mounted state, as illustrated in FIG. 50. In other words, as illustrated in FIG. 50, the two-dimensional center of gravity of the third film 523 and the two dimensional center of gravity of the abutment part 80 either match or approximate one another. The "two-dimensional center of gravity" refers to the center of gravity of a two-dimensional figure obtained by projecting the outline onto a horizontal plane.

The movement of the third film 523 to the outside (the −Z-axis direction) is limited by when the abutment part 80 abuts near the middle of the third film 523 in the mounted state. When the movement is limited in this manner, then the third film 523 more readily moves inward when the liquid storage bag 52 is compressed due to a reduction in the amount of ink remaining. As a result, the amount of residual ink is more readily reduced.

Re-Injection of Ink

Figure 51:
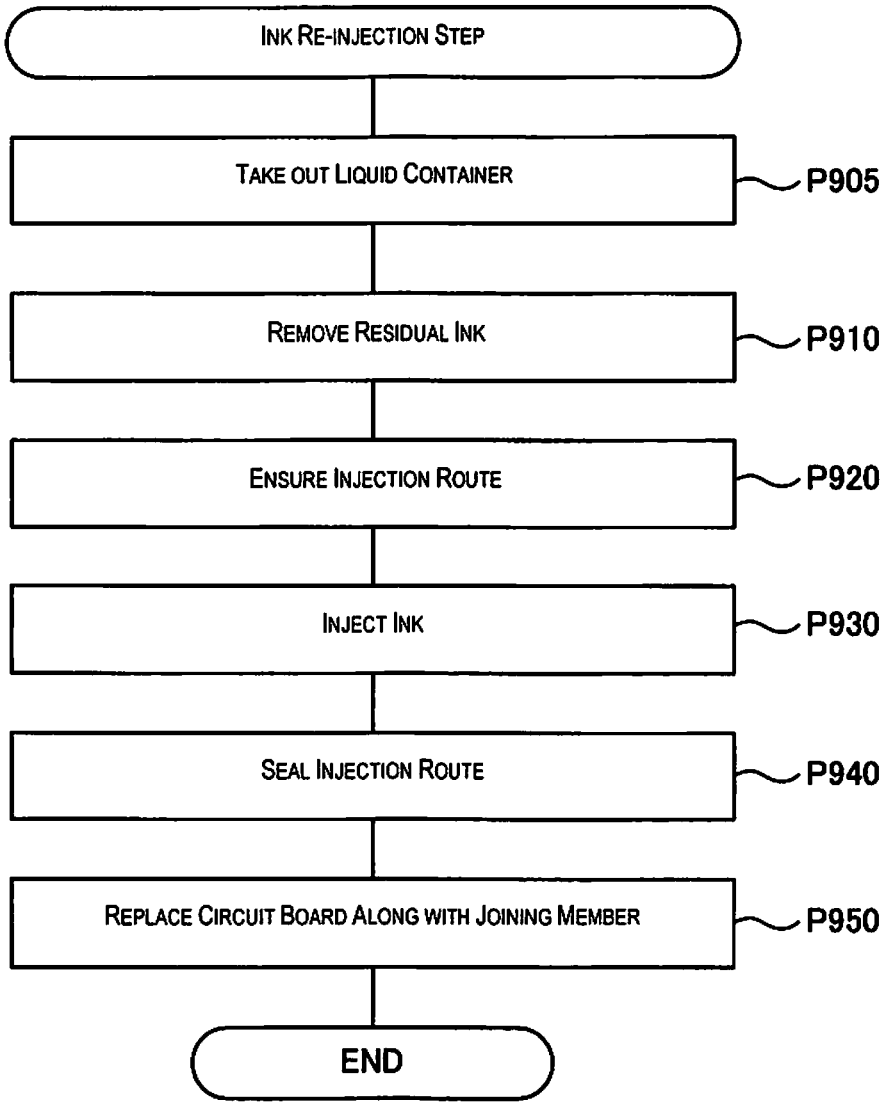
FIG. 51 is an operation flow chart illustrating an ink re-injection step.

FIG. 51 is an operation flow chart illustrating an ink re-injection step. Re-injection of the ink refers to again injecting the ink into a liquid container 50 where little ink remains due to the ink having been used for printing.

First, the liquid container 50 is removed from the storage space part 26 (step P905). Next, the residual ink is removed (step P910). Then, an injection route is ensured (step P920) and the ink is injected (step P930).

The steps P910 to P930 can be implemented with a variety of methods. In the embodiment 1, the liquid supply tube part 57 is utilized to implement all of the steps P910 to P930. In the step P910 of the embodiment 1, the syringe that was used for the step P9880 is inserted into the liquid supply tube part 57 interior to suction the residual ink. The steps P920 and P930 of the embodiment 1 are achieved with a similar approach to that for the steps P850 and P860 in the ink sealing step.

Figure 52:
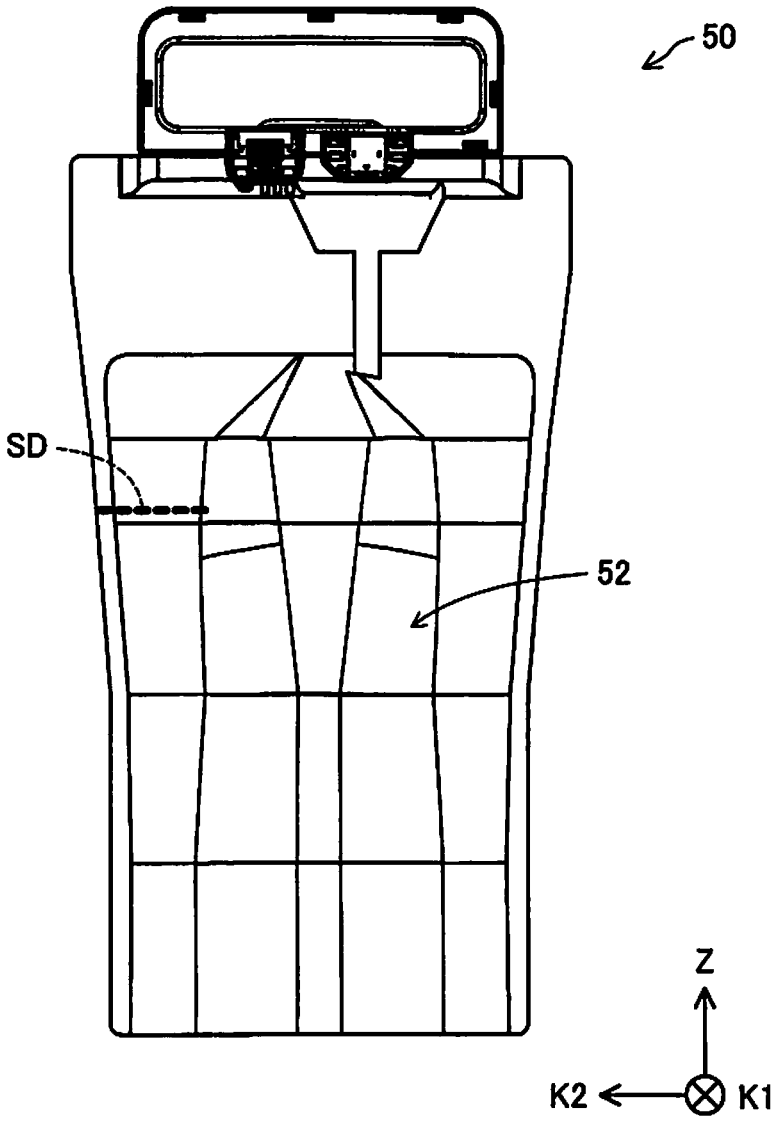
FIG. 52 is a drawing illustrating a cut surface for re-injection of ink.

In another embodiment, for example, the step P910 may be achieved by cutting a part of the liquid storage bag 52 and discharging the residual ink from the cut surface. FIG. 52 illustrates a cut surface SD for the step P910. In a case where the step P910 is implemented in this manner, then the step P920 is achieved at the same time. This is because the cut surface SD functions as an injection route. The step P930 is achieved by injecting the ink from the cut surface. The operation member 53 helps to form the cut surface SD. This is because at the time of cutting, gripping the operation member 53 makes it possible to stabilize the posture of the liquid container 50.

After the injection of the ink, the injection route is sealed (step P940). The step P940 is implemented in accordance with the approach for the step P920. In a case where the liquid injection member 13 is used for the step P920, then the injection route is sealed off whenever the liquid injection member 13 is pulled out. Moreover, the liquid supply port 572 may be blocked off with the sealing film 99 or the like. In a case where cutting is used for the step P920, then the step P940 is achieved by blocking off the cut surface with welding or the like.

Finally, the circuit board 582 is replaced along with the joining member 53A (step P950). The circuit board 582 after replacement stores information relating to the replacement. "Information relating to the replacement" could refer to, for example, the date of the replacement and the number of times re-injection was performed. The joining member 53A is a separate member from the liquid supply part 53B involved in sealing the ink, and therefore can easily be replaced.

Effects

According to the embodiment 1, at least the following effects can be obtained.

The fact that the third film 523 functions as a gusset part makes it possible to store a large amount of ink.

The fact that the crease 90 is provided to the third film 523 makes it possible to reduce the amount of residual ink.

The fact that the flow path member 70 is provided reduces the amount of residual ink because the ink is absorbed near the bottom part of the liquid storage bag 52.

The fact that a part of the liquid supply tube part 57 is provided so as to contact the scooped-out part 60 makes it possible to offset the liquid supply tube part 57 in the −Z-axis direction more than in a case where the scooped-out part 560 were not provided. As a result, any increase in the height of the liquid container 50 (the length in the Z-axis direction) is curbed while also the receiving space part 542 is being ensured in the grip part 54.

When the liquid supply part 53B is positioned relative to the liquid storage bag 52 as preparation for welding, simple execution is possible because the liquid supply tube part 57 need only be made to contact the notch part 529.

The fact that the bonded part 549*a* has the overhanging part 570 increases the surface area of the bonded part 549*a*. It is consequently possible to increase the bonding force.

The fact that the first chamber 558, the second chamber 559, and the bypass 562 are provided to the reverse side of the overhanging part 570 curbs any increase in the size of the liquid supply part 53B in the Z-axis direction.

The fact that the flow path member 70 has the holes 71 causes the ink to be smoothly injected.

At the time of ink injection, the fact that the lead-out part 550 and the bypass 562 function as injection routes causes the injection to be smoother.

The fact that the projections 665 are provided curbs any affixation of the second film 522 to the end surface of the second rib 660. This causes smoother flowing between the first chamber 558 and the second chamber 559.

The bypass 562 functions as a route for injecting the ink, and is sealed off at the time of completion of the ink sealing step. Because there is no portion that is welded twice or more while such a step is being achieved, the possibility that the first and second films 521, 522 could be damaged or peel is reduced. There is no portion that is welded twice or more because the welded surface of the second rib 660 is not a continuous surface with respect to the welded surface of the 650.

When the liquid injection member 13 is pulled out, the liquid supply tube part 57 is oriented in the horizontal direction, and therefore ink that drips from the liquid injection member 13 or the liquid supply port 572 is less likely to stick to the liquid container 50.

Until the liquid injection member 13 is pulled out after having been inserted, the liquid injection member 13 and the liquid supply tube part 57 are positioned by the jig 14, and therefore the injection of the ink can be stably executed. Moreover, with this positioning, the liquid supply part 53B does not experience great stress, and therefore there is no need for the operation member 53 overall to have the strength necessary for the positioning.

Because the flow path member 70 is inserted into the liquid storage bag 52 interior when the ink is being injected, affixation between the first film 521 and the second film 522 is curbed. In some instances, affixation between sheets may hinder the injection of the ink.

The bypass 562 can be utilized to discharge gas that has mixed in with the ink.

The guidance by the guide part 27 makes it possible for the user to easily insert the liquid container 50 into the storage space part 26.

Because the abutment part 80 has a convex shape bent at the portion that abuts against the third film 523, damage to the third film 523 is curbed.

The liquid supply tube part 57 is oriented in the horizontal direction and located higher than the liquid storage bag 52 in the set state. Also, the upper part of the cover member 22 is opened in the set state. Such a positional relationship makes it easier for the user to view the liquid supply tube part 57 and the liquid introduction part 362, and allows the user to easily execute the mounting operation.

During the set state, the mounted state, and a transition from one of these two states to the other, the fact that the abutment part 80 abuts against the third film 523 reduces the load applied to the detachable unit 30. Any damage to the detachable unit 30 is consequently curbed. In addition, it is easier to move the movable member 40 during a transition of state.

In the mounting operation, the user is able to move the movable member 40 and the liquid container 50 when the user presses on the pressing member 54C, and can therefore easily execute the mounting operation.

In the mounted state, the fact that the abutment part 80 abuts against the third film 523 makes it possible to reduce the amount of residual ink.

Because the liquid supply tube part 57 is positioned in the mounted state, the ink is supplied stably.

The fact that the flow path member 70 is provided makes it possible to easily discharge the residual ink.

Because the substrate unit 58 can be replaced by replacing the joining member 53A, the work of removing the substrate unit 58 from the joining member 53A is obviated.

Embodiment 2

Figure 53:
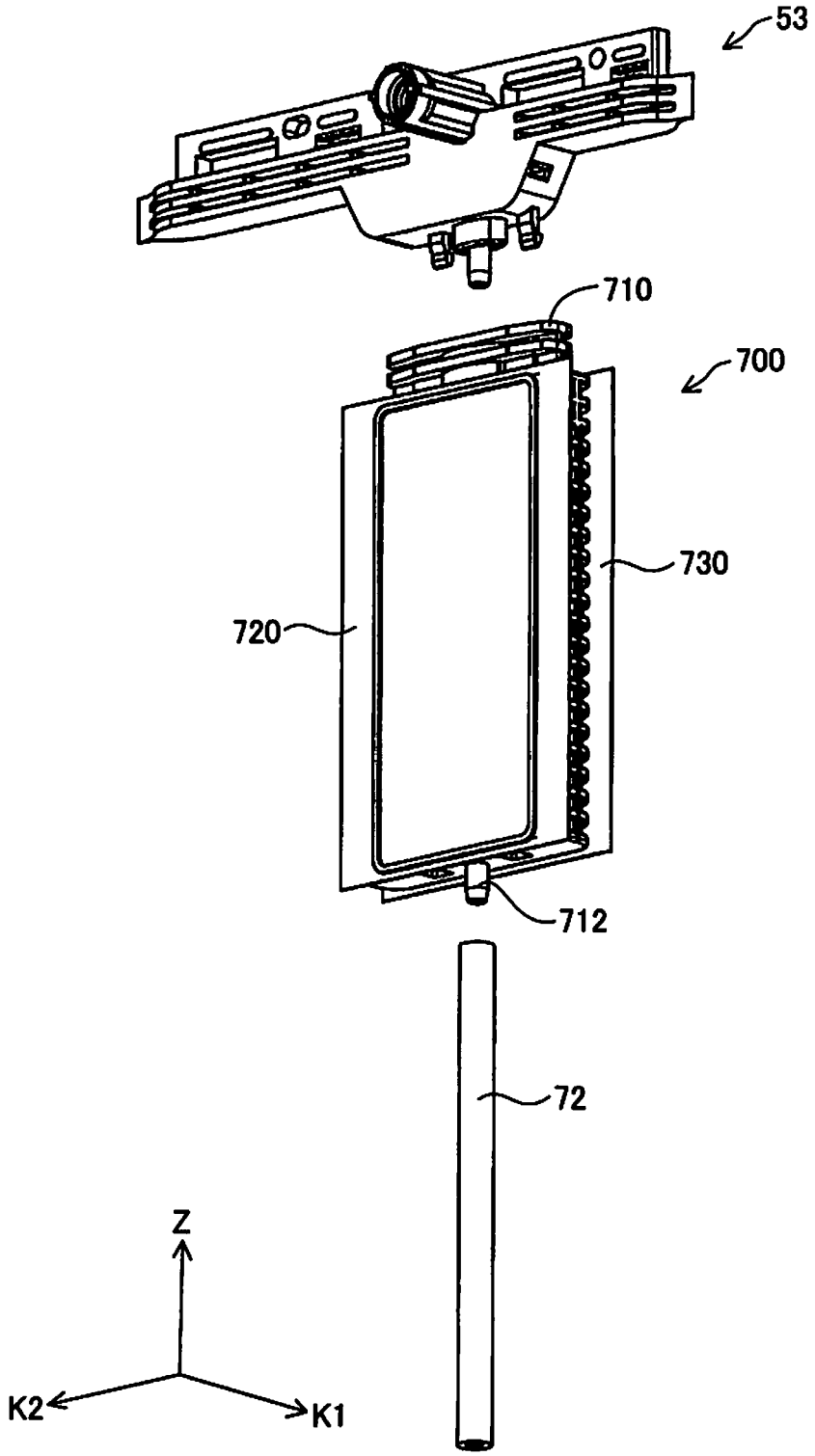
FIG. 53 is a perspective view illustrating a preparatory stage for an ink sealing process.
Figure 54:
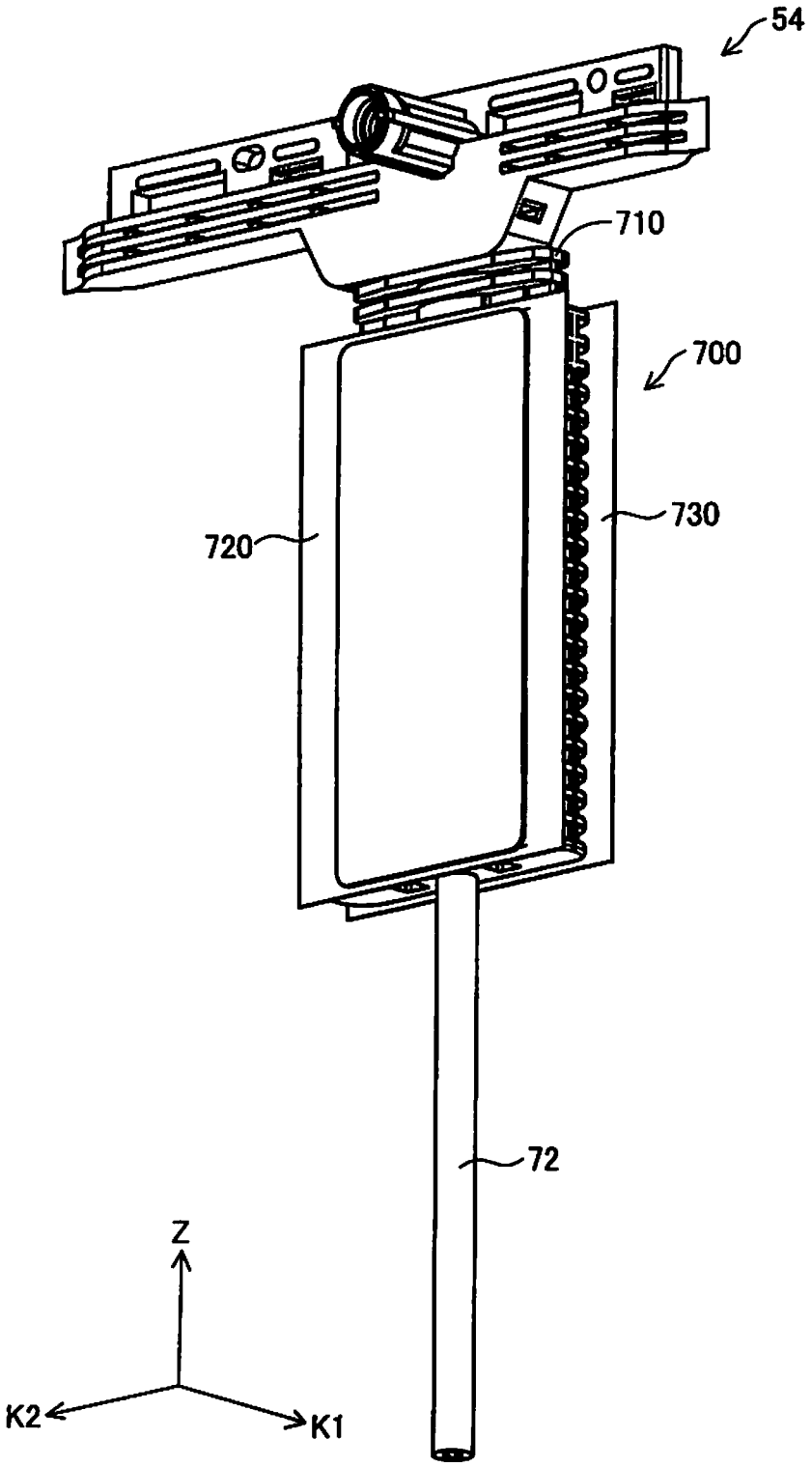
FIG. 54 is a perspective view illustrating a stage at which connection of a flow path is completed.

The embodiment 2 is different from the embodiment 1 in that a filter unit 700 is provided to the liquid storage bag 52 interior. FIG. 53 is a perspective view illustrating a preparatory stag of the step P810 in the ink sealing process (FIG. 14). FIG. 54 is a perspective view illustrating a stage where the step P810 is complete. The filter unit 700 has a flow path provided to the interior (see FIGS. 55, 58) and is connected between the operation member 53 and the flow path member 72, as illustrated in FIG. 54.

Figure 55:
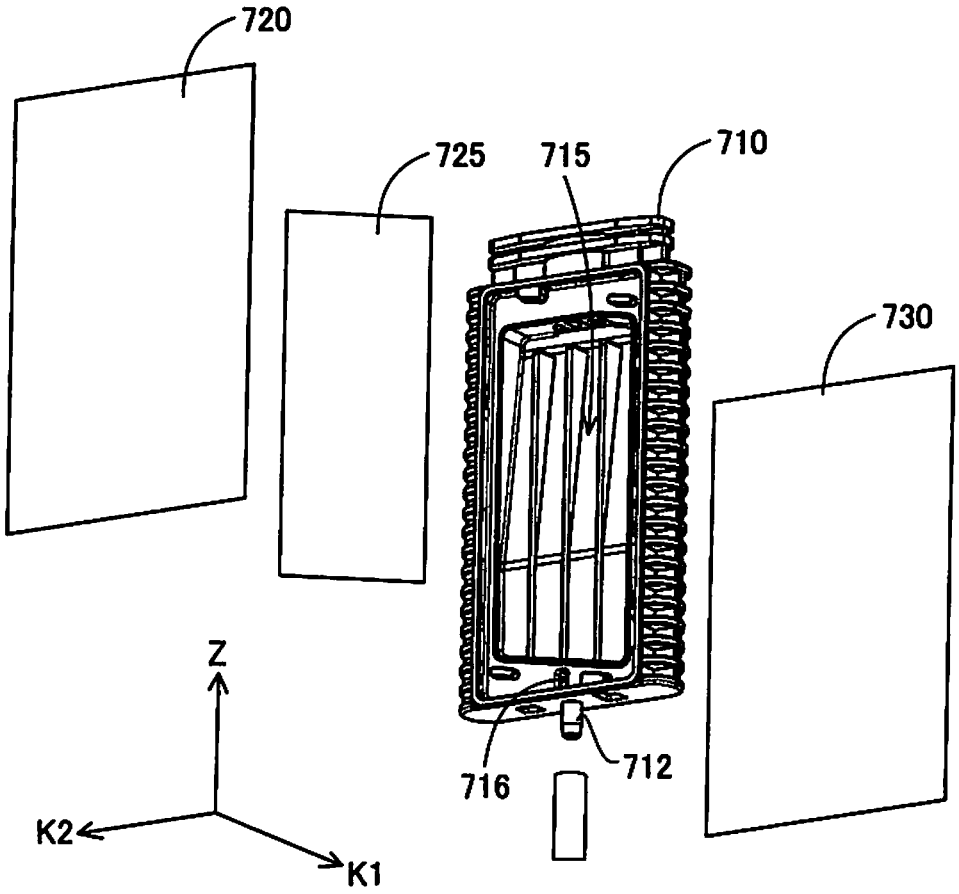
FIG. 55 is a perspective view illustrating an exploded view of a filter unit.
Figure 56:
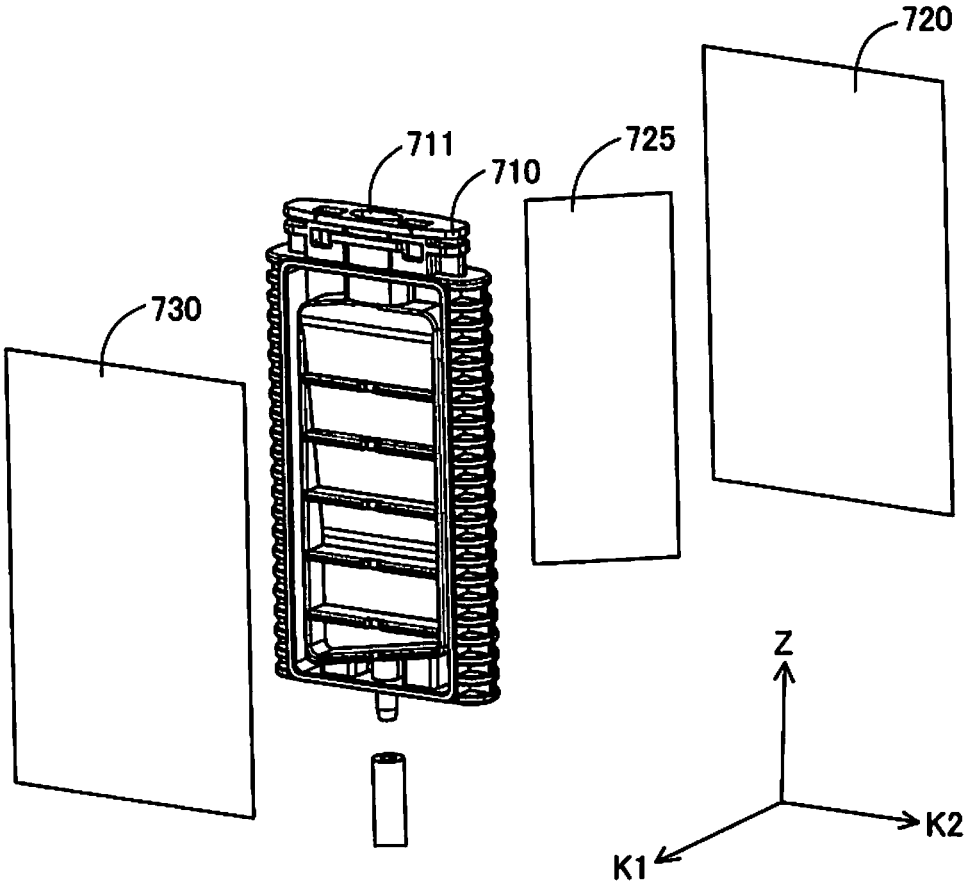
FIG. 56 is a perspective view illustrating an exploded view of a filter unit.

FIGS. 55 and 56 are perspective views illustrating an exploded view of the filter unit 700. The filter unit 700 is provided with a frame 710, a filter chamber frame 720, a filter 725, and a deaeration chamber film 730. The frame 710 is provided with an upper connection part 711, a lower connection part 712, a flow path chamber 715, a through hole 716, and a deaeration chamber 735.

The frame 710 is formed by, for example, resin molding. The filter 725 does allow the ink to pass through but is impermeable to impurities of a predetermined size or larger. The filter chamber film 720 and the deaeration chamber film 730 allow gas to pass through but are impermeable to the ink. The filter chamber film 720 and the deaeration chamber film 730 are formed of the same material.

The deaeration chamber film 730 seals off the deaeration chamber 735 in a state where the deaeration chamber 735 has been depressurized. This depressurization signifies that the pressure is lower than atmospheric pressure. Accordingly, any gas that would have contacted the deaeration chamber film 730 from the outside when the atmosphere of the deaeration chamber film 730 is at atmospheric pressure passes through the deaeration chamber film 730 and is trapped inside the deaeration chamber 735. Accordingly, at least some of any gas that has been mixed into the liquid storage bag 52 during the injection of the ink is trapped inside the deaeration chamber 735.

Figure 57:
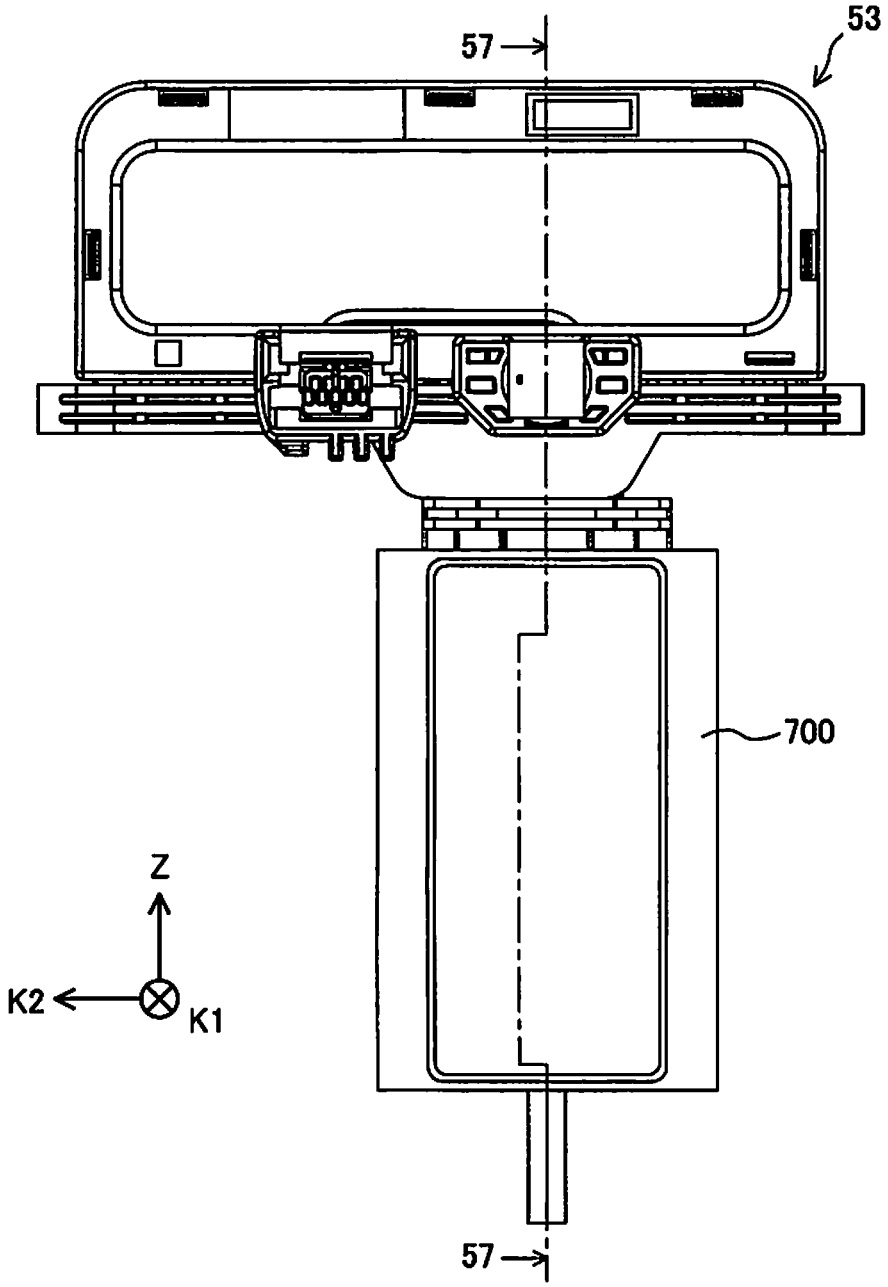
FIG. 57 is a front view illustrating the manner in which an operation member and a filter unit are connected.
Figure 58:
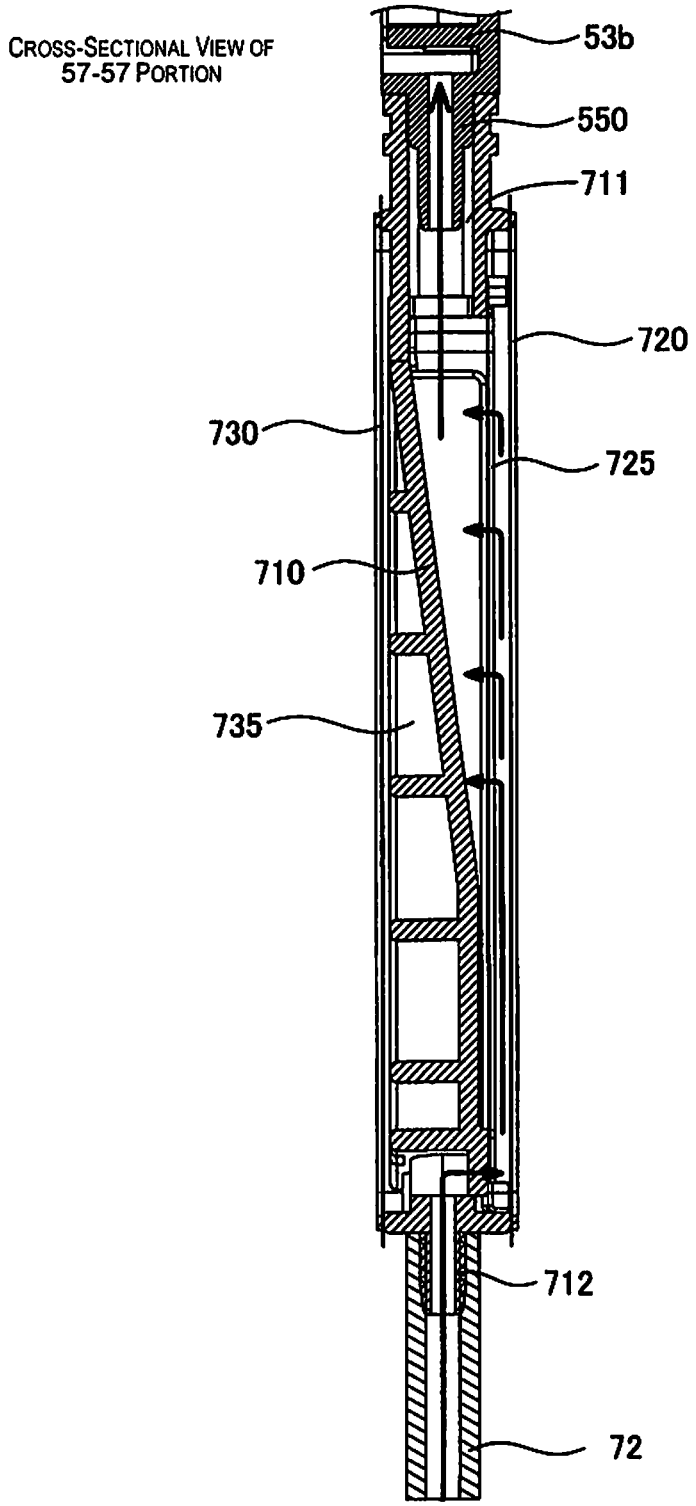
FIG. 58 is a cross-sectional view of FIG. 57.

FIG. 57 is a front view illustrating the manner in which the operation member 53 and the filter unit 700 are connected. FIG. 58 is a cross-sectional view taken along the 57-57 line in FIG. 57.

As illustrated in FIG. 58, ink that has flowed into the flow path member 72 passes through the through hole 716 (see FIG. 55; not illustrated in FIG. 58) and flows into a gap between the filter chamber film 720 and the filter 725. The ink that has flowed into this gap flows into the flow path chamber 715 while also being filtered by the filter 725. The ink that has flowed into the flow path chamber 715 passes through the lead-out part 550 and flows into the liquid supply part 53B.

According to the embodiment 2, it is possible to remove gas and impurities from the ink being supplied to the printer 10. Though the filter 725 is provided, the bypass 562 functions as the injection route during injection of the ink, and therefore a considerable increase in the flow path resistance for the injection route overall is avoided.

Embodiment 3

Figure 59:
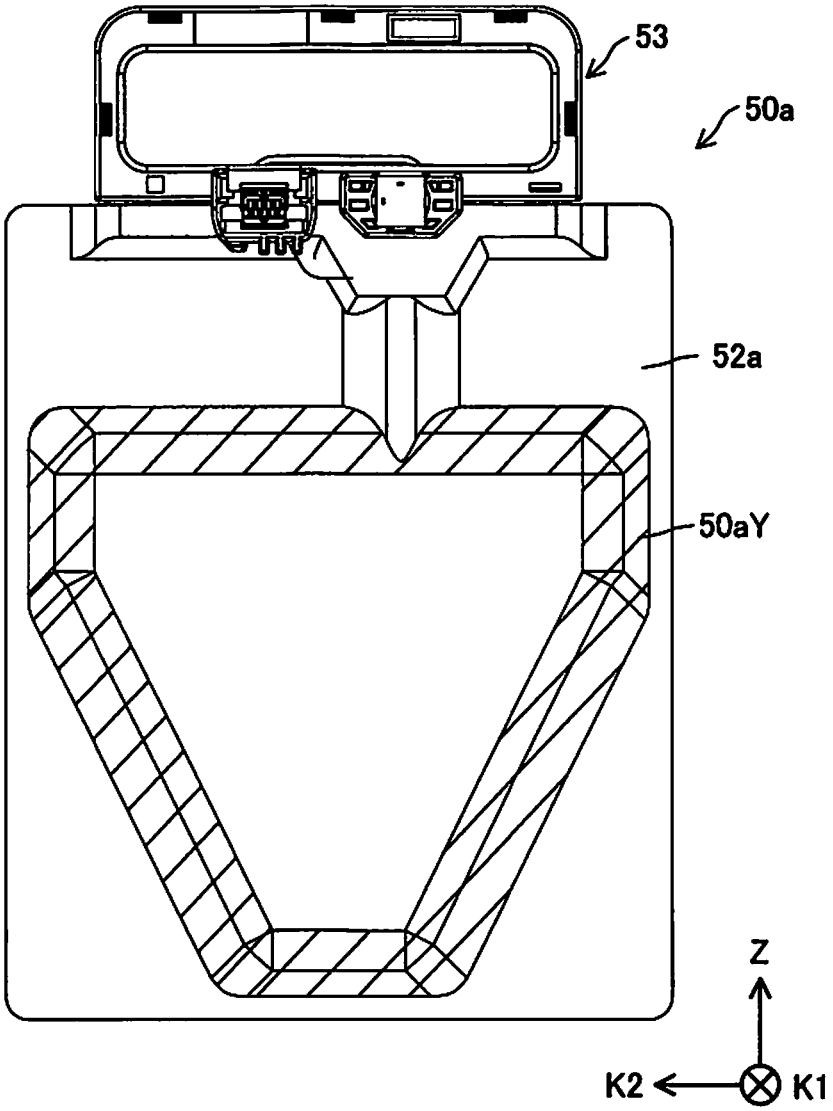
FIG. 59 is a front view (embodiment 3) illustrating a liquid container.
Figure 60:
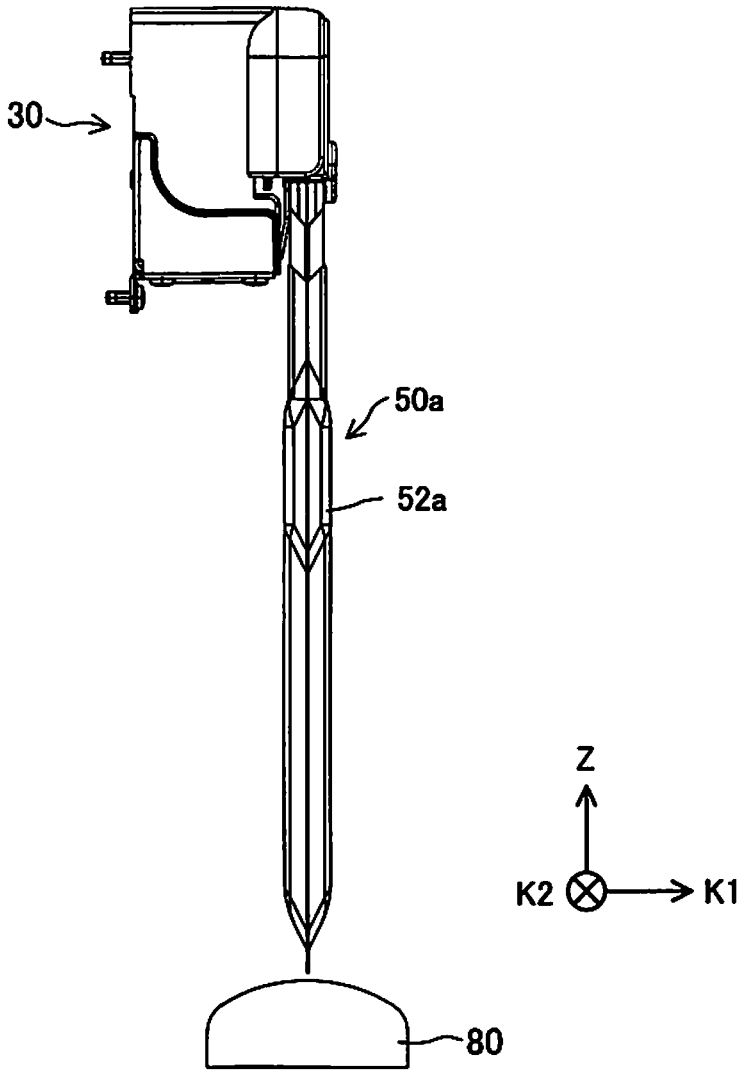
FIG. 60 is a side view (embodiment 3) illustrating a liquid container in a mounted state.

FIG. 59 is a front view illustrating a liquid container 50*a*. FIG. 60 is a side view illustrating the liquid container 50*a* in the mounted state, and illustrates a state where the amount of ink remaining is substantially zero. The liquid container 50*a* is intended to be mounted onto the detachable unit 30 as an alternative to the liquid container 50.

The liquid container 50*a* is provided with a liquid storage bag 52*a*. The liquid storage bag 52*a* is formed when two films are bonded together, and, unlike the liquid container 50, does not have a gusset part. The hatching illustrated in FIG. 49 illustrates a welded part 50*a*Y where the two films are welded together. The welded part 50*a* forms a shape like a pentagon; the reason why liquid is not stored near the corners near the bottom part is in order to reduce the amount of storage.

The liquid storage bag 52*a* is bonded to the operation member 53. This operation member 53 is the same as the one included with the liquid container 50, and is connected to the flow path member at the liquid storage bag 52*a* interior.

As illustrated in FIG. 60, the liquid container 50*a* does not abut against the abutment part 80 in the mounted state. This is because with the liquid storage bag 52*a*, the length in the Z-axis direction is less than that of the liquid storage bag 52 in the embodiment 1. Because the liquid storage bag 52*a* does not have the gusset part, it would be difficult to exert the effect where the amount of residual ink is reduced even were there to be abutment against the abutment part 80. Were there to be abutment, because the liquid storage bag 52*a* does not have the gusset part, there would be the possibility that the posture of the liquid container 50*a* in the mounted state could be inclined. Thus, in the case where there is no gusset part, it is preferable not to abut against the abutment part 80.

Embodiment 4

Figure 61:
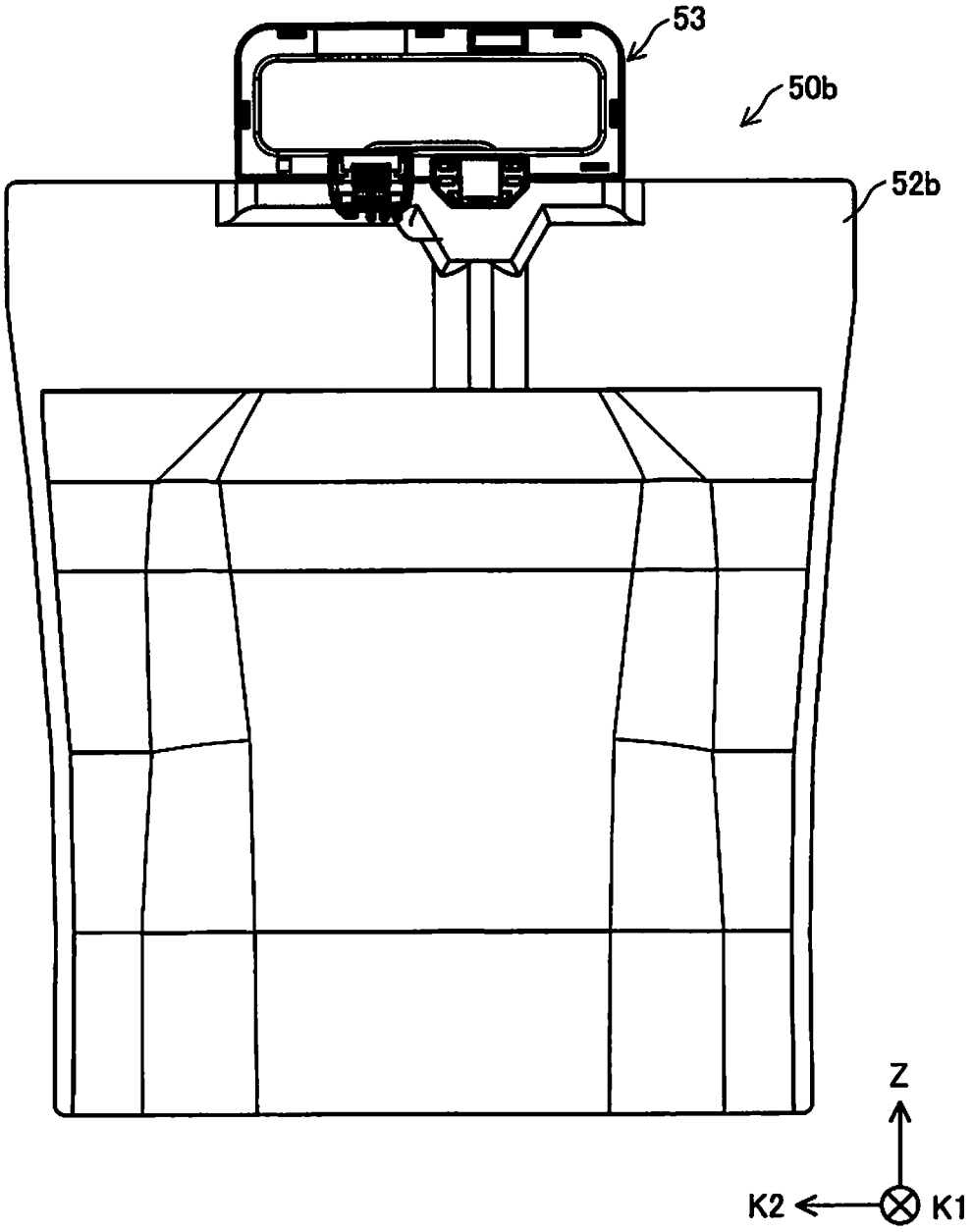
FIG. 61 is a front view (embodiment 4) illustrating a liquid container.

FIG. 61 is a front view illustrating a liquid container 50*b*. The liquid storage bag 52*b* is intended to be mounted onto the detachable unit 30 as an alternative to the liquid containers 50, 50*a*. The liquid container 50*b* is provided with a liquid storage bag 52*b* and the operation member 53. This operation member 53 is the same as the one included in the liquid container 50. The liquid storage bag 52*b* is wider in the K2-axis direction and is able to store more ink compared to the liquid storage bag 52.

As is exemplified by the embodiments 3 and 4, having the operation member 53 be shared makes it possible to use a variety of liquid storage bags.

The horizontal direction is an example of a direction of intersection, the ink an example of a liquid, the printer 10 an example of a liquid consumption apparatus, and the liquid storage bag 52 an example of a liquid storage part. The first, second, and third films 521, 522, 523 are examples of film members. The notch part 529 is an example of a notch part, the lead out part 550 and first chamber 558 an example of a connection flow path, and the bypass 562 an example of a bypass flow path.

The present invention is not limited to the embodiments or working examples described above, nor to the modification examples, and can be realized in a variety of configurations within a scope that does not depart from the essence thereof. For example, the technical features in the embodiments/working examples and modification examples corresponding to the technical features in each of the modes set forth in the Summary of the Invention could be replaced or combined as appropriate in order to partially or entirely solve the above problems, or in order to partially or entirely achieve the above effects. The technical features thereof, where not described as being essential in the description, can also be removed as appropriate. Examples could include the following.

Figure 62:
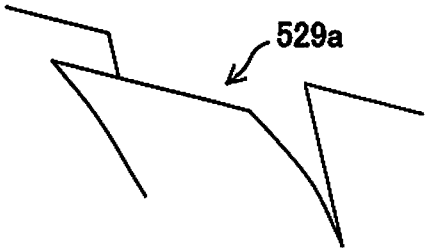
FIG. 62 is a drawing (modification example) illustrating a notching of a film.

Instead of the notch part 529 (FIG. 10), incisions 529*a* may be provided as illustrated in FIG. 62.

The abutment part 80 need not be provided integrally with the storage space part 26, and may be provided as a separate body. For example, a soft member such as a sponge may be fixed with an adhesive or the like and thereby made to function as the abutment part. Alternatively, a spring may be installed in the storage space part 26, with the abutment part 80 provided on this spring. In this manner, damage to the liquid storage bag 52 is further curbed.

The liquid container 50 may have any posture at the time of injection of the ink. The top and bottom may be reversed from the embodiments, i.e., with the liquid storage bag 52 further in the +Z-axis direction than the operation member 53, or the liquid container 50 may be laid such that the central axis CT of the liquid supply tube part 57 is oriented in the +Z-axis direction or the −Z-axis direction.

Alternatively, the posture may be one where the liquid storage bag 52 is bent.

When the liquid injection member 13 is being pulled out, the posture of the liquid container 50 may be changed from during insertion of the liquid injection member 13.

All three or any two among the joining member 53A, the liquid supply part 53B, and the pressing member 53C may be molded with the same material.

In the embodiments described above, the liquid storage bag 52 was formed of a flexible member, but there is no limitation thereto, and the liquid storage bag 52 need only function as a liquid storage part with which a liquid can be stored in the interior. For example, the liquid storage bag 52 may be formed of a member that is partially flexible, or may be formed of a rigid member with which the volume does not change regardless of the amount of liquid consumed. When the liquid storage bag 52 to be formed of a member that is at least partially flexible, this allows the volume to change depending on the amount of ink that is stored in the liquid storage bag 52.

In the embodiments described above, the operation member 53 was in the shape of a frame, but the shape is not limited thereto, and the operation member 53 need only be of a shape that can be grasped by the user. For example, the operation member 53 may be of a rod shape (plate shape) that extends along the Z-axis direction.

In the embodiments described above, the joining member 53A, the liquid supply unit 55, the circuit board retention part 59, and the like were formed by combining the three members 53A, 53B, 53C, but there is no limitation thereto. For example, an assembly formed by combining the three members 53A, 53B, 53C may be integrally formed. One method of integral formation would be integral molding or to attach each of the members 53A, 53B, 53C using an adhesive or the like. This makes it possible to easily manufacture the liquid container 50. Further, the liquid supply unit 55 and the substrate unit 58 can be formed integrally, and therefore the positioning between the two units 55, 58 can be performed with precision. The joining member 53A and the bonded part 549 can also be formed integrally. This enables a reduction in the possibility that the weight of the liquid storage bag 52 could cause the bonded part 549 and the joining member 53A to separate when the user grips the joining member 53A. Also, when the user grips the joining member 53A, a load produced by the weight of the liquid storage bag 52 acts on the joining member 53A via the bonded part 549. This makes it possible to reduce the external force applied to the liquid storage bag 52 itself, and therefore enables a reduction in the possibility of the liquid storage bag 52 being damaged. Additionally, the liquid supply part 53B and the liquid storage bag 52 may be integrally molded.

The present invention is not limited to the inkjet printer and the liquid container 50 therefor, but rather can be applied also to an arbitrary print apparatus (liquid consumption apparatus) for jetting a liquid other than ink, and to a liquid container for storing a liquid therefor. For example, the present invention could be applied to the following variety of liquid jet apparatuses and liquid containers therefor.

(1) An image recording apparatus, such as a facsimile
(2) A color material jet apparatus used to manufacture a color filter for an image display apparatus such as a liquid crystal display
(3) An electrode material jet apparatus used in electrode formation for an organic electroluminescence (EL) display, a field emission display (FED), or the like
(4) A liquid spray apparatus for spraying a liquid including a bio-organic material used to produce a bio-chip
(5) A sample spray apparatus that serves as a precision pipette
(6) An apparatus for spraying lubricating oil
(7) An apparatus for spraying a resin solution
(8) A liquid spray apparatus for spraying lubricating oil at pinpoints onto precision machinery of a timepiece, camera, or the like
(9) A liquid spray apparatus for spraying a substrate with a transparent resin solution, such as an ultraviolet-ray-curable resin solution, in order to form a hemispherical microlens (an optical lens) or the like to be used in an optical communication element or the like
(10) A liquid spray apparatus for spraying an acidic or alkaline etching solution in order to etch a substrate or the like
(11) A liquid spray apparatus provided with a liquid spray head for ejecting small amounts of liquid droplets of any desired liquid The phrase "liquid droplets" refers to the state of a liquid that is ejected from a liquid spray apparatus, and is understood to also include a liquid that leaves a particulate, tear-shaped, or filamentous trail. The phrase "liquid" as stated herein should be such a material that the liquid spray apparatus is able to spray the material. For example, the "liquid" should be a material that is in a state of when a substance is a liquid phase, and the phrase "liquid" also includes highly- or poorly-viscous liquid-state materials, as well as sols, gel waters, and other such liquid-state materials as inorganic solvents, organic solvents, solutions, liquid-state resins, and liquid-state metals (metallic melts). The "liquid" moreover encompasses a liquid as one state of a substance, but also particles of a functional material composed of solid matter, such as pigments or metal particle, that have been dissolved, dispersed, or mixed into a solvent, and the like. Representative examples of liquids include ink, as was described in the embodiments above, as well as liquid crystal and the like. Herein, the term "ink" is understood to comprise a variety of compositions in the form of a liquid, such as general water-soluble ink and oil-soluble ink as well as gel ink, hot melt ink, and the like.

A laminated structure obtained when a plurality of films are laminated may be used to form the first through third films 521 to 523. With such a laminated structure, for example, the outer layers may be formed of an excellently impact-resistant PET or nylon, and the inner layers may be formed of an excellently ink-resistant polyethylene. A film having a layer onto which aluminum or the like has been deposited may serve as one of the structural materials of the laminated structure. This makes it possible to improve the gas barrier properties, and therefore makes it possible, for example, to curb any change in concentration of the ink that is stored in the liquid storage bag 52. The material of the liquid storage bag 52 can thus be set arbitrarily. One film may be folded and welded to the bonded parts 549*a*, 549*b*. With such a mode, as well, it is possible to recognize one end part as having been formed on a plurality of film members.

The shape and size of the liquid storage bag 52 can be respectively set as desired. For example, the liquid storage bag 52K for storing the black ink may be given a greater volume (size) than the liquid storage bag 52C for storing another color ink (cyan, by way of example).

The positioning part 56 may be provided integrally to the operation member 53, by attaching the positioning part 56 to the operation member 53 with an adhesive or the like. Also, the positioning part 56 was provided to near the liquid supply port 572 in such a form as to surround the peripheral direction, excluding above the liquid supply port 572, but in a case where the operation member 53 is composed of a material that is not readily deformed, then the positioning part 56 may be provided to a position of the operation member 53 that is somewhat removed from the liquid supply port 572.

The numbers of the cover member 22, the liquid container 50, and the detachable unit 30 are not intended to be limited to what was described above. For example, there may be three or fewer liquid containers 50, or may be five or more. The detachable units 30 may be provided in a number that corresponds to the number of liquid containers 50. There may be one cover member 22, or may be three or more.

The number of engagement parts 511A, 511B, 511C may be two or fewer, or may be four or more.

There may be four or more of the engagement parts 513, or may be two or fewer.

In the replacement of the substrate unit 58, the joining member 53A need not be replaced. In other words, the configuration may be such that the substrate unit 58 is removed from the joining member 53A, and a new substrate unit 58 is attached. In such a case, too, removing the joining member 53A facilitates the work of replacing the substrate unit 58.

The flow path member may not be provided. Even when the flow path member is not provided, the first through third films are flexible and therefore there is not so much of the residual ink.

The invention claimed is:

1. A liquid container comprising:

a liquid storage part including at least first and second film members that face each other in a first direction and are partially welded to each other; and a liquid supply part configured to supply a liquid stored in the liquid storage part to a liquid consumption apparatus, the liquid supply part including a bonded part with a bonding surface, the bonded part being disposed between the first and second film members in the first direction such that the bonding surface and one of the first and second film members are bonded to each other at one end portion of the liquid storage part in the first direction, and a liquid supply tube part at which is formed a liquid supply port oriented in the first direction intersecting with the bonding surface of the bonded part, the liquid supply tube part being provided such that at least a part of the liquid supply port overlaps with the bonded part as viewed in the first direction, which is an axial direction of the liquid supply tube part.

2. The liquid container as set forth in claim 1, wherein a notch part is provided to one part of the film member constituting the one end portion of the liquid storage part, and at least one portion of the liquid supply tube part is arranged so as to enter into the notch part.

3. The liquid container as set forth in claim 1, wherein the liquid supply part has an overhanging part overhanging more to an interior side of the liquid storage part than a position of the liquid supply tube part, at least one portion of a surface of the overhanging part is the bonding surface, and the overhanging part has inside thereof a connection flow path that connects the liquid supply port and an inside of the liquid storage part.

4. The liquid container as set forth in claim 3, wherein the overhanging part has inside thereof a bypass flow path that connects the connection flow path and the inside of the liquid storage part.

5. The liquid container as set forth in claim 1, wherein the liquid supply part is supported so as to be located further upward in a direction of the force of gravity than the liquid storage part in a state of having been connected to the liquid consumption apparatus, and such that the liquid supply port is oriented in an intersecting direction, which is a direction that intersects with the direction of the force of gravity.

6. The liquid container as set forth in claim 5, wherein the liquid supply part moves in the intersecting direction and is subsequently connected to the liquid consumption apparatus.

7. A liquid container comprising:

a liquid storage part including at least first and second film members that face each other in a first direction and are partially welded to each other; and a liquid supply part configured to supply a liquid stored in the liquid storage part to a liquid consumption apparatus, the liquid supply part including a bonded part with a bonding surface, the bonded part being disposed between the first and second film members in the first direction such that the bonding surface and one of the first and second film members are bonded to each other at one end portion of the liquid storage part in the first direction, and a liquid supply tube part at which is formed a liquid supply port oriented in the first direction intersecting with the bonding surface of the bonded part, the first film member having a notch part at the one end portion of the liquid storage part, and at least one portion of the liquid supply tube part being arranged so as to enter into the notch part in the first direction.

* * * * *